US010464317B2

(12) United States Patent
Hirai et al.

(10) Patent No.: US 10,464,317 B2
(45) Date of Patent: Nov. 5, 2019

(54) LIQUID EJECTING HEAD AND LIQUID EJECTING APPARATUS

(71) Applicant: SEIKO EPSON CORPORATION, Tokyo (JP)

(72) Inventors: Eiju Hirai, Azumino (JP); Motoki Takabe, Shiojiri (JP); Daisuke Yamada, Shiojiri (JP); Yoichiro Kondo, Chino (JP); Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/030,699

(22) Filed: Jul. 9, 2018

(65) Prior Publication Data

US 2019/0016126 A1 Jan. 17, 2019

(30) Foreign Application Priority Data

Jul. 13, 2017 (JP) ..... 2017-136863

(51) Int. Cl.
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/04586* (2013.01); *B41J 2/04588* (2013.01); *B41J 2/04595* (2013.01); *B41J 2/04596* (2013.01); *B41J 2/14233* (2013.01); *B41J 2002/14419* (2013.01); *B41J 2002/14491* (2013.01); *B41J 2202/18* (2013.01)

(58) Field of Classification Search
CPC combination set(s) only.
See application file for complete search history.

(56) References Cited

U.S. PATENT DOCUMENTS

2016/0263887 A1* 9/2016 Tanaka ..... B41J 2/14233
2018/0117912 A1 5/2018 Tanaka

FOREIGN PATENT DOCUMENTS

JP 2016-165847 A 9/2016
JP 2016-179572 A 10/2016

* cited by examiner

*Primary Examiner* — Bradley W Thies
(74) *Attorney, Agent, or Firm* — Workman Nydegger

(57) ABSTRACT

A liquid ejecting head includes a drive element, a drive circuit that outputs a signal for driving the drive element, and a wiring board. The wiring board is provided with a power supply wire through which power is supplied to the drive circuit, a first drive signal wire through which a first drive signal is supplied to the drive circuit, and a second drive signal wire through which a second drive signal is supplied to the drive circuit and that is not electrically connected to the power supply wire and the first drive signal wire on the wiring board, each of the first drive signal wire and the second drive signal wire is provided with a buried wire that is buried in a groove, and the first drive signal wire and the second drive signal wire are different from each other in number of the buried wires.

16 Claims, 20 Drawing Sheets

FIG. 22

| STRUCTURE | TOTAL NUMBER OF BURIED WIRES | | COM1 | | | COM2 | | VBS | COM1 -COM2 | COUNTERMEASURE FOR VOLTAGE DROP OF COM1 | CRACK RISK | ADDITIONAL SPACE |
|---|---|---|---|---|---|---|---|---|---|---|---|---|
| | FIRST SURFACE | SECOND SURFACE | FIRST SURFACE | SECOND SURFACE | TOTAL | FIRST SURFACE | SECOND SURFACE | SECOND SURFACE | | | | |
| EMBODIMENT 1 | 7 | 6 | 2 | 0 | 2 | 1 | 0 | 6 | 1 | ○ | HIGH | NECESSARY |
| EMBODIMENT 2 | 6 | 6 | 1 | 2 | 3 | 1 | 0 | 4 | 2 | ○ | LOW | NOT NECESSARY |
| EMBODIMENT 3 | 6 | 6 | 1 | 2 | 3 | 1 | 1 | 4 | 1 | ○ | HIGH | NECESSARY |
| EMBODIMENT 4 | 7 | 7 | 2 | 2 | 4 | 1 | 1 | 4 | 2 | ◎ | LOW | NECESSARY |
| COMPARATIVE EXAMPLE | 6 | 6 | 1 | 0 | 1 | 1 | 0 | 6 | 0 | × | LOW | — |

LIQUID EJECTING HEAD AND LIQUID EJECTING APPARATUS

The entire disclosure of Japanese Patent Application No. 2017-136863, filed Jul. 13, 2017 is expressly incorporated by reference herein.

BACKGROUND

1. Technical Field

The present invention relates to a liquid ejecting head which ejects liquid from a nozzle and a liquid ejecting apparatus and particularly relates to an ink jet recording head that discharges ink as liquid and an ink jet recording apparatus.

2. Related Art

A liquid ejecting head is provided with a drive element that causes a pressure change in a flow path communicating with a nozzle opening and a wiring board on which a drive circuit is provided, the drive circuit including a switching element that outputs a signal for driving the drive element.

The wiring board is provided with a wire through which a drive signal is supplied to the drive circuit, a wire through which power is supplied to the drive circuit, or the like. In addition, as the drive circuit, there is proposed a drive circuit through which two or more kinds of different drive signals are supplied (for example, refer to JP-A-2016-179572).

In addition, when the electrical resistivity of a wire provided on the wiring board, particularly, a wire through which bias voltage, which is the reference potential of the drive element, is supplied is high, there is voltage drop and there is a variation in driving state of the drive element. Therefore, it is desired to use a wire having a low electrical resistivity as the wire through which the bias voltage is supplied. However, in order to arrange wires at a high density and a high accuracy or in order to mount an electronic component on a wire, it is necessary to suppress the height of a wire. Therefore, there is proposed a configuration in which a wiring board is provided with a groove and a wire is buried in the groove such that the height of the wire is suppressed (for example, refer to JP-A-2016-165847).

However, a wire through which different kinds of drive signals are supplied has a problem that it becomes not possible to stably drive the drive element when there is voltage drop in a wire in which a large electric current flows since the value of an electric current flowing through the wire is different depending on the kind thereof.

In addition, when only the number of wires that supply a drive signal is increased, a space for the wires becomes necessary and the size of the wiring board is increased.

Such a problem is not limited to an ink jet recording head and a liquid ejecting head that ejects liquid other than ink has the same problem.

SUMMARY

An advantage of some aspects of the invention is to provide a liquid ejecting head and a liquid ejecting apparatus with which it is possible to stably drive a drive element and to realize a decrease in size.

According to an aspect of the invention, there is provided a liquid ejecting head including a drive element that causes a change in pressure of liquid in a flow path communicating with a nozzle from which the liquid is ejected, a drive circuit that outputs a signal for driving the drive element, and a wiring board of which a first surface is on the drive circuit side and a second surface is on the drive element side, the first surface being on a side opposite to the drive element, in which the wiring board is provided with a power supply wire through which power is supplied to the drive circuit, a first drive signal wire through which a first drive signal is supplied to the drive circuit, and a second drive signal wire through which a second drive signal is supplied to the drive circuit and that is not electrically connected to the power supply wire and the first drive signal wire on the wiring board, each of the first drive signal wire and the second drive signal wire is provided with a buried wire that is buried in a groove provided on the wiring board, and the first drive signal wire and the second drive signal wire are different from each other in number of the buried wires.

In this case, it is possible to decrease the electrical resistivity of a wire having a large number of buried wires such that a voltage drop of a drive signal to be supplied is suppressed by increasing the number of buried wires of one of the first drive signal wire and the second drive signal wire. In addition, it is possible to suppress an increase in size of the wiring board and to achieve a decrease in size of the wiring board by decreasing the number of buried wires of one of the first drive signal wire and the second drive signal wire.

In the liquid ejecting head, a plurality of the drive elements are preferably provided, a common electrode that is common to the plurality of drive elements is preferably provided, the wiring board is preferably provided with a bias wire that is connected to the common electrode and through which a bias voltage, which is a reference potential, is supplied to the common electrode, the bias wire is preferably provided with a buried wire that is buried in a groove provided on the wiring board, and the number of the buried wires of the bias wire is preferably equal to or larger than any one of the number of the buried wires of the first drive signal wire and the number of the buried wires of the second drive signal wire. In this case, the electrical resistivity of the bias wire can be decreased. Therefore, in a case where a drive element having a piezoelectric characteristic in which a relationship between voltage and electric-field-induced strain (displacement) is represented by a butterfly curve is used as the drive element, the electrical resistivity of the bias wire on the ground side in which a variation in displacement characteristic with respect to a variation in voltage is large is reliably suppressed and a variation in displacement characteristics of the drive element can be further suppressed.

In the liquid ejecting head, any one of the first drive signal wire and the second drive signal wire is preferably disposed close to an outer periphery side of the wiring board and the number of the buried wires of the one of the first drive signal wire and the second drive signal wire, which is disposed close to the outer periphery side of the wiring board, is preferably larger than the number of the buried wires of the other one of the first drive signal wire and the second drive signal wire. In this case, it is possible to suppress an increase in size of the wiring board by increasing the number of the buried wires close to the outer periphery side of the wiring board, on which a relatively large available space is provided and it is easy to perform wiring.

In addition, in the liquid ejecting head, the number of the buried wires provided on the first surface and the number of the buried wires provided on the second surface may be different from each other.

In addition, in the liquid ejecting head, the number of the buried wires provided on the second surface is preferably larger than the number of the buried wires provided on the first surface. In this case, it is possible to suppress an increase in size of the wiring board by increasing the number of the buried wires on the second surface of the wiring board, on which a relatively large available space is provided.

In addition, in the liquid ejecting head, the number of the buried wires provided on the first surface and the number of the buried wires provided on the second surface are preferably the same as each other. In this case, warping of the wiring board, which occurs due to a difference between the first surface and the second surface in area ratio of buried wires when buried wires having a linear expansion coefficient and an in-plane stress different from those of the wiring board are buried, can be suppressed.

In addition, in the liquid ejecting head, a plurality of the drive elements are preferably provided, a common electrode that is common to the plurality of drive elements is preferably provided, the wiring board is preferably provided with a bias wire that is connected to the common electrode and through which a bias voltage, which is a reference potential, is supplied to the common electrode, wherein the bias wire is preferably provided with a buried wire that is buried in a groove provided on the wiring board, and one of the first drive signal wire and the second drive signal wire, which is provided with a larger number of buried wires, the bias wire, and the other one of the first drive signal wire and the second drive signal wire, which is provided with a smaller number of buried wires, are preferably arranged in this order. In this case, a large electric current can be caused to flow through a wire having a large number of buried wires and an induced electromotive current can be decreased with the wire having a large number of buried wires and the bias wire disposed to face each other. Therefore, distortion of a drive waveform of a drive signal flowing through a wire, so-called overshoot or undershoot can be suppressed.

Furthermore, according to another aspect of the invention, there is provided a liquid ejecting apparatus including the liquid ejecting head described above and a drive signal generation circuit that generates the first drive signal and the second drive signal, in which the number of the buried wires of the first drive signal wire is larger than the number of buried wires of the second drive signal wire in a case where a value of an electric current, which flows through the first drive signal wire for one discharge cycle via the first drive signal and the second drive signal generated by the drive signal generation circuit, is larger than a value of an electric current, which flows through the second drive signal wire for one discharge cycle via the first drive signal and the second drive signal generated by the drive signal generation circuit.

In this case, it is possible to decrease the electrical resistivity of the first drive signal wire such that a voltage drop of the first drive signal is suppressed by increasing the number of the buried wires of the first drive signal wire in which a large electric current flows. In addition, since the number of the buried wires of the second drive signal wire, in which a relatively small electric current flows, is smaller than that of the first drive signal wire, it is not necessary to secure a meaningless space for providing the buried wires on the wiring board and thus a decrease in size of the wiring board can be achieved.

In addition, according to still another aspect of the invention, there is provided a liquid ejecting head including a drive element that causes a change in pressure of liquid in a flow path communicating with a nozzle from which the liquid is ejected, a drive circuit that outputs a signal for driving the drive element, and a wiring board of which a first surface is on the drive circuit side and a second surface is on the drive element side, the first surface being on a side opposite to the drive element, in which the wiring board is provided with a power supply wire through which power is supplied to the drive circuit, a first drive signal wire through which a first drive signal is supplied to the drive circuit, and a second drive signal wire through which a second drive signal is supplied to the drive circuit and that is not electrically connected to the power supply wire and the first drive signal wire on the wiring board, each of the first drive signal wire and the second drive signal wire is provided with a buried wire that is buried in a groove provided on the wiring board, and a total electrical resistivity of the buried wires of the first drive signal wire and a total electrical resistivity of the buried wires of the second drive signal wire are different from each other.

In this case, it is possible to suppress a voltage drop of the drive signal to be supplied by decreasing the electrical resistivity of one of the first drive signal wire and the second drive signal wire. In addition, it is possible to reduce an installation space by increasing the electrical resistivity of the other one of the first drive signal wire and the second drive signal wire and it is possible to achieve a decrease in size of the wiring board by suppressing an increase in size of the wiring board.

In addition, according to still another aspect of the invention, there is provided a liquid ejecting apparatus including the liquid ejecting head described above.

In this case, it is possible to realize a liquid ejecting apparatus with which it is possible to stably drive a drive element and to realize a decrease in size.

BRIEF DESCRIPTION OF THE DRAWINGS

The invention will be described with reference to the accompanying drawings, wherein like numbers reference like elements.

FIG. 22 is a table that shows the number of buried wires in Embodiments 1 to 4 and a comparative example.

DESCRIPTION OF EXEMPLARY EMBODIMENTS

Figure 1:
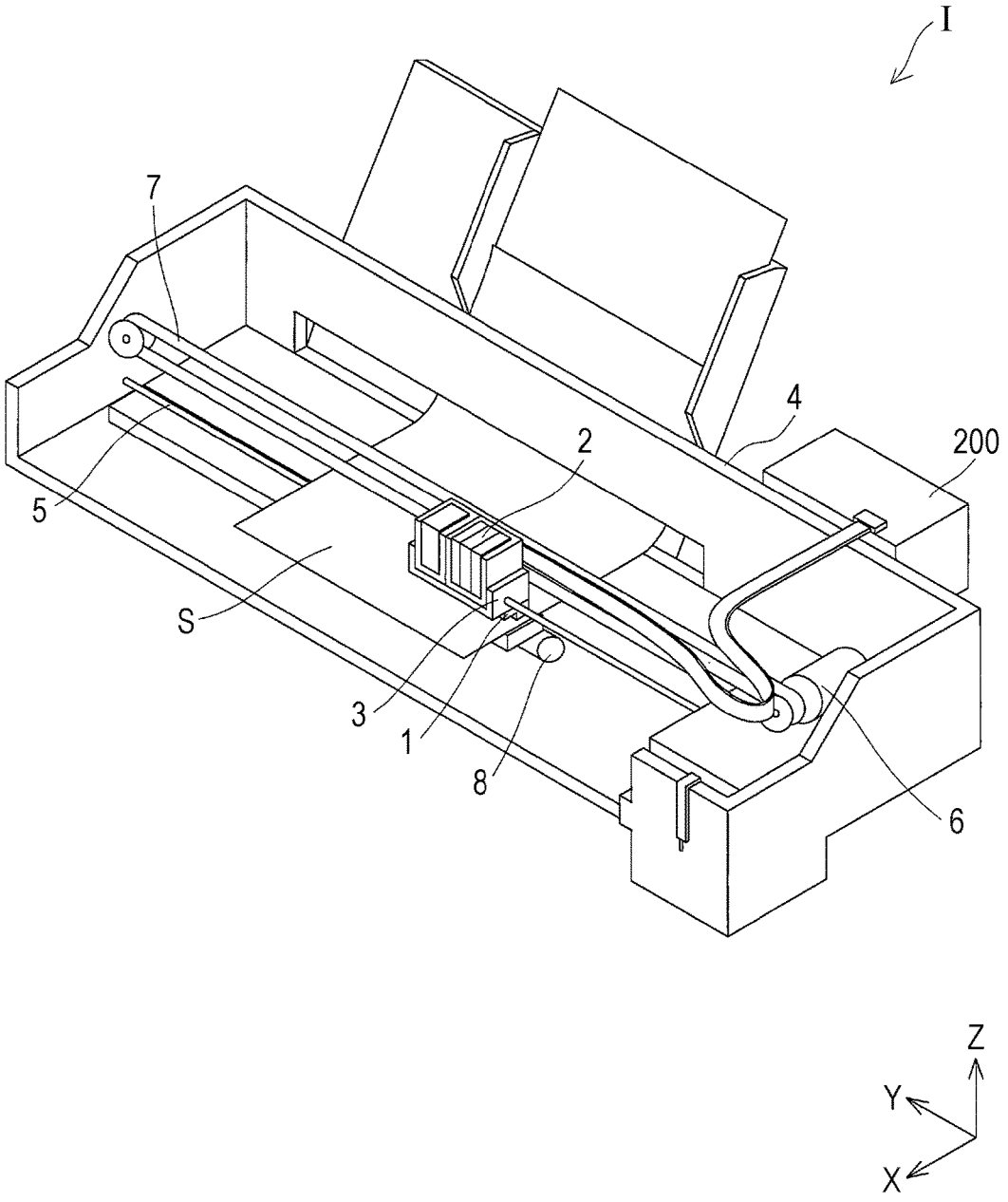
FIG. 1 is a view illustrating a schematic configuration of a recording apparatus according to Embodiment 1.

Hereinafter, embodiments of the invention will be described with reference to drawings. However, the following description is for describing an embodiment of the invention and can be randomly modified within the scope of the invention. In each drawing, members with the same reference numerals are the same members and description thereof will be appropriately omitted. In addition, in each drawing, X, Y, and Z respectively represent three spatial axes orthogonal to each other. In the specification, directions along the axis will be referred to as a first direction X, a second direction Y, and a third direction Z.

Embodiment 1

FIG. 1 is a view illustrating a schematic configuration of an ink jet recording apparatus, which is a liquid ejecting apparatus according to Embodiment 1 of the invention.

As illustrated in FIG. 1, an ink jet recording apparatus I, which is an example of the liquid ejecting apparatus, includes an ink jet recording head 1 (hereinafter, simply referred to as recording head 1 in some cases) which is an example of a liquid ejecting head that discharges ink as liquid in the form of ink droplets.

A cartridge 2 that constitutes an ink supply unit is detachably provided on the recording head 1 and a carriage 3 in which the recording head 1 is installed is provided on a carriage shaft 5 attached to an apparatus main body 4 such that the carriage 3 can move in an axial direction. In the present embodiment, a direction in which the carriage 3 moves is the second direction Y.

In addition, when a driving force from a drive motor 6 is transmitted to the carriage 3 via a plurality of gears (not shown) and a timing belt 7, the carriage 3 in which the recording head 1 is installed moves along the carriage shaft 5. Meanwhile, the apparatus main body 4 is provided with a transportation roller 8 as a transportation unit and a recording sheet S, which is a recording medium such as a paper sheet, is transported by the transportation roller 8. Note that, the transportation unit that transports the recording sheet S is not limited to the transportation roller and may be a belt, a drum, or the like. In the present embodiment, a transportation direction of the recording sheet S is the first direction X. In addition, a direction orthogonal to both of the first direction X and the second direction Y is the third direction Z.

In addition, as illustrated in FIG. 1, the ink jet recording apparatus I is provided with a control device 200. Here, an electrical configuration in the present embodiment will be described with reference to FIG. 2. Note that, FIG. 2 is a block diagram illustrating the electrical configuration of the ink jet recording apparatus according to Embodiment 1 of the invention.

Figure 2:
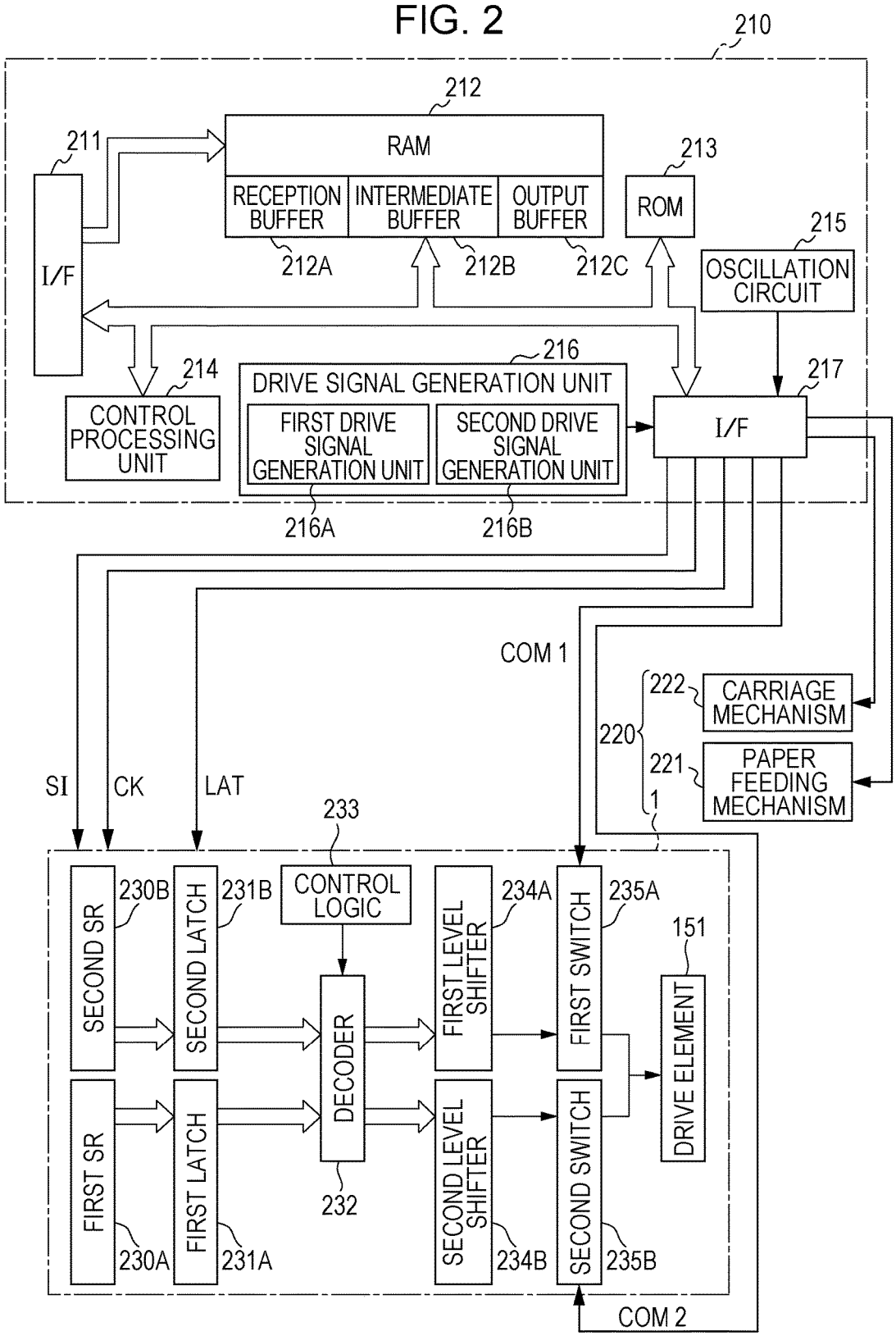
FIG. 2 is a block diagram illustrating an electrical configuration of the recording apparatus according to Embodiment 1.

As illustrated in FIG. 2, the ink jet recording apparatus I is provided with a printer controller 210, which is a controller in the present embodiment, and a printer engine 220.

The printer controller 210 is an element that controls the entire ink jet recording apparatus I and in the present embodiment, the printer controller 210 is provided in the control device 200 with which the ink jet recording apparatus I is provided.

The printer controller 210 is provided with an external interface 211 (hereinafter, referred to as external I/F 211), a RAM 212 that temporarily stores various data, a ROM 213 that stores a control program or the like, a control processing unit 214 configured to include a CPU or the like, an oscillation circuit 215 that generates a clock signal (CK), a drive signal generation unit 216 which is a drive signal generation circuit generating a drive signal to be supplied to the recording head 1, and an internal interface 217 (hereinafter, referred to as internal I/F 217) that transmits dot pattern data (bit map data) or the like developed based on the drive signal or printing data to the printer engine 220.

The external I/F 211 receives, for example, printing data including a character code, a graphic function, image data or the like from a host computer or the like (not shown). In addition, a busy signal (BUSY) or an acknowledge signal (ACK) is output to an external apparatus such as the host computer through the external I/F 211. The RAM 212 functions as a reception buffer 212A, an intermediate buffer 212B, an output buffer 212C and a work memory (not shown). In addition, the reception buffer 212A temporarily stores the printing data received via the external I/F 211, the intermediate buffer 212B stores intermediate code data converted by the control processing unit 214, and the output buffer 212C stores the dot pattern data. Note that, the dot pattern data is configured of recording data (SI) which is obtained by decoding (translating) gradation data.

The drive signal generation unit 216 is provided with a first drive signal generation unit 216A, which is a first drive signal generating unit that can generate a first drive signal COM1, and a second drive signal generation unit 216B, which is a second drive signal generating unit that can generate a second drive signal COM2.

Although details will be described later, the first drive signal COM1 generated by the first drive signal generation unit 216A is a signal including a first discharge pulse DP1, a second discharge pulse DP2, and a third discharge pulse DP3 in one recording cycle T, the discharge pulses driving the recording head 1 such that ink droplets are discharged from nozzle openings of the recording head 1. The first drive signal COM1 is repeatedly generated for each recording cycle T.

In addition, although details will be described later the second drive signal COM2 generated by the second drive signal generation unit 216B is a signal including a fourth discharge pulse DP4 and a slight vibration pulse VP in one recording cycle T, the fourth discharge pulse DP4 driving the recording head 1 such that ink droplets are discharged from the nozzle openings of the recording head 1 and the slight vibration pulse VP driving the recording head 1 such that ink droplets are not discharged from the nozzle openings. The second drive signal COM2 is repeatedly generated for each recording cycle T. Note that, the recording cycle T is a unit in which the drive signals COM are repeatedly generated and is a kind of a discharge cycle in the invention. The recording cycle T corresponds to one pixel in an image printed on the recording sheet S. Note that, the details of the first drive signal COM1 and the second drive signal COM2 will be described later.

The ROM 213 stores font data, a graphic function, or the like in addition to the control program (control routine) for various data processing. The control processing unit 214 reads the printing data in the reception buffer 212A and causes the intermediate buffer 212B to store intermediate code data, which is obtained by converting the printing data. In addition, the control processing unit 214 analyzes the intermediate code data read from the intermediate buffer 212B and develops the intermediate code data into the dot pattern data by referring to the font data, the graphic function, or the like stored in the ROM 213. Then, after performing a necessary decoration process, the control processing unit 214 causes the output buffer 212C to store the dot pattern data obtained through the development.

When the dot pattern data corresponding to one line of the recording head 1 is acquired, the dot pattern data corresponding to one line is output to the recording head 1 through the internal I/F 217. In addition, when the dot pattern data corresponding to one line is output from the output buffer 212C, the intermediate code data after the development is deleted from the intermediate buffer 212B and a development process for next intermediate code data is performed.

The printer engine 220 is configured to include the recording head 1, a paper feeding mechanism 221, and a carriage mechanism 222. The paper feeding mechanism 221 is configured to include the transportation roller 8 and a motor or the like (not shown) that drives the transportation roller 8 and the paper feeding mechanism 221 sequentially feeds the recording sheet S in accordance with a recording operation of the recording head 1. That is, the paper feeding mechanism 221 relatively moves the recording sheet S in the first direction X. The carriage mechanism 222 is provided with the carriage 3 and the drive motor 6 or the timing belt 7 that moves the carriage 3 in the second direction Y along the carriage shaft 5.

Although details will be described later, the recording head 1 is provided with a nozzle row. The nozzle row is a plurality of nozzle openings arranged in parallel along the first direction X, which is a sub scanning direction. At a timing prescribed in the dot pattern data or the like, an ink droplet as a liquid droplet is discharged from each nozzle opening 21.

Here, the electrical configuration of the recording head 1 in the present embodiment will be described. As illustrated in FIG. 2, the recording head 1 is provided with a shift register circuit configured with a first shift register 230A and a second shift register 230B, a latch circuit configured with a first latch circuit 231A and a second latch circuit 231B, a decoder 232, a control logic 233, a level shifter circuit configured with a first level shifter 234A and a second level shifter 234B, a switch circuit configured with a first switch 235A and a second switch 235B, and a drive element 151 that causes an ink pressure change in a flow path of the recording head 1. In addition, each of the shift registers 230A and 230B, each of the latch circuits 231A and 231B, each of the level shifters 234A and 234B, the switches 235A and 235B, and the drive element 151 are provided to correspond to each of the nozzle openings.

The recording head 1 discharges an ink droplet based on the recording data (SI) from the printer controller 210. In the present embodiment, the recording data is send to the recording head 1 in order from a high-order bit group of the recording data to a low-order bit group of the recording data. Therefore, first, the high-order bit group of the recording data is set in the second shift register 230B. When the high-order bit group of the recording data is set in the second shift register 230B with respect to all of the nozzle openings, the high-order bit group of the recording data is shifted to the first shift register 230A. At the same time, the low-order bit group of the recording data is set in the second shift register 230B.

The first latch circuit 231A is electrically connected to a rear stage of the first shift register 230A and the second latch circuit 231B is electrically connected to a rear stage of the second shift register 230B. In addition, when a latch signal (LAT) from the printer controller 210 is input to the latch circuits 231A and 231B, the first latch circuit 231A latches the high-order bit group of the recording data and the second latch circuit 231B latches the low-order bit group of the recording data. The recording data (high-order bit group and low-order bit group) latched in the latch circuits 231A and 231B is output to the decoder 232. The decoder 232 generates pulse selection data for selection of the first discharge pulse DP1, the second discharge pulse DP2, and the third discharge pulse DP3 constituting the first drive signal COM1 and selecting the fourth discharge pulse DP4 and the slight vibration pulse VP constituting the second drive signal COM2 based on the high-order bit group and the low-order bit group of the recording data.

The pulse selection data is generated for each of the first drive signal COM1 and the second drive signal COM2. That is, first pulse generation data corresponding to the first drive signal COM1 is configured with one-bit data. In addition, second pulse generation data corresponding to the second drive signal COM2 is configured with one-bit data.

In addition, a timing signal from the control logic 233 is also input to the decoder 232. The control logic 233 generates the timing signal in synchronization with input of the latch signal or a channel signal. The timing signal is also generated for each of the first drive signal COM1 and the second drive signal COM2. Pieces of the pulse selection data generated by the decoder 232 are sequentially input to the level shifters 234A and 234B in order from a high-order bit at a timing prescribed in the timing signal. The level shifters 234A and 234B function as a voltage amplifier and in a case where the pulse selection data is "×1", the level shifters 234A and 234B output an electric signal, of which the voltage value is increased to a voltage value at which the corresponding switches 235A and 235B can be driven, for example, a several tens of volts. That is, in a case where the first pulse selection data is "×1", an electrical signal is output to the first switch 235A and in a case where the second pulse selection data is "×1", an electrical signal is output to the second switch 235B and the second switch 235B enters a connected state.

The first drive signal COM1 from the first drive signal generation unit 216A is supplied to an input side of the first switch 235A and the second drive signal COM2 from the second drive signal generation unit 216B is supplied to an input side of the second switch 235B. In addition, the drive element 151 is electrically connected to an output side of each of the switches 235A and 235B. The first switch 235A and the second switch 235B are provided to respectively correspond to the kinds of drive signals generated and are interposed between the drive signal generation unit 216 and the drive element 151 such that the first drive signal COM1 and the second drive signal COM2 are selectively supplied to the drive element 151. Note that, when both of the first switch 235A and the second switch 235B enter a disconnected state, the first drive signal COM1 and the second drive signal COM2 are not supplied to the drive element 151.

The pulse selection data as described above is for controlling the operation of each of the switches 235A and 235B. That is, during a period in which the pulse selection data input to the first switch 235A is "×1", the first switch 235A enters a conduction state in which the first switch 235A is connected and the first drive signal COM1 is supplied to the drive element 151. Similarly, during a period in which the pulse selection data input to the second switch 235B is "×1", the second switch 235B enters a conduction state in which the second switch 235B is connected and the second drive signal COM2 is supplied to the drive element 151. In addition, a discharge signal applied to the drive element 151 is changed corresponding to the supplied first drive signal COM1 and the second drive signal COM2. Meanwhile, during a period in which both of pieces of the pulse selection data input to the switches 235A and 235B are "×0", each of the switches 235A and 235B enters the disconnected state and the first drive signal COM1 and the second drive signal COM2 are not supplied to the drive element 151. In short, a pulse during a period in which "×1" is set as the pulse selection data is selectively supplied to the drive element 151. Note that, during a period in which the pieces of pulse selection data are "×0", since each drive element 151 holds a previous potential, a previous displacement state is maintained.

As described above, in the present embodiment, the decoder 232, the control logic 233, each of the level shifters 234A and 234B, and each of the switches 235A and 235B function as a drive element control unit and control the behavior of the drive element 151 by controlling supply of the first drive signal COM1 and the second drive signal COM2 in accordance with the recording data (gradation data).

Next, the first drive signal COM1 and the second drive signal COM2 generated by the drive signal generation unit 216 and supply control of the first drive signal COM1 and the second drive signal COM2 to the drive element will be described. Note that, FIG. 3 is drive waveforms illustrating the drive signals.

Figure 3:
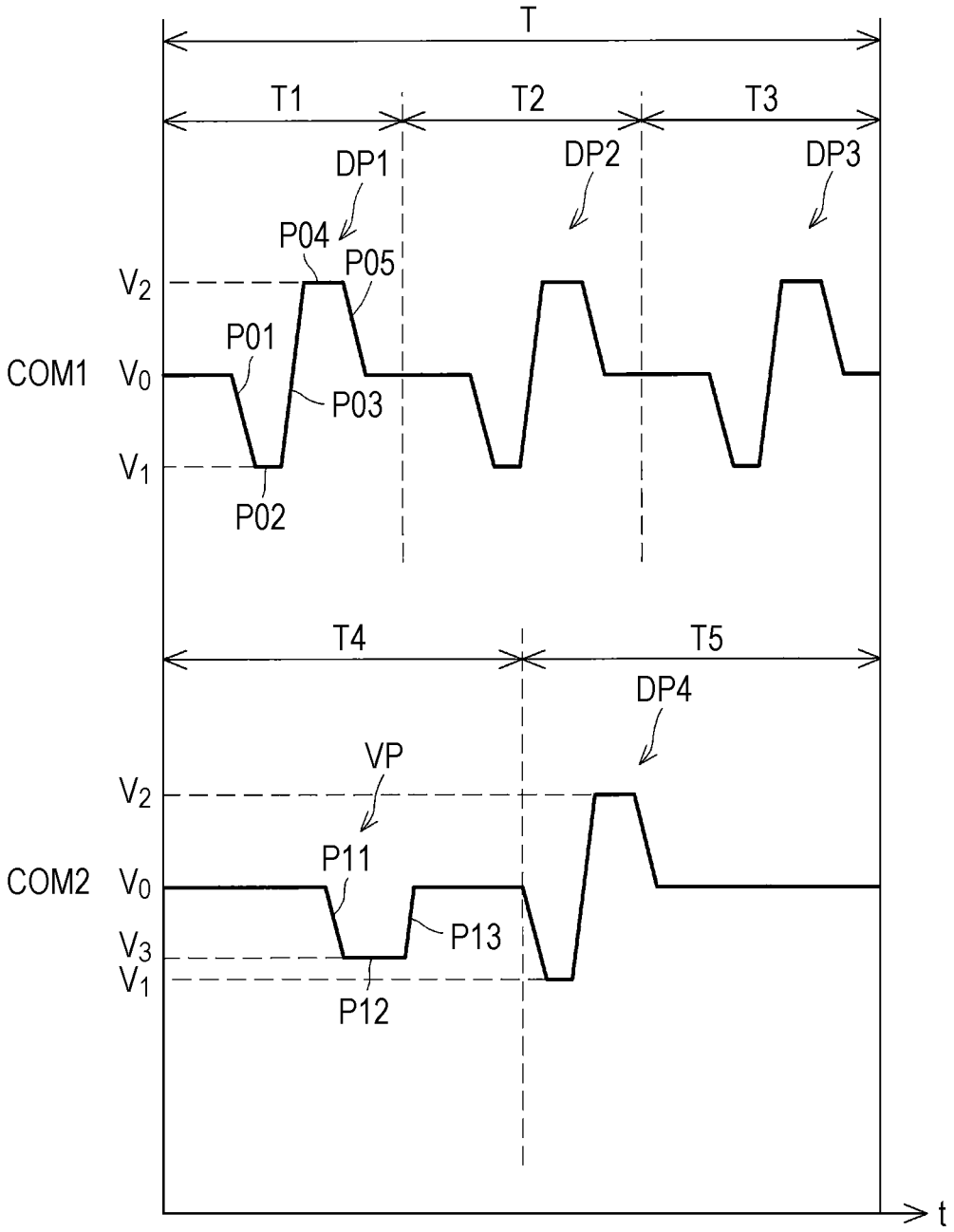
FIG. 3 is a waveform chart illustrating a first drive signal and a second drive signal according to Embodiment 1.

The drive waveforms illustrating the drive signals illustrated in FIG. 3 are composed of the first drive signal COM1 and the second drive signal COM2.

The first drive signal COM1 is repeatedly generated from the first drive signal generation unit 216A of the drive signal generation unit 216 for each unit cycle T (discharge cycle T (also referred to as recording cycle T)) prescribed in the clock signal transmitted from the oscillation circuit 215. The unit cycle T corresponds to one pixel in an image or the like printed on the recording sheet S. In the present embodiment, the first discharge pulse DP1, the second discharge pulse DP2, and the third discharge pulse DP3 are generated in the unit cycle T. That is, regarding the first drive signal COM1, the first discharge pulse DP1 is generated in a period T1 in the unit cycle T, the second discharge pulse DP2 is generated in a period T2, and the third discharge pulse DP3 is generated in a period T3. Note that, in the present embodiment, the periods T1, T2, and T3 are the same periods of times (cycles) having the same length.

Similarly, the second drive signal COM2 is repeatedly generated from the second drive signal generation unit 216B of the drive signal generation unit 216 for each unit cycle T as with the first drive signal COM1. In the present embodiment, the slight vibration pulse VP and the fourth discharge pulse DP4 are generated in the unit cycle T. That is, regarding the second drive signal COM2, the slight vibration pulse VP is generated in a period T4 in the unit cycle T and the fourth discharge pulse DP4 is generated in a period T5. Note that, the period T4 is a period of time (cycle) having a length different from that of the period T1 of the first drive signal COM1. In the present embodiment, the length of the period T4 is larger than that of the period T1 and is smaller than the sum of the lengths of the period T1 and the period T2.

In addition, for each recording cycle T, a combination of the first discharge pulse DP1, the second discharge pulse DP2, and the third discharge pulse DP3 of the first drive signal COM1 and the slight vibration pulse VP and the fourth discharge pulse DP4 of the second drive signal COM2 is selectively supplied to each of the drive elements 151 corresponding to the nozzle openings. Note that, in the present embodiment, the first drive signal COM1 and the second drive signal COM2 are supplied to individual electrodes with a common electrode (details thereof will be described later) of the drive elements 151 as a reference potential (VBS). That is, a voltage applied to an individual electrode of the drive element 151 via the discharge signal is represented as a potential with the reference potential (VBS) as a reference.

Specifically, the first discharge pulse DP1 of the first drive signal COM1 includes a first expansion element P01 that causes the volume of a flow path to be increased to be higher than a reference volume by means of application of up to a first potential $V_1$ in a state where an intermediate potential $V_0$ is applied, a first expansion maintaining element P02 that causes the volume of the flow path, which is increased due to the first expansion element P01, to be maintained for a predetermined period of time, a first contraction element P03 that causes the volume of the flow path to be decreased by means of application of the first potential $V_1$ to the second potential $V_2$, a first contraction maintaining element P04 that causes the volume of the flow path, which is decreased due to the first contraction element P03, to be maintained for a predetermined period of time, and a first expansion returning element P05 that causes the volume of the flow path to return to the reference volume corresponding to the intermediate potential $V_0$ from that in a contraction state corresponding to the second potential $V_2$.

When the first discharge pulse DP1 as described above is supplied to an activated portion of a piezoelectric actuator, which will be described later in details and which is the drive element 151 according to the present embodiment, due to the first expansion element P01, the activated portion is deformed in a direction in which the volume of a pressure generation chamber 12 is increased, a meniscus in a nozzle opening is drawn into the flow path side, and ink is supplied into the flow path from an upstream side. Then, the expanded state of the flow path is maintained due to the first expansion maintaining element P02. Thereafter, the first contraction element P03 is supplied, the flow path rapidly contracts such that the volume of the flow path is changed from an expansion volume to a contraction volume corresponding to the second potential $V_2$, and the pressure of ink in the flow path is increased such that an ink droplet is discharged from the nozzle opening. The contraction state of the flow path is maintained due to the first contraction maintaining element P04 and the pressure of ink in the flow path, which is decreased due to the discharging of the ink droplet, is increased again due to natural vibration thereof at this time. The first expansion returning element P05 is supplied at the timing of an increase in pressure of ink in the flow path and thus the volume of the flow path returns to the reference volume and a fluctuation in pressure in the flow path is cancelled out.

Note that, the second discharge pulse DP2, the third discharge pulse DP3, and the fourth discharge pulse DP4 have the same drive waveform as that of the first discharge pulse DP1. In addition, the meaning of the expression "×the second discharge pulse DP2, the third discharge pulse DP3, and the fourth discharge pulse DP4 have the same drive waveform as that of the first discharge pulse DP1" is that a waveform such as the voltage applied to the drive element 151 and a time for which voltage application is performed (including inclination) is the same. That is, discharge pulses having the same waveform include a discharge pulse at a different timing within the unit cycle T. In addition, since the second discharge pulse DP2 has the same drive waveform as that of the first discharge pulse DP1, the flying speed and the weight per droplet of an ink droplet discharged due to supply of the first discharge pulse DP1 and the flying speed and the weight per droplet of an ink droplet discharged due to the second discharge pulse DP2 can be made the same as each other. That is, the meaning of the expression "×the flying speeds and the weights per droplet of ink droplets are the same as each other" is that the ink droplets are discharged by means of drive waveforms having the same waveform and also includes a case where there is an error in flying speed or weight per droplet of an ink droplet due to an error in structure, a variation in characteristics of the drive element, or the like although waveforms have the same drive waveform.

In addition, the slight vibration pulse VP of the second drive signal COM2 includes a second expansion element P11 that causes the volume of the flow path to be increased to be higher than the reference volume by means of application of up to a third potential $V_3$ in a state where the intermediate potential $V_0$ is applied, a second expansion maintaining element P12 that causes the volume of the flow path, which is increased due to the second expansion element P11, to be maintained for a predetermined period of time, and a second expansion returning element P13 that causes the volume of the flow path to return the reference volume corresponding to the intermediate potential $V_0$ from that in a contraction state corresponding to the third potential $V_3$.

When the slight vibration pulse VP described above is supplied to the activated portion of the piezoelectric actuator, which will be described later in details and which is the drive element 151 according to the present embodiment, the activated portion can generate slight vibration that causes a meniscus of ink in a nozzle opening to be generated to such an extent that no ink droplet is discharged from the nozzle opening.

In a case where a small dot (S dot) is recorded by using the first drive signal COM1 and the second drive signal COM2 as described above, as illustrated in FIG. 4, only the first discharge pulse DP1 of the first drive signal COM1 which is generated in the period T1 is supplied to the drive element 151 in one recording cycle T.

Figure 5:
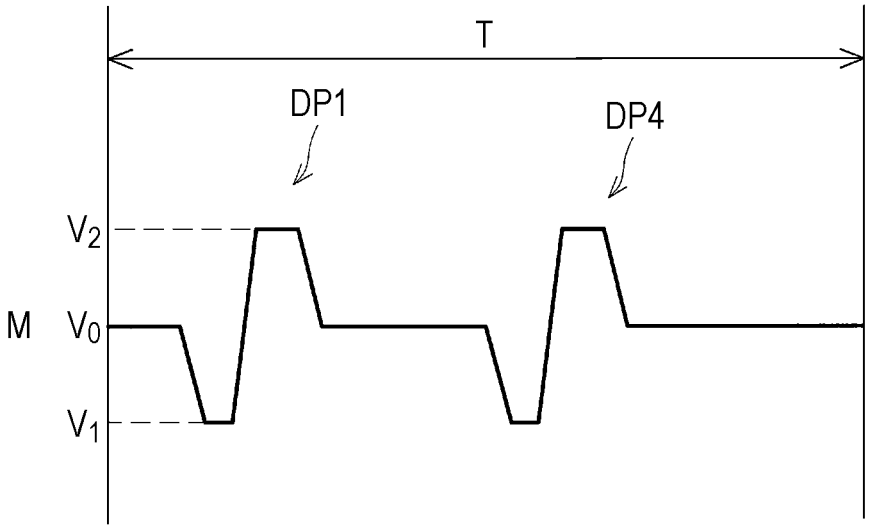
FIG. 5 is a waveform chart illustrating a middle dot discharge signal according to Embodiment 1.

In addition, in a case where a middle dot (M dot) is recorded, as illustrated in FIG. 5, the first discharge pulse DP1 of the first drive signal COM1 which is generated in the period T1 and the fourth discharge pulse DP4 of the second drive signal COM2 which is generated in the period T5 are supplied to the drive element 151 in one recording cycle T.

Figure 6:
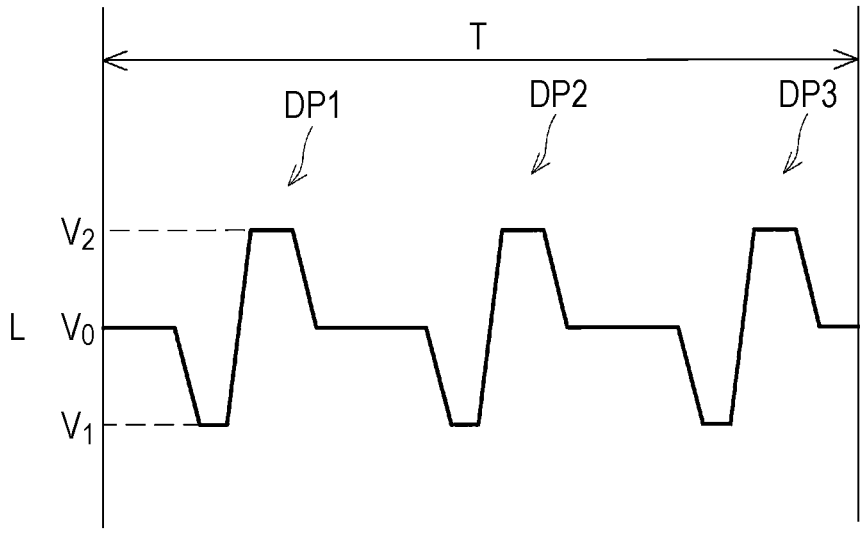
FIG. 6 is a waveform chart illustrating a large dot discharge signal according to Embodiment 1.

In addition, in a case where a large dot (L dot) is recorded, as illustrated in FIG. 6, the first discharge pulse DP1 of the first drive signal COM1 which is generated in the period T1, the second discharge pulse DP2 of the first drive signal COM1 which is generated in the period T2, and the third discharge pulse DP3 of the first drive signal COM1 which is generated in the period T3 are supplied to the drive element 151 in one recording cycle T.

Figure 7:
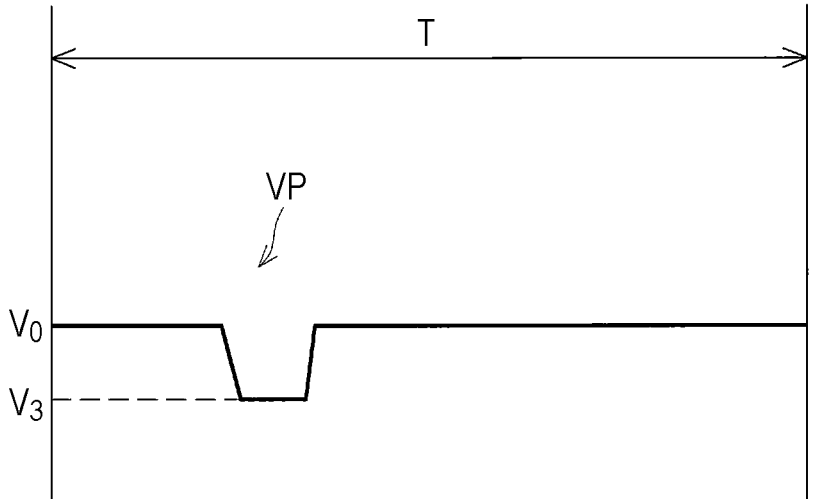
FIG. 7 is a waveform chart illustrating a slight-vibration driving discharge signal according to Embodiment 1.

In addition, in a case where no not is formed, that is, in a case where no ink droplet is discharged, as illustrated in FIG. 7, only the slight vibration pulse VP of the second drive signal COM2 which is generated in the period T4 is supplied to the drive element 151 in one recording cycle T. In this manner, it is possible to suppress precipitation of components contained in ink by means of slight vibration of a meniscus of ink in a nozzle opening from which ink is not discharged. It is a matter of course that the slight vibration pulse VP may not be supplied in a case where no ink droplet is discharged.

Figure 9:
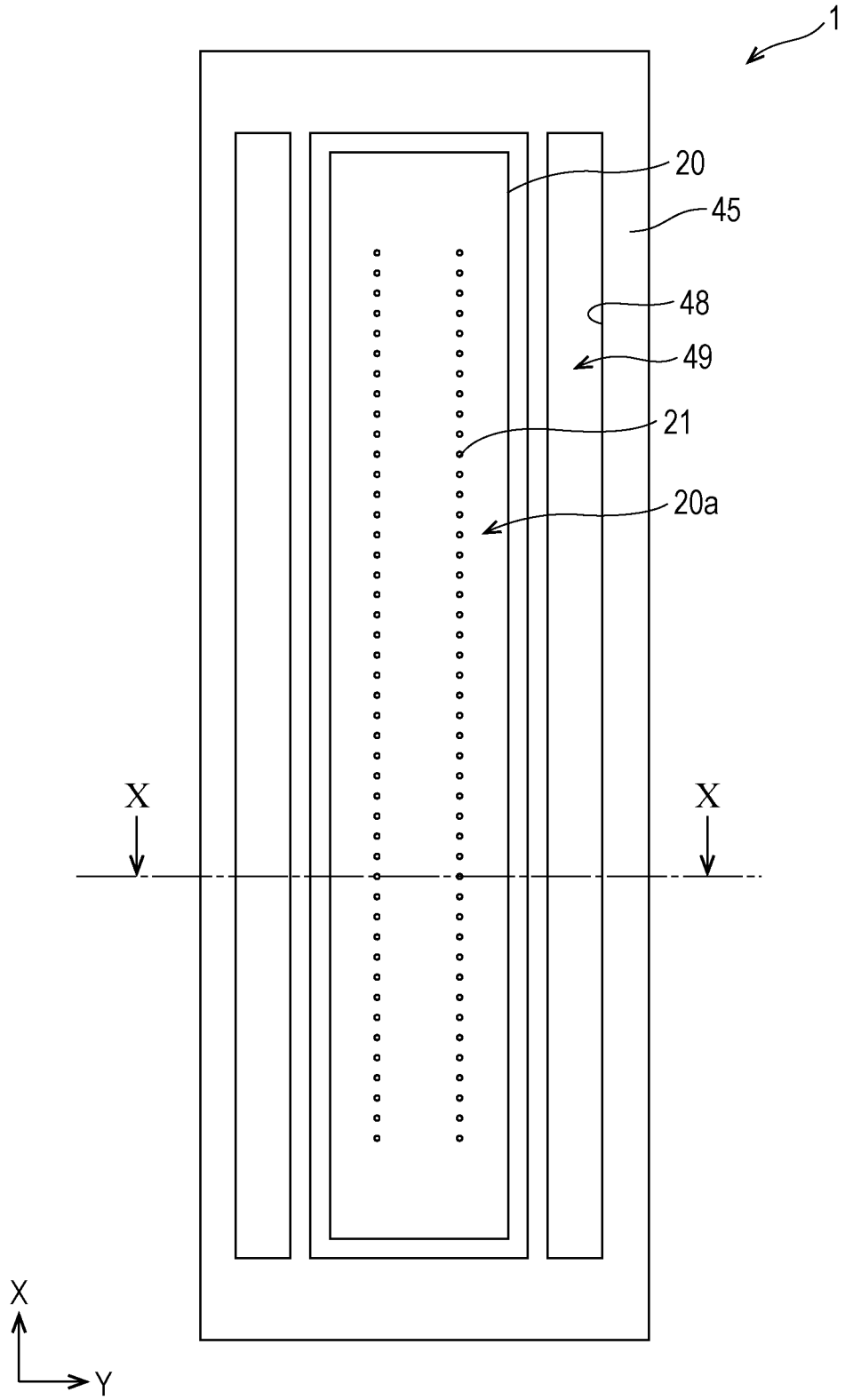
FIG. 9 is a plan view illustrating a liquid ejection surface side of the recording head according to Embodiment 1.
Figure 10:
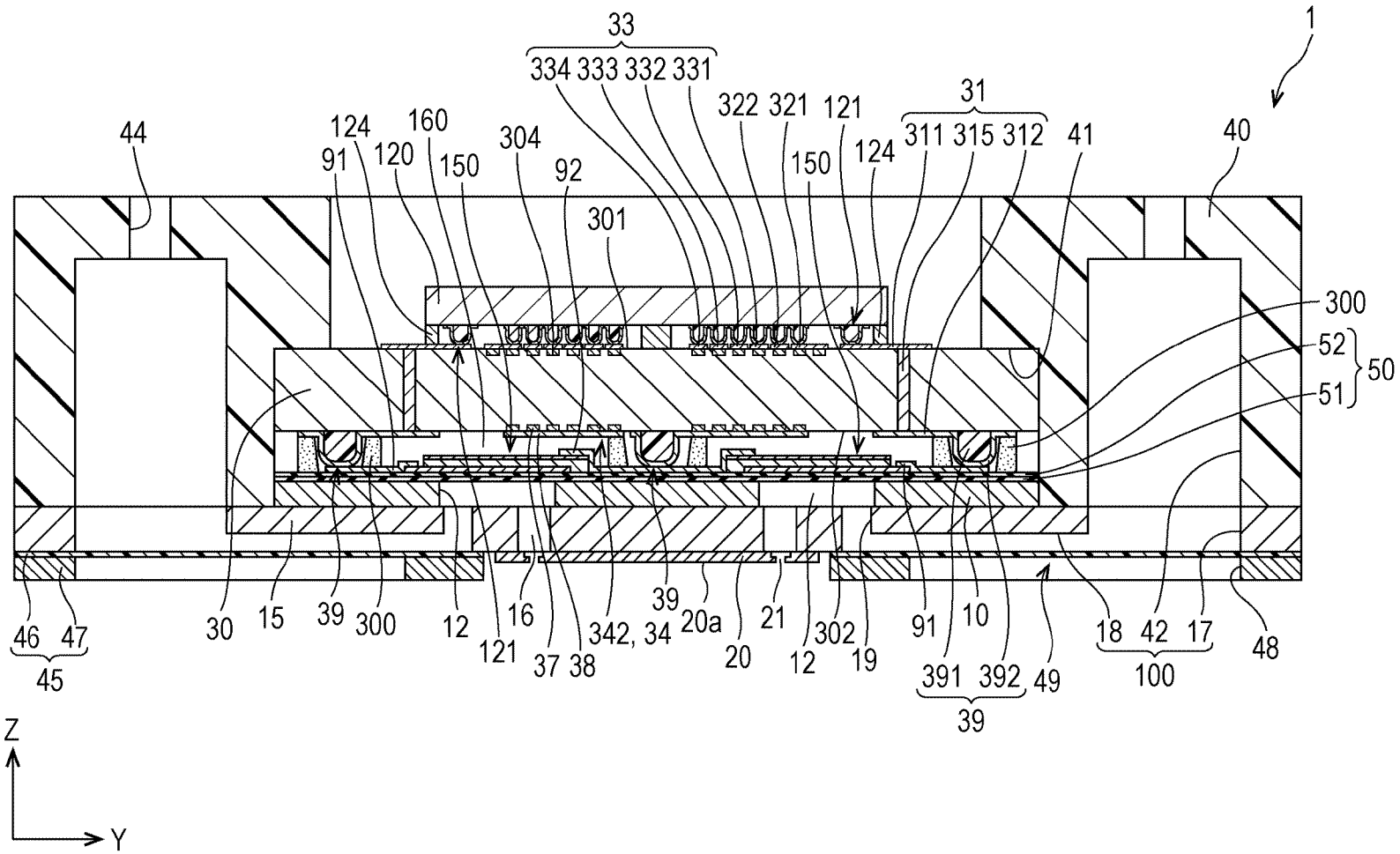
FIG. 10 is a sectional view taken along line X-X in FIG. 9 according to Embodiment 1.
Figure 11:
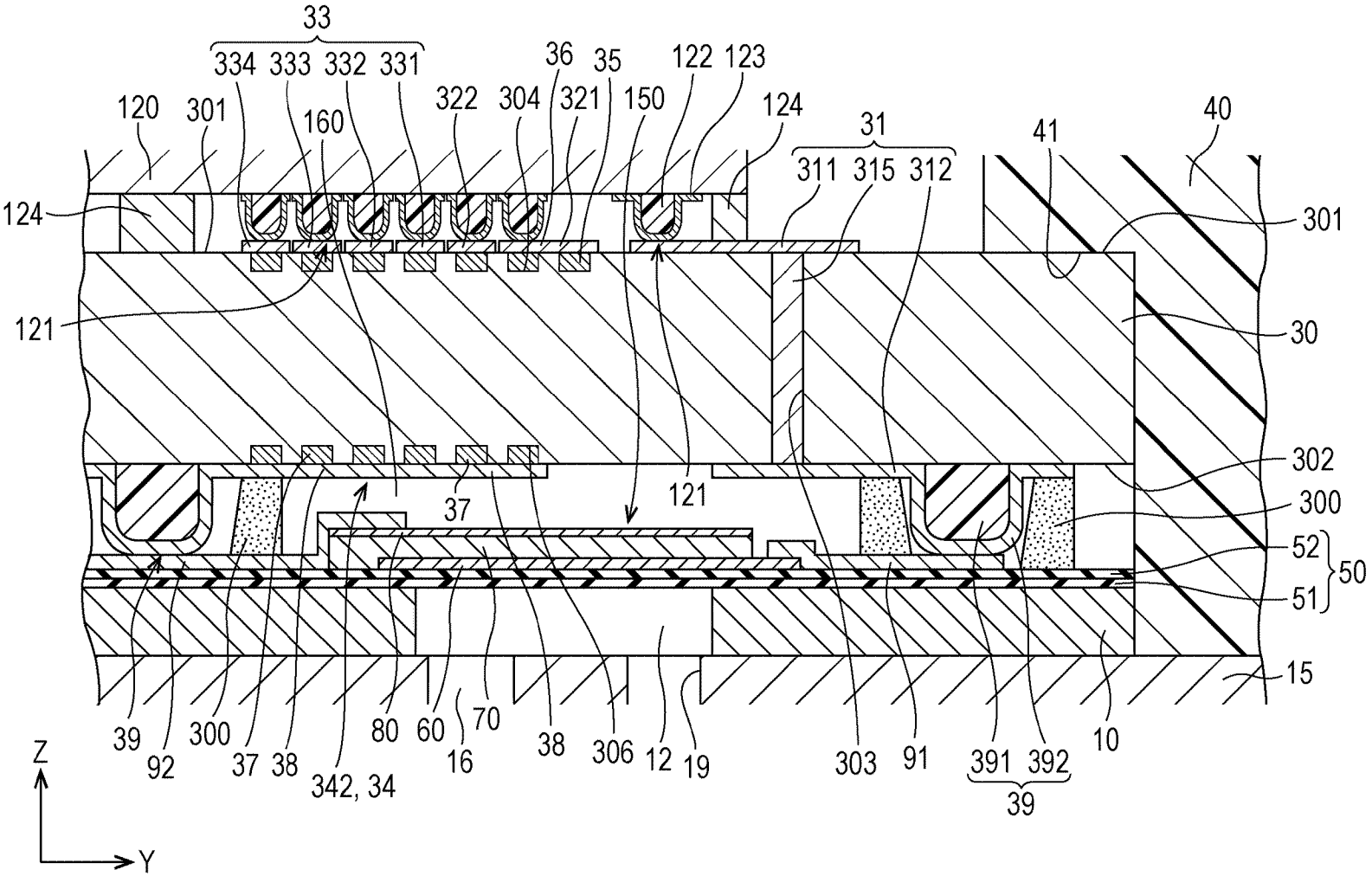
FIG. 11 is an enlarged sectional view of a main portion in FIG. 10 according to Embodiment 1.

Here, the recording head 1 according to the present embodiment will be described with reference to FIGS. 8 to 12. Note that, FIG. 8 is an exploded perspective view of the recording head according to Embodiment 1 of the invention, FIG. 9 is a plan view of the recording head (plan view as seen from liquid ejection surface 20*a* side), FIG. 10 is a sectional view taken along line X-X in FIG. 9, and FIG. 11 is an enlarged sectional view of a main portion in FIG. 10.

Figure 8:
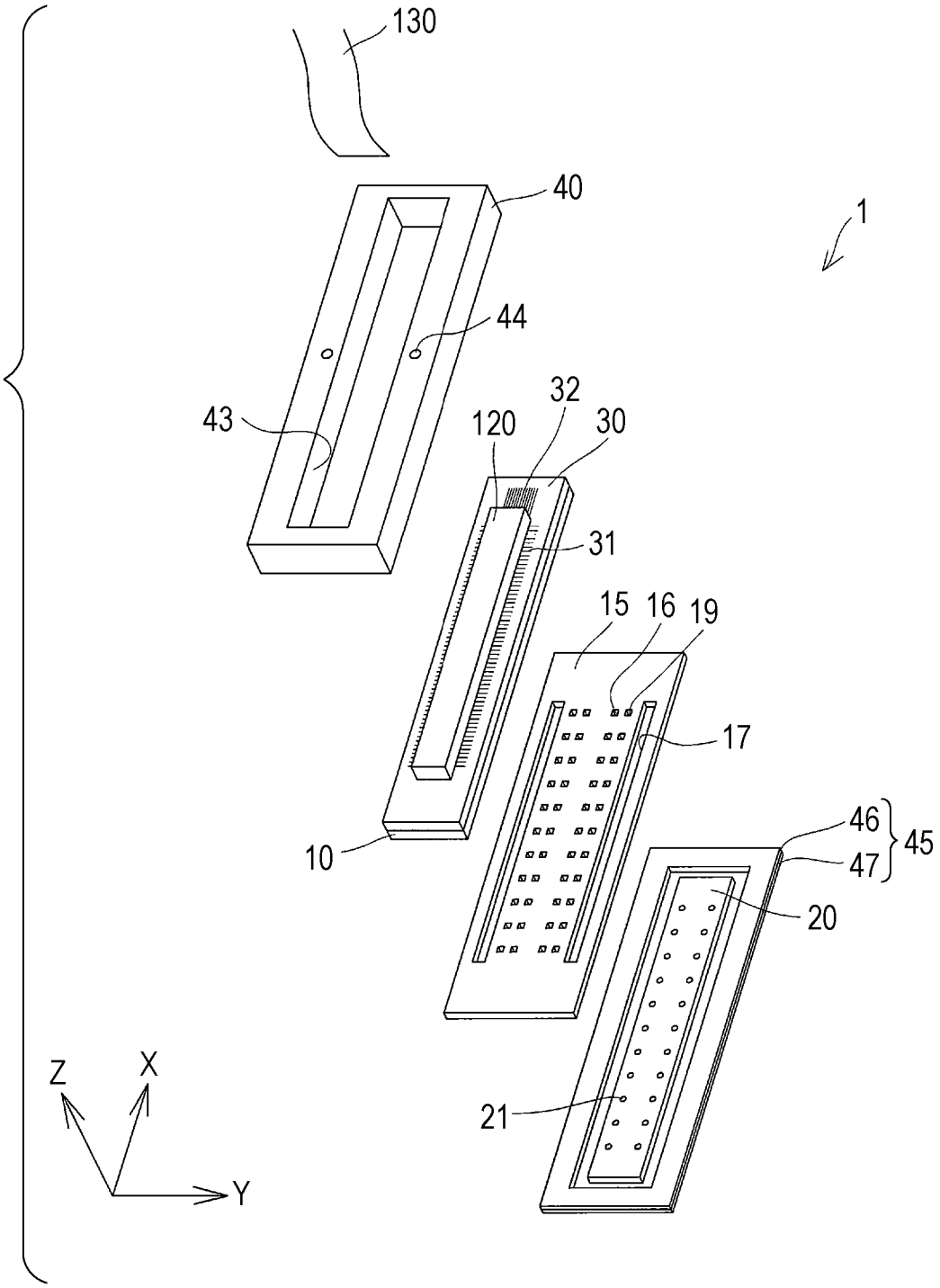
FIG. 8 is an exploded perspective view of a recording head according to Embodiment 1.

As illustrated in FIG. 8, the recording head 1 according to the present embodiment is provided with a plurality of members such as a flow path forming board 10, a communication plate 15, a nozzle plate 20, a wiring board 30 according to the present embodiment, and a compliance board 45.

For the flow path forming board 10, metal such as stainless steel or Ni, ceramic material represented by $ZrO_2$ or $Al_2O_3$, glass-ceramic material, or an oxide such as $SiO_2$, MgO, and $LaAlO_3$ can be used. In the present embodiment, the flow path forming board 10 is a silicon single-crystal board. In the flow path forming board 10, the pressure generation chambers 12, which are separated from each other by a plurality of partition walls due to anisotropic etching starting from one surface side, are arranged in parallel in a direction in which the plurality of nozzle openings 21 discharging ink are arranged in parallel. In the present embodiment, the direction in which the nozzle openings 21 and the pressure generation chambers 12 are arranged in parallel is the first direction X. In addition, the flow path forming board 10 is provided with a plurality of (in present embodiment, two) rows of pressure generation chambers 12 arranged in parallel in the first direction X, the plurality of rows being arranged in the second direction Y.

In the flow path forming board 10, a supply path or the like of which the opening area is narrower than that of the pressure generation chamber 12 and that applies flow path resistance of ink flowing through to the pressure generation chamber 12 may be provided close to one end portion of the pressure generation chamber 12 in the second direction Y.

The communication plate 15 and the nozzle plate 20 are sequentially stacked on one surface (which is on a side opposite to wiring board 30 (−Z direction)) of the flow path forming board 10. That is, the communication plate 15 that is provided on one surface of the flow path forming board 10, and the nozzle plate 20 that is provided on a surface of the communication plate 15 which is opposite to the flow path forming board 10 and that is provided with nozzle openings 21 are provided.

The communication plate 15 is provided with nozzle communication paths 16 through which the pressure generation chambers 12 and the nozzle openings 21 communicate with each other. The communication plate 15 has an area larger than that of the flow path forming board 10 and the nozzle plate 20 has an area smaller than that of the flow path forming board 10. Since the communication plate 15 is provided in this manner, the nozzle openings 21 of the nozzle plate 20 and the pressure generation chambers 12 are separated from each other and thus ink in the pressure generation chambers 12 is less likely to be influenced by evaporation of moisture in ink near the nozzle openings 21. In addition, since the nozzle plate 20 may cover openings of the nozzle communication paths 16 through which the pressure generation chambers 12 and the nozzle openings 21 communicate with each other, it is possible to make the area of the nozzle plate 20 relatively small and to achieve cost reduction. Note that, in the present embodiment, a surface in which the nozzle openings 21 of the nozzle plate 20 are open and from which ink droplets are discharged will be referred to as the liquid ejection surface 20*a*.

In addition, the communication plate 15 is provided with first manifold portions 17 and second manifold portions 18 that constitute a portion of a manifold 100.

The first manifold portion 17 is provided to penetrate the communication plate 15 in a thickness direction (direction in which communication plate 15 and flow path forming board 10 are stacked). The second manifold portion 18 is provided not to penetrate the communication plate 15 in the thickness direction and is provided to be open in a portion of the communication plate 15 which is on the nozzle plate 20 side.

Furthermore, the communication plate 15 is provided with supply communication paths 19, each of which communicates with one end portion of the pressure generation chamber 12 in the second direction Y. The supply communication paths 19 are respectively provided for the pressure generation chambers 12 such that the communication paths 19 are independent of each other. The second manifold portion 18 and the pressure generation chambers 12 communicate with each other through the supply communication paths 19.

For the communication plate 15 as described above, metal such as stainless steel or Ni, ceramic material represented by $ZrO_2$ or $Al_2O_3$, glass-ceramic material, or an oxide such as $SiO_2$, MgO, and $LaAlO_3$ can be used. Note that, as the communication plate 15, material having the same linear expansion coefficient as the flow path forming board 10 is preferable. That is, in a case where material having a linear expansion coefficient significantly different from that of the flow path forming board 10 is used as the communication plate 15, warping occurs due to the difference in linear expansion coefficient between the flow path forming board 10 and the communication plate 15 when the communication plate 15 is heated or cooled. In the present embodiment, the same material as that of the flow path forming board 10, that is, a silicon single-crystal board is used as the communication plate 15 and thus warping, a crack, or peeling-off caused by heat can be suppressed.

In the nozzle plate 20, the nozzle openings 21 that communicate with the pressure generation chambers 12 via the nozzle communication paths 16 are formed. The nozzle openings 21 are arranged in parallel in the first direction X and two rows of the nozzle openings 21 arranged in parallel in the first direction X are formed in the second direction Y.

As the nozzle plate 20, for example, metal such as stainless steel (SUS), an organic material such as polyimide resin, a silicon single-crystal board, or the like can be used. Note that, when the silicon single-crystal board is used as the nozzle plate 20, the linear expansion coefficients of the nozzle plate 20 and the communication plate 15 become the same as each other and thus warping caused by a heating process or a cooling process, a crack, or peeling-off caused by heat can be suppressed.

Meanwhile, a vibration plate 50 is formed on a surface of the flow path forming board 10 which is on a side opposite to the communication plate 15 (wiring board 30 side (+Z direction)). In the present embodiment, as the vibration plate 50, an elastic film 51 that is provided on the flow path forming board 10 side and is formed of silicon oxide and an insulating film 52 that is provided on the elastic film 51 and is formed of zirconium oxide are provided. A liquid flow path such as the pressure generation chamber 12 or the like is formed by performing anisotropic etching on the flow path forming board 10 starting from one surface side (side close to surface to which communication plate 15 is bonded) and the other surface of the liquid flow path such as the pressure generation chamber 12 or the like is defined by the elastic film 51. It is a matter of course that the configuration of the vibration plate 50 is not particularly limited to this and any one of the elastic film 51 and the insulating film 52 may be provided and another film may be provided.

On the vibration plate 50 of the flow path forming board 10, piezoelectric actuators 150 are provided as the drive elements that cause a change in pressure of ink in the pressure generation chamber 12 according to the present embodiment. As described above, in the flow path forming board 10, the plurality of pressure generation chambers 12 are arranged in parallel in the first direction X and two rows of pressure generation chambers 12 are arranged in parallel in the second direction Y. Activated portions, which are substantive driving portions of the piezoelectric actuators 150, are arranged in parallel in the first direction X such that rows of activated portions are formed and two rows of activated portions of the piezoelectric actuators 150 are arranged in parallel in the second direction Y. That is, substantially, the drive element refers to the activated portions of the piezoelectric actuators 150.

The piezoelectric actuator 150 is provided with first electrodes 60, a piezoelectric layer 70, and a second electrode 80, which are stacked in this order from the vibration plate 50 side. The first electrodes 60 constituting the piezoelectric actuator 150 constitute the individual electrodes that are isolated to respectively correspond to the pressure generation chambers 12 and that are respectively provided for the activated portions, which are the substantive drive portions of the piezoelectric actuator 150, such that the individual electrodes are independent of each other.

The piezoelectric layer 70 is provided such that the piezoelectric layer 70 has a predetermined width in the second direction Y and continues in the first direction X.

An end portion of the piezoelectric layer 70 which is on a side close to one end portion of the pressure generation chamber 12 in the second direction Y (side opposite to manifold 100) is positioned outward of an end portion of the first electrode 60. That is, the end portion of the first electrode 60 is covered by the piezoelectric layer 70. In addition, an end portion of the piezoelectric layer 70 which is on a side close to the other end of the pressure generation chamber 12 in the second direction Y (manifold 100 side) is positioned inward of an end portion of the first electrode 60 (positioned closer to pressure generation chamber 12) and an end portion of the first electrode 60 on the manifold 100 side is not covered by the piezoelectric layer 70.

The piezoelectric layer 70 is formed of oxide piezoelectric material that is formed on the first electrode 60 and has a polarization structure and the piezoelectric layer 70 can be formed of, for example, perovskite type oxide represented by a general formula $ABO_3$. As the perovskite type oxide used for the piezoelectric layer 70, for example, lead based piezoelectric material containing lead, non-lead based piezoelectric material not containing lead, or the like can be used.

Note that, although not particularly illustrated, on the piezoelectric layer 70, a recess portion may be formed at a position corresponding to each partition wall between the pressure generation chambers 12. In this case, it is possible to favorably displace the piezoelectric actuator 150.

The second electrode 80 is provided on a surface of the piezoelectric layer 70 that is opposite to the first electrode 60 and constitutes a common electrode that is common to the plurality of activated portions.

The piezoelectric actuator 150 configured with the first electrodes 60, the piezoelectric layer 70, and the second electrode 80 as described above is displaced when voltage is applied between the first electrodes 60 and the second electrode 80. That is, when voltage is applied between the first and second electrodes, piezoelectric distortion of the piezoelectric layer 70 interposed between the first electrodes 60 and the second electrode 80 occurs. A portion of the piezoelectric layer 70 (region interposed between first electrodes 60 and second electrodes 80) at which the piezoelectric distortion occurs when voltage is applied between the first and second electrodes will be referred to as an activated portion. With regard to this, a portion of the piezoelectric layer 70 at which the piezoelectric distortion does not occur will be referred to as a non-activated portion. In addition, a portion of the piezoelectric actuator 150 that faces the pressure generation chamber 12 and can be deformed will be referred to as a flexible portion and a portion of the piezoelectric actuator 150 that is positioned outward of the pressure generation chamber 12 will be referred to as a non-flexible portion.

As described above, regarding the piezoelectric actuator 150, the first electrodes 60 are the individual electrodes respectively provided for the plurality of activated portions such that the individual electrodes are independent of each other and the second electrode 80 is the common electrode that continues over the plurality of activated portions. It is a matter of course that the invention is not limited to such a configuration and the first electrode 60 may be the common electrode that continues over the plurality of activated portions and the second electrode may be the individual electrodes respectively provided for the plurality of activated portions such that the individual electrodes are independent of each other. In addition, instead of providing the elastic film 51 and the insulating film 52 as the vibration plate 50, a configuration in which only the first electrodes 60 function as a vibration plate may be adopted. In addition, the piezoelectric actuator 150 itself may also have a function as a vibration plate substantially. In the present embodiment, the activated portions of the piezoelectric actuator 150 are arranged in parallel in the first direction X to correspond to the pressure generation chambers 12 and two rows of activated portions arranged in parallel in the first direction X as described above are provided in the second direction Y.

In addition, as illustrated in FIGS. 10 and 11, individual lead electrodes 91, which are led-out wires, are led out from the first electrodes 60 of the piezoelectric actuator 150. The individual lead electrode 91 is led outward of each row of activated portions in the second direction Y.

In addition, a common lead electrode 92, which is a led-out wire, is led out from the second electrode 80 of the piezoelectric actuator 150. In Embodiment, 1, the common lead electrode 92 is electrically connected to the second electrode 80 of each of two rows of piezoelectric actuators 150. In addition, the common lead electrode 92 is provided at a ratio of one common lead electrode 92 to the plurality of activated portions.

Figure 12:
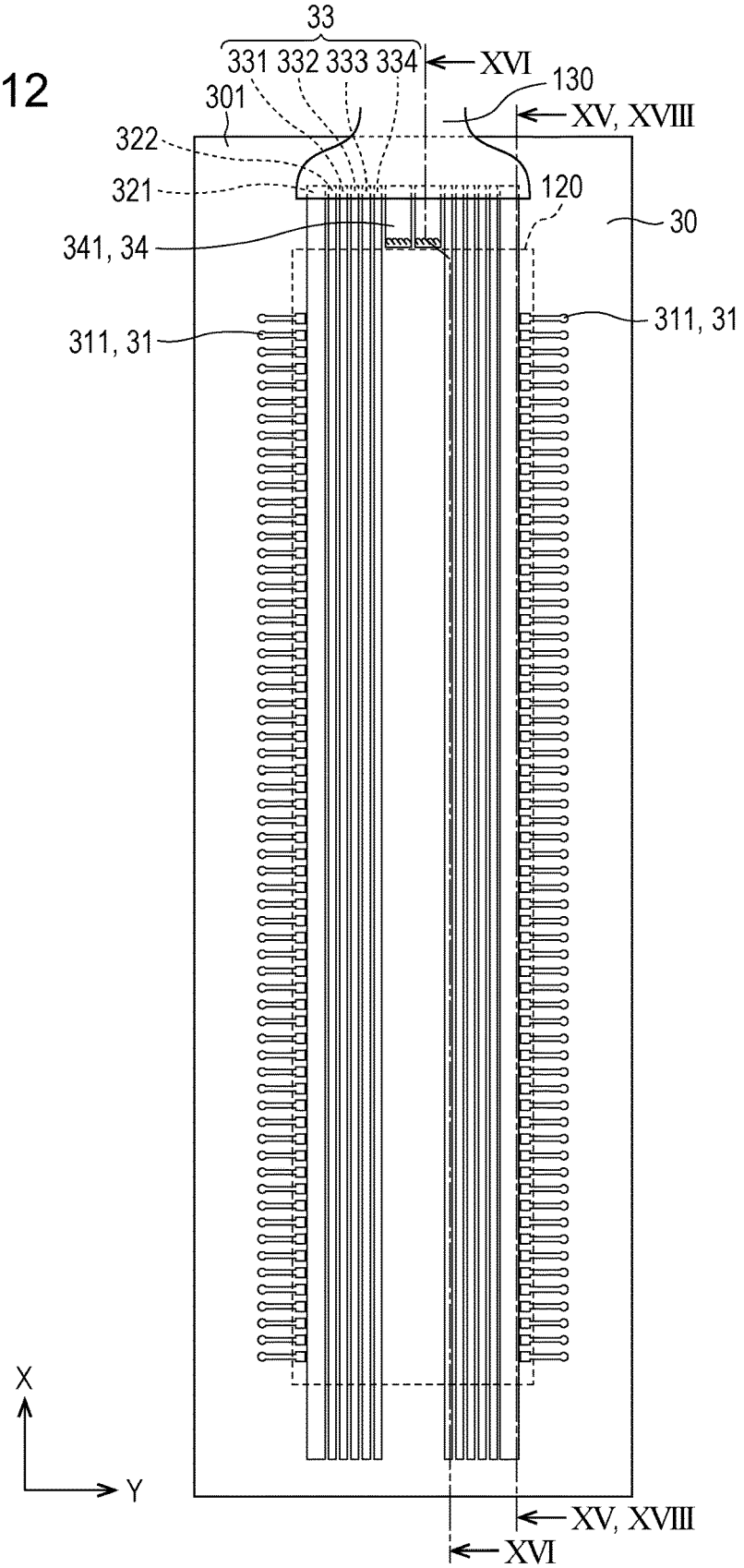
FIG. 12 is a plan view illustrating a first surface side of a drive circuit board according to Embodiment 1.
Figure 13:
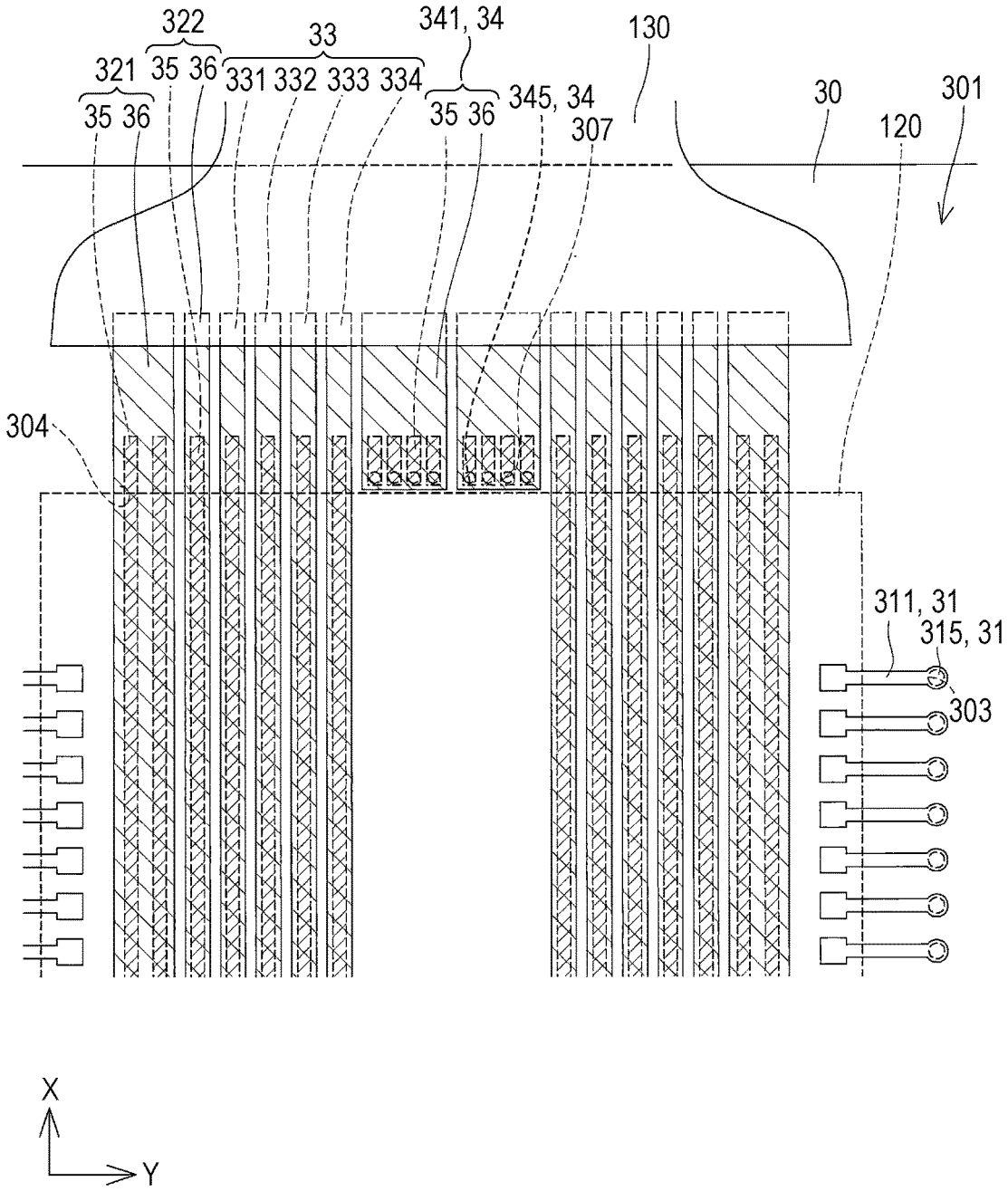
FIG. 13 is an enlarged plan view of a main portion of the drive circuit board according to Embodiment 1.
Figure 14:
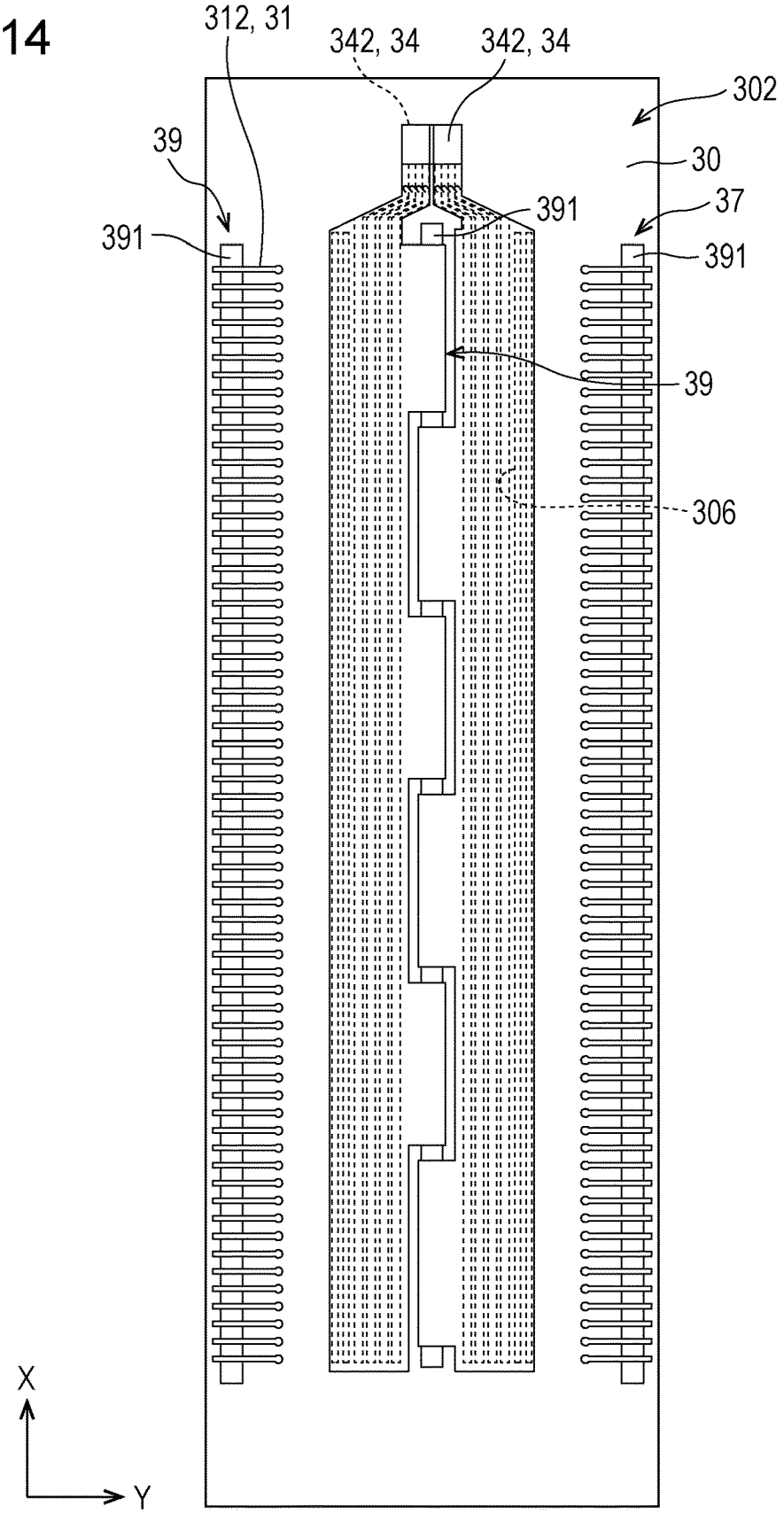
FIG. 14 is a plan view illustrating a second surface side of the drive circuit board according to Embodiment 1.
Figure 15:
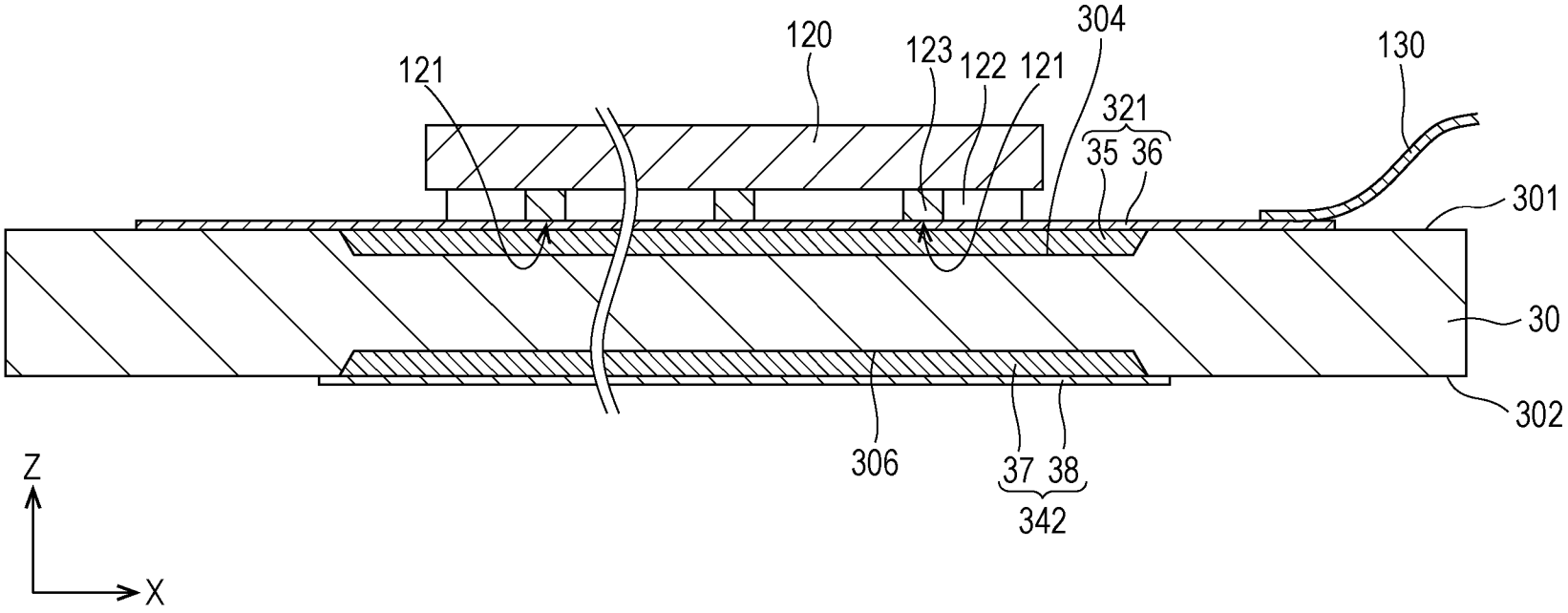
FIG. 15 is a sectional view taken along line XV-XV in FIG. 12 according to Embodiment 1.
Figure 16:
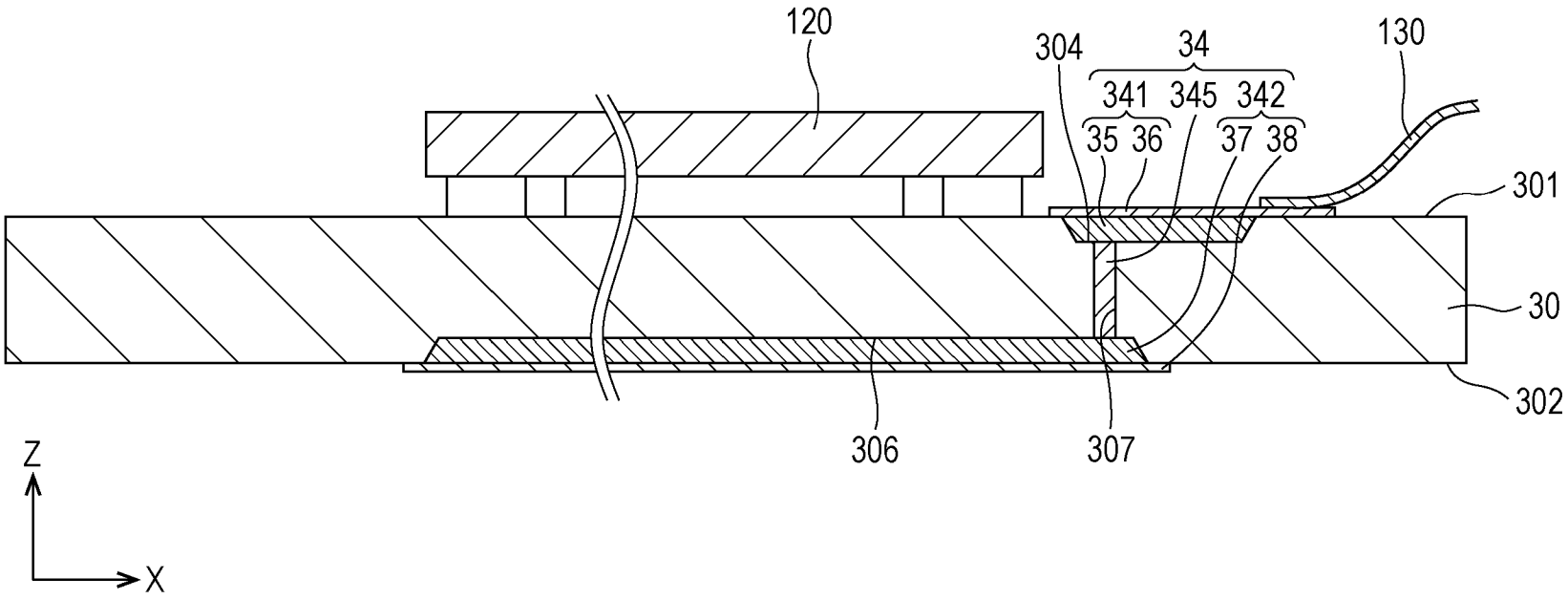
FIG. 16 is a sectional view taken along line XVI-XVI in FIG. 12 according to Embodiment 1.

The wiring board 30 is bonded to a surface of the flow path forming board 10 that is on the piezoelectric actuator 150 side. The wiring board 30 has approximately the same size as the flow path forming board 10. Here, the wiring board 30 according to the present embodiment will be further described with reference to FIGS. 12 to 15. Note that, FIG. 12 is a plan view illustrating a first surface side of the wiring board, FIG. 13 is an enlarged view of a main portion in FIG. 12, FIG. 14 is a plan view illustrating a second surface side of the wiring board, FIG. 15 is a sectional view taken along line XV-XV in FIG. 12, and FIG. 16 is a sectional view taken along line XVI-XVI in FIG. 12.

For the wiring board 30, metal such as stainless steel or Ni, ceramic material represented by $ZrO_2$ or $Al_2O_3$, glass-ceramic material, or an oxide such as $SiO_2$, MgO, and $LaAlO_3$ can be used. In the present embodiment, the wiring board 30 is a silicon single-crystal board of which the plane orientation is preferentially oriented in a (110) plane. In addition, a surface (+Z) of the wiring board 30 that is on a side opposite to the piezoelectric actuator 150 (which is drive element) will be referred to as a first surface 301 and a surface (−Z) of the wiring board 30 that is on the piezoelectric actuator 150 side will be referred to as a second surface 302. In addition, as illustrated in FIGS. 10 and 11, a drive circuit 120 that outputs a signal for driving the piezoelectric actuator 150 is mounted on the first surface 301 of the wiring board 30. That is, the first surface 301 of the wiring board 30, which is opposite to the piezoelectric actuator 150 as the drive element, is on the drive circuit 120 side.

In the drive circuit 120, a switching element such as a transmission gate is provided for each of the activated portions of the piezoelectric actuator 150 and the discharge signal for driving the activated portions of the piezoelectric actuator 150 is generated from the first drive signal COM1 and the second drive signal COM2, which are supplied from the outside, at a predetermined timing with the switching element being opened or closed based on a control signal input thereto. Note that, the discharge signal herein is represented by a signal for driving the activated portions of the piezoelectric actuator 150, which is the drive element, such that an ink droplet is discharged from the nozzle opening 21. However, the discharge signal is not limited to the signal as described above and the meaning thereof includes a signal for a slight-vibration driving operation of driving the activated portions of the piezoelectric actuator 150 to such an extent that no ink droplet is discharged or another driving operation. As the drive circuit 120, for example, a circuit board or a semiconductor integrated circuit (IC) can be used. Incidentally, when the discharge signal, which is generated from the first drive signal COM1 and the second drive signal COM2 and is illustrated in FIGS. 4 to 7, is supplied to the first electrodes 60, which are the individual electrodes respectively provided for the activated portions of the piezoelectric actuator 150, by the drive circuit 120 and a bias voltage (VBS) as the reference potential $V_0$ is supplied to the second electrode 80, which is the common electrode of the plurality of activated portions, the activated portions of the piezoelectric actuator 150 are driven.

The wiring board 30 as described above is provided to be elongated in the first direction X, which is a direction in which the activated portions of each of the rows of the piezoelectric actuators 150 are arranged in parallel. That is, the wiring board 30 is disposed such that a longitudinal direction of the wiring board 30 becomes the first direction X and a transverse direction of the wiring board 30 becomes the second direction Y.

In addition, as illustrated in FIGS. 11, 12, and 13, the first surface 301 of the wiring board 30 is provided with first individual wires 311 constituting individual wires 31, first drive signal wires 321, second drive signal wires 322, power supply wires 33, and first bias wires 341 constituting bias wires 34.

On each of opposite end portions in the second direction Y, a plurality of the first individual wires 311, each of which constitutes the individual wire 31, are arranged in parallel in the first direction X. In addition, the first individual wire 311 is provided to extend in the second direction Y, one end thereof is electrically connected to each terminal of the drive circuit 120, and the other end thereof is electrically connected to an individual through-wire 315.

Here, the individual through-wire 315 is provided in a first through-hole 303 that is provided to penetrate the wiring board 30 in the third direction Z, which is the thickness direction. The individual through-wire 315 is a wire that relays the first surface 301 and the second surface 302 to each other and connects the first individual wire 311 on the first surface 301 and a second individual wire 312 on the second surface 302, which will be described in details later. The first through-hole 303 in which the individual through-wire 315 is provided can be formed by performing laser processing, drilling, dry etching (Bosch method, non-Bosch method (RIE), ion milling), wet etching, sandblasting, or a combination thereof on the wiring board 30. The individual through-wire 315 is formed to fill the first through-hole 303. Note that, the individual through-wire 315 is formed of metal such as copper (Cu) and can be formed via electroplating, electroless plating, or the like.

In addition, the individual through-wire 315 is connected to the second individual wire 312 on the second surface 302. Although details will be described later, the second individual wire 312 is electrically connected to the individual lead electrode 91 that is connected to the first electrode 60, which is the individual electrode of the activated portion of the piezoelectric actuator 150. That is, the number of the individual wires 31, each of which is configured with the first individual wire 311, the individual through-wire 315, and the second individual wire 312, is the same as the number of the first electrodes 60, each of which is the individual electrode of the activated portion of the piezoelectric actuator 150.

In addition, on the first surface 301 of the wiring board 30, the first drive signal wires 321 are provided. Through the first drive signal wire 321, the first drive signal COM1, which is supplied from an external wire 130, is supplied to the drive circuit 120. In the present embodiment, as illustrated in FIG. 12, the first drive signal wire 321 is provided to extend in the first direction X such that the first drive signal wire 321 extends from one end of the wiring board 30, to which the external wire 130 is connected, toward the other end of the wiring board 30. In addition, in the present embodiment, one first drive signal wire 321 is provided for each of the rows of the activated portions of the piezoelectric actuator 150 and two first drive signal wires 321 are arranged in parallel in the second direction Y, in total.

In addition, on the first surface 301 of the wiring board 30, the second drive signal wires 322 are provided. Through the second drive signal wire 322, the second drive signal COM2, which is supplied from the external wire 130, is supplied to the drive circuit 120. Therefore, the second drive signal wire 322 is provided not to be electrically connected to the first drive signal wire 321 and the power supply wire 33 on the wiring board 30. In the present embodiment, the second drive signal wire 322 is provided to extend in the first direction X such that the second drive signal wire 322 extends from the one end of the wiring board 30, to which the external wire 130 is connected, toward the other end of the wiring board 30. In addition, in the present embodiment, one second drive signal wire 322 is provided for each of the rows of the activated portions of the piezoelectric actuator 150 and two second drive signal wires 322 are arranged in parallel in the second direction Y, in total. That is, the first drive signal wires 321 and the second drive signal wires 322 are arranged in parallel in the second direction Y and in the present embodiment, the first drive signal wires 321 are disposed close to the outer periphery side of the wiring board 30 in the second direction Y and the second drive signal wires 322 are disposed close to the center of the wiring board 30 in the second direction Y.

Note that, the first drive signal wire 321 is disposed close to the outer periphery side of the wiring board 30 in the second direction Y and the second drive signal wire 322 is disposed close to the center of the wiring board 30 in the second direction Y, the second direction Y being a direction in which the first drive signal wire 321 and the second drive signal wire 322 are arranged in parallel.

In addition, as illustrated in FIG. 12, on the first surface 301 of the wiring board 30, the power supply wires 33 are provided. The power supply wires 33 are for supplying power to the drive circuit 120. In the present embodiment, a high-voltage power supply wire 331 through which high-voltage power for a high-voltage circuit of the drive circuit 120 is supplied, a high-voltage ground wire 332 corresponding to the high-voltage power supply wire 331, a low-voltage power supply wire 333 through which low-voltage power for a low-voltage circuit of the drive circuit 120 is supplied, and a low-voltage ground wire 334 corresponding to the low-voltage power supply wire 333 are provided. That is, in the present embodiment, four types of power supply wires 33 are provided.

The power supply wire 33 is provided to extend in the first direction X such that the power supply wire 33 extends from the one end of the wiring board 30, to which the external wire 130 is connected, toward the other end of the wiring board 30. In addition, one high-voltage power supply wire 331, one high-voltage ground wire 332, one low-voltage power supply wire 333, and one low-voltage ground wire 334 are provided for each of the rows of the activated portions of the piezoelectric actuator 150. That is, four power supply wires are provided for each of the rows of the activated portions of the piezoelectric actuator 150 and eight power supply wires are provided in total. The high-voltage power supply wire 331, the high-voltage ground wire 332, the low-voltage power supply wire 333, and the low-voltage ground wire 334 are arranged in parallel in the second direction Y. In addition, the first drive signal wire 321 and the second drive signal wire 322 corresponding to each of the rows of the activated portions of the piezoelectric actuator 150 are disposed closer to one side than the power supply wires 33. In the present embodiment, the first drive signal wire 321 and the second drive signal wire 322 corresponding to each of the rows of the activated portions of the piezoelectric actuator 150 are disposed closer to the outer periphery side of the wiring board 30 than the power supply wires 33 in the second direction Y. That is, the power supply wires 33 are disposed close to the center of the wiring board 30 in the second direction Y and the first drive signal wire 321 and the second drive signal wire 322 are disposed close to the outer periphery of the wiring board 30.

Furthermore, as illustrated in FIGS. 13 and 16, on the first surface 301 of the wiring board 30, the first bias wires 341 constituting the bias wires 34 are provided. Through the first bias wire 341, a bias voltage (VBS) as the reference potential, which is supplied from the external wire 130, is supplied to the second electrode 80 which is the common electrode of the piezoelectric actuator 150. The first bias wire 341 is provided on the one end portion of the wiring board 30 in the first direction X to which the external wire 130 is connected such that the first bias wire 341 extends in the first direction X and the first bias wire 341 has a length smaller than the lengths of the first drive signal wire 321, the second drive signal wire 322, and the power supply wire 33. That is, since it is sufficient that the first bias wire 341 be directly connected to the second electrode 80, which is the common electrode of the piezoelectric actuator 150, without being connected to the drive circuit 120, the first bias wire 341 is provided to have a length in the first direction X such that the first bias wire 341 does not reach a region on which the drive circuit 120 is mounted. In the present embodiment, the first bias wire 341 is disposed on the opposite side of the power supply wires 33 from the second drive signal wire 322 in the second direction Y. That is, the first bias wire 341 is disposed closer to the central side of the wiring board 30, which is an inner side, than the power supply wires 33. In addition, in the present embodiment, one first bias wire 341 is provided for each piezoelectric actuator 150 and two first bias wires 341 are provided in total.

As illustrated in FIGS. 11, 15, and 16, each of the first drive signal wires 321, the second drive signal wires 322, the power supply wires 33, and the first bias wires 341 is provided with a first buried wire 35 that is buried in a first groove 304 provided in the first surface 301 of the wiring board 30 and a first connection wire 36 that is provided to cover the first buried wire 35.

Here, inner wall surfaces of the first groove 304 in which the first buried wire 35 is provided are formed by a first (111) surface that is perpendicular to a (110) surface of a surface of the wiring board 30 and a second (111) surface that faces the first (111) surface and is perpendicular to the (110) surface. The first groove 304 provided with the first (111) surface and the second (111) surface can be formed at a high precision by performing anisotropic etching (wet etching) by using an alkaline solution such as a potassium hydroxide solution (KOH) or tetramethylammonium hydroxide (TMAH). In addition, in the present embodiment, the first (111) surface and the second (111) surface, which are the inner wall surfaces of the first groove 304, are disposed to be linear in the first direction X. When the inner wall surface of the first groove 304 is formed to be linear in the first direction X, the first groove 304 and the first buried wire 35 can be formed to be long in the first direction X and it is possible to achieve space saving. Incidentally, for example, a direction in which the activated portions of the piezoelectric actuator 150 are arranged in parallel and the orientations of the first (111) surface and the second (111) surface of the wiring board 30 may be different from each other. In addition, in the present embodiment, the first groove 304 and the first buried wire 35 are provided to be linear. However, the invention is not particularly limited to this and for example, the first groove 304 and the first buried wire 35 may be curved at an intermediate position in a direction in which the first groove 304 and the first buried wire 35 extend.

The first groove 304 formed as described above has a rectangular cross section. It is a matter of course that a method of forming the first groove 304 is not limited to anisotropic etching and the first groove 304 may be formed via laser processing, drilling, dry etching (Bosch method, non-Bosch method (RIE), ion milling), sandblasting, or a combination thereof.

In addition, in the present embodiment, the plurality of first grooves 304 are provided at equal intervals in the second direction Y. In the present embodiment, eleven first grooves 304 are provided for each of the rows of the activated portions of the piezoelectric actuator 150 and twenty two first grooves 304 are provided in total. Specifically, two first grooves 304 for the first drive signal wire 321, one first groove 304 for the second drive signal wire 322, four first grooves 304 for the power supply wires 33, and four first grooves 304 for the first bias wire 341 are provided for each of the rows of the activated portions of the piezoelectric actuator 150 and eleven first grooves 304 are provided in total for each of the rows of the activated portions of the piezoelectric actuator 150. It is a matter of course that the number of the first grooves 304 corresponding to the first drive signal wire 321, the power supply wires 33, and the first bias wire 341 and the positions of the first grooves 304 are not particularly limited to this and the number of the first grooves 304 may be one and may be two or more. In addition, since the first buried wire 35 of the first bias wire 341 shorter than the other first buried wires 35, on the wiring board 30, seven first grooves 304 formed in the first direction X are provided for each of the rows of the activated portions of the piezoelectric actuator 150. Accordingly, it can be said that substantially seven first grooves 304 are provided for each of the rows of the activated portions of the piezoelectric actuator 150 and it can be said that substantially fourteen first grooves 304 are provided in total.

The first buried wire 35 is buried in the first groove 304. That is, the first buried wire 35 is formed to fill the first groove 304. The first buried wire 35 is formed of metal such as copper (Cu) and for example, can be formed by electroplating, electroless plating, or a method of printing conductive paste. In addition, the first buried wire 35 can be formed at the same time as the individual through-wire 315 through plating. It is possible to simplify a manufacturing process and to achieve cost reduction when forming the first buried wire 35 and the individual through-wire 315 at the same time in this manner.

The first connection wires 36 are stacked to cover the respective first buried wires 35. The width of each first connection wire 36 in the second direction Y is slightly larger than the width of the first buried wire 35 but the first connection wires 36 are arranged at intervals such that no short circuit occurs between the first drive signal wire 321, the second drive signal wire 322, the power supply wire 33 and, the first bias wire 341 which are adjacent to each other in the second direction Y. Note that, in the present embodiment, the first drive signal wire 321 is configured with two first buried wires 35 and the first connection wire 36 that covers the two first buried wires 35 at once. On the other hand, the second drive signal wire 322 is configured with one first buried wire 35 and one first connection wire 36. In addition, the power supply wire 33 is configured with one first buried wire 35 and one first connection wire 36. In addition, as illustrated in FIG. 13, the first bias wire 341 is configured of four first buried wires 35 and one first connection wire 36 that covers the four consecutive first buried wires 35.

As the first connection wire 36, although not particularly illustrated, for example, a wire, which is obtained by stacking a close-contact layer that is provided on the first buried wire 35 side and is formed of titanium (Ti) and a conductive layer that is provided on the close-contact layer and is formed of gold (Au) or the like, can be used. It is a matter of course that a layer formed of other conductive material may also be stacked. In addition, the first connection wire 36 can be formed via, for example, a sputtering technique or the like. Note that, the first connection wire 36 can be formed at the same time as, for example, the first individual wire 311. It is possible to simplify a manufacturing process and to achieve cost reduction when forming the first connection wire 36 and the first individual wire 311 at the same time in this manner.

In addition, the above-described close-contact layer and the conductive layer can be used as a protection layer against migration and oxidation of the buried wire. In addition, the above-described conductive layer can be used as a bonding surface against a pump formed on another drive circuit board, a flexible tape (FPC), and a Chip-on-Film/Flex (COF).

In addition, as illustrated in FIGS. 12, 13, 15, and 16, the first connection wire 36 extends beyond an end portion of the first buried wire 35 in the first direction X and extends up to the vicinity of an end portion of the wiring board 30 in the first direction X. In this manner, the first connection wire 36 that extends up to an end portion of the wiring board 30 in the first direction X is electrically connected to the external wire 130 such as an FPC. The first drive signal COM1 is supplied to the first drive signal wire 321 to which the external wire 130 is connected and the second drive signal COM2 is supplied to the second drive signal wire 322. In addition, power is supplied to the power supply wires 33 and the bias voltage (VBS) is supplied to the first bias wire 341. In addition, the first individual wires 311, the first drive signal wires 321, the second drive signal wires 322, and the power supply wires 33 are electrically connected to respective terminals (not shown) of the drive circuit 120 on the first surface 301. Note that, although not particularly illustrated, a wire through which a control signal such as the clock signal (CLK), the latch signal (LAT), a change signal (CH), pixel data (SI), setting data (SP) for controlling the drive circuit 120 is supplied from the external wire 130 is provided on the first surface 301 of the wiring board 30, the external wire 130 is electrically connected to the wire and the wire is electrically connected to each of the terminals of the drive circuit 120.

In the present embodiment, as illustrated in FIG. 11, bump electrodes 121 are provided on a surface of the drive circuit 120 that is on the wiring board 30 side and the first individual wires 311, the first drive signal wires 321, the second drive signal wires 322, and the power supply wires 33 are electrically connected to respective terminals (not shown) of the drive circuit 120 via the bump electrodes 121.

Here, the bump electrode 121 is provided with a core portion 122 that is formed of elastic resin material and a bump wire 123 that covers at least a portion of a surface of the core portion 122.

The core portion 122 is formed of photosensitive insulating resin such as polyimide resin, acrylic resin, phenol resin, silicone resin, silicone-modified polyimide resin, epoxy resin, or thermosetting insulating resin.

In addition, the core portion 122 is formed to have a substantially semi-cylindrical shape before connection between the drive circuit 120 and the wiring board 30. Here, the semi-cylindrical shape means a columnar shape of which an inner surface (bottom surface) that is in contact with the drive circuit 120 is a flat surface and of which an outer surface, which is a non-contact surface, is a curved surface. Specifically, examples of the substantially semi-cylindrical shape include a shape with a substantially semi-circular cross section, a substantially semi-elliptic cross section, or a substantially trapezoidal cross section.

In addition, when the drive circuit 120 and the wiring board 30 are pressed such that the drive circuit 120 and the wiring board 30 relatively approach each other, tip ends of the core portions 122 are elastically deformed in accordance with the shapes of surfaces of the first individual wires 311, the first drive signal wires 321 and the power supply wires 33. Therefore, even when the drive circuit 120 or the wiring board 30 is warped or rolled up, since the core portion 122 is deformed corresponding to the deformation of the drive circuit 120 or the wiring board 30, the bump electrodes 121, the first individual wires 311, the first drive signal wires 321, the second drive signal wires 322, and the power supply wires 33 can be reliably connected to each other.

The core portion 122 is formed to linearly continue in the first direction X. In addition, the plurality of core portions 122 are arranged in parallel in the second direction Y. In the present embodiment, the core portions 122, which are respectively provided for the opposite end portions of the drive circuit 120 in the second direction Y, constitute the bump electrodes 121 connected to the first individual wires 311. In addition, the core portions 122, which are provided close to the center of the drive circuit 120 in the second direction Y, constitute the bump electrodes 121 connected to the first drive signal wires 321 or the power supply wires 33. The core portion 122 can be formed by using a photolithographic technique or an etching technology.

The bump wire 123 covers at least a portion of a surface of the core portion 122. The bump wire 123 is formed of metal such as Au, TiW, Cu, Cr (chrome), Ni, Ti, W, NiV, Al, Pd (palladium), and lead-free solder or an alloy and the bump wire 123 may be a single layer formed of one of those described above and may be formed by stacking a plurality of layers formed of a plurality of kinds of substances from those described above. In addition, the bump wires 123 are deformed in accordance with the shapes of the surfaces of the first individual wires 311, the first drive signal wires 321, and the power supply wires 33 with the core portions 122 being elastically deformed and the bump wires 123 are electrically connected to the first individual wires 311, the first drive signal wires 321, and the power supply wires 33, respectively. In the present embodiment, an adhesion layer 124 is provided between the drive circuit 120 and the wiring board 30 and the drive circuit 120 and the wiring board 30 are bonded to each other via the adhesion layer 124 such that the state of connection between the bump electrodes 121 and the first individual wires 311, the first drive signal wires 321, the second drive signal wires 322, and the power supply wires 33 is maintained.

In addition, the bump wires 123 are electrically connected to respective terminals (not shown) of the drive circuit 120. Specifically, the bump wire 123 of the bump electrode 121 connected to the first individual wire 311 is connected to a terminal through which the discharge signal is supplied to the piezoelectric actuator 150 from the drive circuit 120. In addition, the bump wire 123 connected to the first drive signal wire 321 is connected to a terminal that receives the first drive signal COM1. In addition, the bump wire 123 connected to the second drive signal wire 322 is connected to a terminal that receives the second drive signal COM2. In addition, the bump wire 123 connected to the power supply wire 33 is connected to a terminal that receives power. The plurality of bump electrodes 121 connected to the first drive signal wire 321, the second drive signal wire 322, and the power supply wires 33 are provided at predetermined intervals along the first drive signal wire 321, the second drive signal wire 322, and the power supply wires 33. Accordingly, one first drive signal wire 321, one second drive signal wire 322, and one power supply wire 33 can be electrically connected to the drive circuit 120 at a plurality of positions and a voltage drop in the first direction X, which is the longitudinal direction of the drive circuit 120, can be suppressed.

Note that, in the present embodiment, as the bump electrode 121, the core portion 122 and the bump wire 123 are provided. However, the invention is not particularly limited to this and the bump electrode 121 may be, for example, a metal bump. In addition, the connection between the terminals of the drive circuit 120 and the first individual wires 311, the first drive signal wires 321, and the power supply wires 33 may be established by welding a solder joint or the like or by means of compression with an anisotropic conductive adhesive (ACP or ACF) and a non-conductive adhesive (NCP or NCF) being interposed therebetween.

As described above, in the present embodiment, the drive circuit 120 is mounted on the first surface 301 of the wiring board 30 and thus it is not possible to secure a sufficient space on the first surface 301 of the wiring board 30. That is, the size of a space between the first surface 301 of the wiring board 30 and the drive circuit 120 is determined by the height of the bump electrode 121. The height of the bump electrode 121 of the recording head 1 is, for example, equal to or smaller than 20 μm. Even in such a configuration, when the first drive signal wires 321, the power supply wires 33, and the first bias wires 341 provided with the first buried wires 35 are provided, a wire of which the area of a cross section along the second direction Y, which is a direction orthogonal to a direction in which electricity flows, is large and that has a low electrical resistivity can be disposed in a narrow space on the first surface 301. Incidentally, in a case where the first buried wires 35 are not provided as the first drive signal wires 321, the second drive signal wires 322, the power supply wires 33, and the first bias wires 341, that is, in a case where each wire is provided without providing the first grooves 304 on the first surface 301 of the wiring board 30, the height of the wires cannot be high due to a limit on the size of a space on the first surface 301 and the cross-sectional area of the wires becomes small, which results in a high electrical resistivity. In addition, when the width of the wires is increased in order to make the electrical resistivity of the wires low, the size of the wiring board 30 is increased (particularly in the second direction Y). Furthermore, in a case where a wire having a relatively large thickness is formed without providing the first grooves 304 on the wiring board 30, it is difficult to form a pattern of wires at a high precision and a high density due to restriction attributable to a photolithographic method and thus it is only possible to form a wire having a relatively small thickness. In the present embodiment, since the thickness of the first buried wires 35 is determined by that of the first grooves 304 and the pattern of the first buried wires 35 is formed by the first grooves 304, it is possible to form the first buried wires 35 having a thickness of, for example, approximately 20 μm to 40 μm, which is relatively large, at pitches of 40 μm to 50 μm and at a high density in comparison with a case where the wires are formed only on a surface. Accordingly, the electrical resistivity can be decreased by increasing the cross-sectional area of the first buried wire 35. In addition, since the first buried wire 35 is buried in the first groove 304 of which the inner wall surface is formed by the first (111) surface and the second (111) surface, the cross section of the first buried wire 35 has a rectangular shape. Accordingly, the cross-sectional area is increased in comparison with a case where a silicon single-crystal board with a (100) surface is used as the drive circuit board and thus the electrical resistivity can be further decreased.

In addition, as described above, in the present embodiment, the first drive signal wire 321 through which the first drive signal COM1 is supplied to the drive circuit 120 from the external wire 130 is provided with two first buried wires 35 and the second drive signal wire 322 through which the second drive signal COM2 is supplied to the drive circuit 120 from the external wire 130 is provided with one first buried wire 35. That is, the number of the first buried wires 35 of the first drive signal wire 321 and the number of the first buried wires 35 of the second drive signal wire 322 are different from each other. In the present embodiment, the number of first buried wires 35 of the first drive signal wire 321 through which the first drive signal COM1 is supplied is larger than the number of the first buried wires 35 of the second drive signal wire 322 through which the second drive signal COM2 is supplied.

Note that, the first drive signal wire 321 provided with a larger number of first buried wires 35 is disposed close to the outer periphery side of the wiring board 30 in the second direction Y and the second drive signal wire 322 provided with a smaller number of first buried wires 35 is disposed close to the center of the wiring board 30 in the second direction Y, the second direction Y being a direction in which the first drive signal wire 321 and the second drive signal wire 322 are arranged in parallel. This is because the power supply wires 33 are not provided on the outer periphery side of the wiring board 30 and an increase in number of the first buried wires 35 on the outer periphery side facilitates changing a wiring pattern or suppression of an increase in size of the wiring board 30. Accordingly, it is preferable that the first drive signal wire 321 provided with a larger number of first buried wires 35 be disposed close to the outer periphery side of the wiring board 30 and the second drive signal wire 322 provided with a smaller number of first buried wires 35 be disposed close to the center of the wiring board 30.

Here, the first buried wires 35 are provided such that the first buried wires 35 have the same cross sectional area, that is, the first buried wires 35 are provided such that the areas of cross sections thereof in the second direction Y, which is a direction orthogonal to a direction in which electricity flows, are the same. Such a configuration is adopted in order to suppress the shape of a mask pattern at the time of forming the first groove 304 in which the first buried wire 35 is formed being complicated and to improve the stability in coverage of the first buried wire 35. Therefore, the first drive signal wire 321 provided with two first buried wires 35 can further decrease the electrical resistivity than the second drive signal wire 322 provided with one first buried wire 35.

Figure 4:
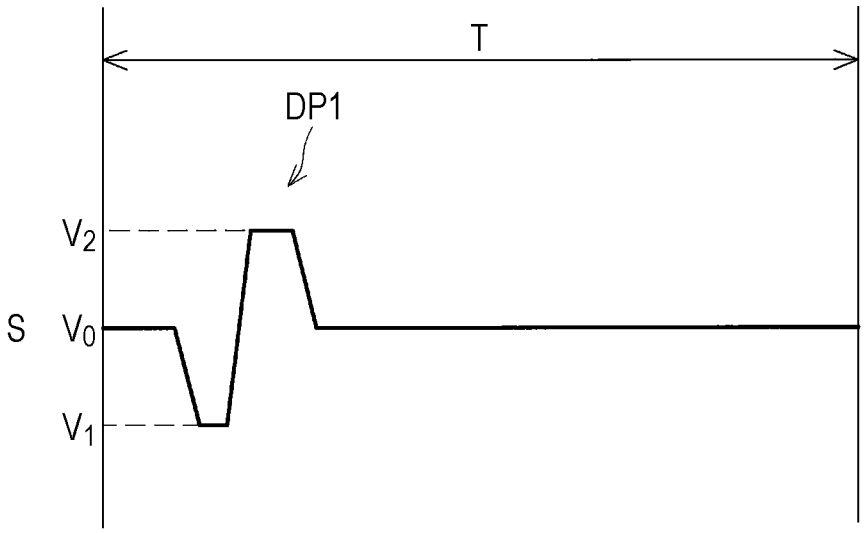
FIG. 4 is a waveform chart illustrating a small dot discharge signal according to Embodiment 1.

Therefore, when the drive circuit 120 supplies the discharge signal for recording a large dot, which is illustrated in FIG. 6, to the activated portion of the piezoelectric actuator 150, the largest electric current flows through the first drive signal wire 321 through which the first drive signal COM1 is supplied to the drive circuit 120. That is, in the case of the discharge signal for recording a small dot, which is illustrated in FIG. 4, only an electric current of the first discharge pulse DP1 flows through the first drive signal wire 321 in one recording cycle T. In addition, in the case of the discharge signal for recording a middle dot, which is illustrated in FIG. 5, an electric current of the first discharge pulse DP1 flows through the first drive signal wire 321 within one recording cycle T and an electric current of the fourth discharge pulse DP4 flows through the second drive signal wire 322 in one recording cycle T. However, in the case of the discharge signal for recording a large dot, which is illustrated in FIG. 6, an electric current of the first discharge pulse DP1, the second discharge pulse DP2, and the third discharge pulse DP3 flows through the first drive signal wire 321 within one recording cycle T and thus a larger electric current flows through the first drive signal wire 321 within one recording cycle T in comparison with a case where a small dot or a middle dot is recorded. Meanwhile, an electric current of the fourth discharge pulse DP4 flows through the second drive signal wire 322 within one recording cycle T in a case where a small dot is recorded and an electric current of the slight vibration pulse VP flows through the second drive signal wire 322 within one recording cycle T in a case where the slight-vibration driving operation is performed. However, these are smaller than an electric current that flows through the first drive signal wire 321 within one recording cycle T in a case where a large dot is recorded. Therefore, when selectively performing the recording of a small dot, the recording of a middle dot, the recording of a large dot, and the slight-vibration driving operation, the largest electric current flows through the first drive signal wire 321 at the time of recording a large dot. Therefore, since the number of the first buried wires 35 of the first drive signal wire 321 in which the largest electric current flows is larger than the number of the first buried wires 35 of the second drive signal wire 322 in which a relatively small electric current flows, a decrease in size of the wiring board 30 is achieved and the electrical resistivity of the first drive signal wire 321 is decreased such that a voltage drop of the first drive signal COM1, which is supplied via the first drive signal wire 321, can be decreased. Therefore, it is possible to restrain a voltage drop of the first drive signal COM1, which is supplied to the drive circuit 120, from occurring depending on the position at which the first drive signal wire 321 is connected to the drive circuit 120 and it is possible to supply the first drive signal COM1 with less variation. That is, it is possible to suppress variation attributable to a voltage drop between the first drive signal COM1 that is supplied to the drive circuit 120 from a terminal (bump electrode 121) connected to the first drive signal wire 321 at a position close to the external wire 130 and the first drive signal COM1 that is supplied to the drive circuit 120 from a terminal (bump electrode 121) connected to the first drive signal wire 321 at a position far from the external wire 130 with the electrical resistivity of the first drive signal wire 321 being decreased. Therefore, the drive circuit 120 can generate a discharge signal with suppressed variation based on the drive signal, the activated portion of the piezoelectric actuator 150 can be driven with a stable discharge signal, and thus it is possible to achieve an improvement in printing quality by reducing a displacement variation of the activated portion at the time of drive.

Incidentally, it is also conceivable to increase the number of the first buried wires 35 of the second drive signal wire 322 such that the number of the first buried wires 35 of the second drive signal wire 322 become equal to the number of the first buried wires 35 of the first drive signal wire 321. However, in this case, the total number of the first buried wires 35 on the first surface 301 is increased, a space for providing the first buried wires 35 becomes necessary, and thus the size of the wiring board 30 becomes large. According to the present embodiment, it is possible to achieve a decrease in size of the wiring board 30 without meaninglessly increasing the number of the first buried wires 35 of the second drive signal wire 322 in which a relatively small electric current flows since the number of the first buried wires 35 of the second drive signal wire 322 is smaller than the number of the first buried wires 35 of the first drive signal wire 321. That is, although the electrical resistivity of the second drive signal wire 322 is higher than that of the first drive signal wire 321 since the number of the first buried wires 35 of the second drive signal wire 322 is smaller than the number of the first buried wires 35 of the first drive signal wire 321, since only a small electric current flows through the second drive signal wire 322 in comparison with the first drive signal wire 321, a voltage drop is less likely to occur in the second drive signal wire 322 even though the second drive signal wire 322 has a relatively high electrical resistivity. Accordingly, it is possible to suppress a voltage drop of the first drive signal COM1 and the second drive signal COM2, which are supplied to the drive circuit 120 via the first drive signal wire 321 and the second drive signal wire 322 from the external wire 130, such that the stable first drive signal COM1 and the stable second drive signal COM2 can be supplied and it is possible to drive the activated portion of the piezoelectric actuator 150 with the stable first drive signal COM1 and the stable second drive signal COM2.

Note that, an electric current that flows through the first drive signal wire 321 and the second drive signal wire 322 changes depending on the number of the activated portions of the piezoelectric actuator 150 driven at the same time. For example, when a large dot is recorded with all of the activated portions being driven at the same time, an electric current of the first drive signal COM1 supplied to the drive circuit 120 via the first drive signal wire 321 becomes large. When the electrical resistivity of the first drive signal wire 321 at this time is high, a voltage drop occurs and there is a change in voltage of the first drive signal COM1 input from a terminal provided at a different position in the first direction X. On the other hand, when the number of the activated portions of the piezoelectric actuator 150 that are driven at the same time is small, an electric current of the first drive signal COM1 supplied to the drive circuit 120 via the first drive signal wire 321 becomes small and an influence due to a voltage drop is less likely to be generated even when the electrical resistivity of the first drive signal wire 321 is high. Therefore, when the electrical resistivity of the first drive signal wire 321 is decreased, a variation in voltage fluctuation of the first drive signal COM1 attributable to a fluctuation in number of the activated portions of the piezoelectric actuator 150 that are driven at the same time, a so-called load fluctuation, is suppressed such that the activated portions of the piezoelectric actuator 150 can be stably driven and a variation in ink droplet discharging characteristics is suppressed such that an improvement in printing quality can be achieved.

In addition, heat generated from a wire increases in proportion to the square of an electric current. Therefore, it is possible to decrease the amount of electric current flowing per one first buried wire 35 and to effectively reduce heat generated from the first drive signal wire 321 by increasing the number of the first buried wires 35 of the first drive signal wire 321 in which a relatively large electric current flows.

Note that, in the present embodiment, the number of the first buried wires 35 of the first drive signal wire 321 and the number of the first buried wires 35 of the second drive signal wire 322 are compared with each other. However, the above-described comparison is substantially comparison between the first buried wires 35 of the first drive signal wire 321 and the first buried wire 35 of the second drive signal wire 322 in electrical resistivity. Therefore, it is sufficient that the comparison between the number of the first buried wires 35 of the first drive signal wire 321 and the number of the first buried wires 35 of the second drive signal wire 322 be performed in a case where the first buried wires 35 of the first drive signal wire 321 and the first buried wire 35 of the second drive signal wire 322 are approximately equal to each other in cross-sectional area, that is, the area of a section in the second direction Y, which is a direction orthogonal to a direction in which electricity flows. However, since there may be a case where the first buried wires 35 of the first drive signal wire 321 and the first buried wire 35 of the second drive signal wire 322 are different from each other in length or sectional area due to a difference in routing method, it is sufficient that the electrical resistivity of the first buried wires 35 of the first drive signal wire 321 and the electrical resistivity of the first buried wire 35 of the second drive signal wire 322 be compared with each other. That is, it is sufficient that the total electrical resistivity of the first buried wires 35 of the first drive signal wire 321 be higher than the total electrical resistivity of the first buried wire 35 of the second drive signal wire 322 as a result of comparison between the total electrical resistivity of the first buried wires 35 of the first drive signal wire 321 and the total electrical resistivity of the first buried wire 35 of the second drive signal wire 322. Therefore, even when the first buried wires 35 of the first drive signal wire 321 and the first buried wire 35 of the second drive signal wire 322 are different from each other in cross sectional area or length, when the electrical resistivities thereof satisfy the above-described relationship, a displacement variation of the piezoelectric actuator 150 attributable to a variation in voltage fluctuation can be suppressed with a voltage drop in the first drive signal wire 321 being suppressed. However, the cross-sectional areas of the plurality of first buried wires 35 are preferably approximately equal to each other. That is, the plurality of first grooves 304 in which the first buried wires 35 are formed are preferably formed to have the same sectional area. Such a configuration is adopted in order to suppress the shape of a mask pattern at the time of etching for forming the first groove 304 or a second groove 306 being complicated and to improve the etching accuracy or the stability in coverage of the first buried wire 35 or a second buried wire 37.

In addition, each of the first drive signal wires 321 and the second drive signal wires 322 is provided with the first connection wire 36 in addition to the first buried wire 35. Therefore, to be precise, it is sufficient that the first drive signal wire 321 and the second drive signal wire 322 be compared with each other in electrical resistivity from a portion to which the external wire 130 is connected to a portion connected to each terminal of the drive circuit 120. That is, it is sufficient that the electrical resistivity from a portion of the first drive signal wire 321 connected to the external wire 130 to a portion of the first drive signal wire 321 connected to a terminal of the drive circuit 120 (in the present embodiment, bump electrode 121 connected to terminal) be larger than the electrical resistivity from a portion of the second drive signal wire 322 connected to the external wire 130 to a portion of the second drive signal wire 322 connected to a terminal of the drive circuit 120 (in the present embodiment, bump electrode 121 connected to terminal). Incidentally, although the first drive signal wire 321 and the second drive signal wire 322 are connected to the drive circuit 120 via a plurality of terminals, it is sufficient that the above-described comparison be performed with respect to a portion with the highest electrical resistivity.

Furthermore, as illustrated in FIGS. 13 and 16, the first bias wire 341 is electrically connected to a bias through-wire 345 provided in the wiring board 30. The bias through-wire 345 is formed in a third through-hole 307 which is provided to be open in the bottom surface of the first groove 304 in which the first bias wire 341 is formed. Accordingly, the bias through-wire 345 and the first bias wire 341 are electrically connected to each other at the bottom surface of the first groove 304. Note that, as with the individual through-wire 315 described above, the bias through-wire 345 can formed of metal such as copper (Cu) and can be formed via electroplating, electroless plating, or the like. In addition, when the first buried wire 35 and the bias through-wire 345 are formed at the same time, the first buried wire 35 and a drive signal through-wire 325 can be integrally formed with each other. That is, when the first buried wire 35, the individual through-wire 315, the drive signal through-wire 325, and the bias through-wire 345 are formed at the same time, a manufacturing process can be further simplified and thus cost reduction can be achieved. Note that, the bias through-wire 345 is formed only on one end side in the first direction X to which the external wire 130 is connected.

As illustrated in FIGS. 11 and 14, the second surface 302 of the wiring board 30 as described above is provided with the second individual wires 312 constituting the individual wires 31 and second bias wires 342 constituting the bias wires.

The second individual wire 312 is electrically connected to the individual through-wire 315 and is electrically connected to the individual lead electrode 91 provided on the flow path forming board 10 and the discharge signal from the drive circuit 120 is supplied to the first electrode 60, which is the individual electrode of the activated portion of the piezoelectric actuator 150, via the bump electrode 121, the individual wire 31 provided with the first individual wire 311, the individual through-wire 315, and the second individual wire 312, and the individual lead electrode 91.

Specifically, on each of the opposite end portions of the wiring board 30 in the second direction Y, a plurality of the second individual wires 312 are arranged in parallel in the first direction X. In addition, the second individual wire 312 is provided to extend in the second direction Y and one end thereof covers an end portion of the individual through-wire 315 such that the second individual wire 312 is electrically connected to the individual through-wire 315. That is, the individual wire 31 includes the first individual wire 311 provided on the first surface 301, the individual through-wire 315, and the second individual wire 312 provided on the second surface 302. In addition, the second individual wire 312 is electrically connected to the individual lead electrode 91 provided on the flow path forming board 10 via a bump electrode 39, which will be described in details later.

As illustrated in FIGS. 11, 14, and 16, the second bias wire 342 is electrically connected to the bias through-wire 345 and is electrically connected to the common lead electrode 92 provided on the flow path forming board 10 and the bias voltage (VBS) supplied from the external wire 130 is supplied to the second electrode 80, which is the common electrode of the activated portions of the piezoelectric actuator 150, via the first bias wire 341, the bias through-wire 345, the second bias wire 342, and the common lead electrode 92. That is, the bias wire 34 through which the bias voltage (VBS) is supplied to the piezoelectric actuator 150 is provided with the first bias wire 341 provided on the first surface 301, the bias through-wire 345, and the second bias wire 342. In addition, the second bias wire 342 extends in the first direction X and one second bias wire 342 is provided for each of the rows of the piezoelectric actuators 150 such that two second bias wires 342 are provided in total.

As illustrated in FIGS. 11 and 16, the second bias wire 342 as described above is provided the second buried wire 37 that is buried in the second groove 306 provided in the second surface 302 of the wiring board 30 and a second connection wire 38 that covers the second buried wire 37.

In the present embodiment, the second groove 306 is provided at a position that faces the first groove 304 provided in the first surface 301 in the third direction Z. That is, in the present embodiment, the position in the second direction Y of each second groove 306 is the same as that of each first groove 304 and each second groove 306 is provided to have the same width as that of each first groove 304. In addition, as illustrated in FIG. 14, the second groove 306 is provided to be linear in the first direction X except for an end portion on the external wire 130 side. Six second grooves 306 as described above are provided for each of the rows of the activated portions of the piezoelectric actuator 150 and twelve second grooves 306 are provided in total.

As with the first groove 304 described above, inner wall surfaces of the second groove 306 as described above are formed by a first (111) surface that is perpendicular to a (110) surface which is the crystal orientation of a surface of the wiring board 30 and a second (111) surface that faces the first (111) surface and is perpendicular to the (110) surface. That is, the second groove 306 can be formed at a high precision by performing anisotropic etching (wet etching) by using an alkaline solution as with the first groove 304. In addition, the first groove 304 and the second groove 306 can be formed at the same time through anisotropic etching.

The second buried wire 37 is buried in the second groove 306. That is, the second buried wire 37 is formed to fill the first groove 304. That is, six second buried wires 37 are provided for each of the rows of the activated portions of the piezoelectric actuator 150 and twelve second buried wires 37 are provided in total. As with the first buried wire 35 buried in the first groove 304, the second buried wire 37 is formed of metal such as copper (Cu) and for example, can be formed by electroplating, electroless plating, or a method of printing conductive paste.

The second connection wire 38 is stacked to cover the second buried wires 37. In the present embodiment, the second connection wire 38 of the second bias wire 342 is stacked to continuously cover the plurality of second buried wires 37. That is, one second connection wire 38 covers all of the six second buried wires 37 that are provided for each of the rows of the activated portions of the piezoelectric actuator 150.

As with the first connection wire 36, a wire, which is obtained by stacking a close-contact layer that is provided on the second buried wire 37 side and is formed of titanium (Ti) and a conductive layer that is provided on the close-contact layer and is formed of gold (Au) or the like, can be used as the second connection wire 38. It is a matter of course that a layer formed of other conductive material may be stacked as the second connection wire 38. Note that, the second connection wire 38 and the second individual wire 312 can be formed at the same time. In this case, it is possible to simplify a manufacturing process and to achieve cost reduction.

The second bias wire 342 is formed by the second buried wires 37 and the second connection wire 38.

As illustrated in FIGS. 11 and 14, each of the second connection wires 38 constituting the second bias wires 342 provided on the wiring board 30 extends in an area between the second connection wires 38 arranged in parallel in the second direction Y and the second connection wires 38 are electrically connected to the common lead electrode 92 provided on the flow path forming board 10 via the bump electrodes 39 at a portion where the second connection wire 38 extends.

Here, as with the bump electrodes 121 provided on the drive circuit 120, each of the bump electrodes 39 that connect the second individual wire 312 and the second bias wire 342 to the individual lead electrode 91 and the common lead electrode 92 is provided with a core portion 391 that is formed of elastic resin material and a bump wire 392 that covers at least a portion of a surface of the core portion 391.

The core portion 391 is formed of the same material as the core portion 122 constituting the bump electrode 121 of the drive circuit 120 as described above and is formed to have the same cross sectional shape as that of the core portion 122. The core portion 391 as described above is disposed to linearly continue in the first direction X. In addition, one core portion 391 is provided outward of each of the two rows of the activated portions of the piezoelectric actuator 150 in the second direction Y such that two core portions 391 are provided outward of the two rows of the activated portions of the piezoelectric actuator 150 in total and one core portion 391 is provided between the two rows of the activated portions of the piezoelectric actuator 150. Therefore, three core portions 391 are provided in total. In addition, each of the core portions 391 provided outward of the two rows of activated portions of the piezoelectric actuator 150 constitutes the bump electrode 39 for connecting the second individual wire 312 to the individual lead electrode 91. In addition, the core portion 391 provided between the two rows of activated portions of the piezoelectric actuator 150 constitutes the bump electrodes 39 for connecting the second bias wire 342 to the common lead electrode 92 of the two rows of the piezoelectric actuators 150.

In addition, in the present embodiment, regarding the bump wire 392 constituting the bump electrode 39 for connecting the second individual wire 312 to the individual lead electrode 91, the second individual wire 312 is provided to extend up to a position on the core portion 391 such that the second individual wire 312 is used as the bump wire 392.

Similarly, in the present embodiment, regarding the bump wire 392 constituting the bump electrode 39 for connecting the second bias wire 342 to the common lead electrode 92, the second connection wire 38 is provided to extend up to a position on the core portion 391 such that the second connection wire 38 is used as the bump wire 392. It is a matter of course that the second individual wire 312 or the second connection wire 38 and the bump wire 392 may be provided as separate wires and both may be partially overlapped with each other such that electrical connection therebetween is established.

Note that, the second connection wire 38 extends up to positions on the core portion 391 at a plurality of positions arranged at predetermined intervals in the first direction X.

That is, the plurality of bump electrodes 39 that connect the second bias wires 342 and the common lead electrode 92 to each other are provided at predetermined intervals in the first direction X. The second bias wires 342 are electrically connected to the first bias wires 341 on the first surface 301 via the bias through-wires 345. Therefore, it is possible to substantially decrease the electrical resistivity of the bias wires 34 in the first direction X. That is, since the bias wires 34 are not provided in the first direction X, which is the longitudinal direction, on the first surface 301 of the wiring board 30 and the plurality of second bias wires 342, each of which is a portion of the bias wire 34, are provided on the second surface 302, the electrical resistivity of the bias wires 34 can be decreased in the first direction X and thus a voltage drop due to insufficient current capacities of the bias wires 34 can be suppressed.

Furthermore, the second bias wires 342 are electrically connected to the common lead electrode 92 via the bump electrodes 39 at a plurality of positions in the second direction Y. Therefore, a voltage drop in the first direction X of the second electrode 80 is suppressed and a variation in bias voltage application to each activated portion can be suppressed.

Note that, electrical connection between the second individual wires 312 and the individual lead electrodes 91 and electrical connection between the second bias wires 342 and the common lead electrode 92 are not limited to electrical connection via the bump electrodes 39 and may be, for example, electrical connection via a metal bump. In addition, connection between the second buried wire and the individual lead wires and connection between an auxiliary wire and the common lead wire may be established by welding a solder joint or the like or by means of compression with an anisotropic conductive adhesive (ACP or ACF) and a non-conductive adhesive (NCP or NCF) being interposed therebetween.

Since the individual lead electrodes 91 and the common lead electrode 92 of the flow path forming board 10 and the second individual wires 312 and the bias wires 34 of the wiring board 30 are electrically connected to each other via the bump electrodes 39, even when the flow path forming board 10 or the wiring board 30 is warped or rolled up, the core portions 391 are deformed corresponding to the deformation of the flow path forming board 10 or the wiring board 30. Therefore, electrical connection between the individual lead electrodes 91 and the second individual wires 312 of the wiring board 30 and electrical connection between the common lead electrode 92 and the second bias wires 342 of the wiring board 30 can be reliably established.

In addition, the flow path forming board 10 and the wiring board 30 are bonded to each other by an adhesion layer 300 and thus the second individual wires 312, the second connection wires 38, the individual lead electrodes 91, and the common lead electrode 92 are fixed in a state of abutting onto each other, the second individual wires 312 and the second connection wires 38 being the bump wires 392 constituting the bump electrodes 39.

Between the flow path forming board 10 and the wiring board 30, a holding section 160, which is a space in which the piezoelectric actuators 150 are disposed, is formed by the adhesion layer 300 that bonds the flow path forming board 10 and the wiring board 30 to each other. That is, the height of the holding section 160 in the third direction Z is determined by the height of the bump electrode 39. In order to increase the height of the holding section 160, it is necessary to increase the size of the core portion 391 of the bump electrode 39. However, in order to increase the size of the core portion 391, a planar space for providing the core portion 391 is also needed, which results in an increase in size of the flow path forming board 10, the wiring board 30, and the like. That is, it is preferable that the height of the holding section 160 be as small as possible to an extent that the driving of the piezoelectric actuator 150 is not hindered. In this case, it is possible to achieve a decrease in size of the recording head in the second direction Y and the third direction Z. Incidentally, in the recording head 1 according to the present embodiment, a space needed for displacement of the piezoelectric actuator 150 is, approximately 20 μm.

Since the second bias wires 342 constituting the bias wires 34 are provided on the second surface 302, it is not necessary to provide the bias wires 34 in the first direction X on the first surface 301 and a space for providing the bias wires 34 in the first direction X on the first surface 301 is not necessary. Therefore, it is possible to achieve a decrease in size of the wiring board 30. That is, since the second bias wires 342, each of which is a main portion of the bias wire 34, are provided on the second surface 302 having a larger available space than the first surface 301, an increase in size of the wiring board 30 is suppressed and a decrease in size can be achieved.

In addition, in the present embodiment, since the second bias wires 342 provided on the second surface 302 of the wiring board 30 include the second buried wires 37 provided in the second grooves 306, the second bias wires 342 with a low electrical resistivity can be provided in the holding section 160 of which the height is small. That is, in a case where the second bias wires 342 are provided without providing the second grooves 306 on the second surface 302 of the wiring board 30, the height of the wires cannot be high due to a limit on the height of the holding section 160 and the cross-sectional area of the wires becomes small, which results in a high electrical resistivity. In addition, when the width of the second bias wire 342 is increased in order to make the electrical resistivity of the second bias wire 342 small, the size of the wiring board 30 or the flow path forming board 10 is increased in the second direction Y. Furthermore, in a case where a wire having a relatively large thickness is formed without providing the second grooves 306 on the wiring board 30, it is difficult to form a pattern of wires at a high precision and a high density due to restriction attributable to a photolithographic method and thus it is only possible to form a wire having a relatively small thickness. Furthermore, when the wire is formed to be thick, the wire becomes close to the piezoelectric actuator 150 and there is a possibility that the wire comes into contact with an electrode of the piezoelectric actuator 150 or dielectric breakdown due to an electric discharge occurs. In the present embodiment, since the thickness of the second buried wires 37 is determined by that of the second grooves 306 and the pattern of the second buried wires 37 is formed by the second grooves 306, it is possible to form the second buried wires 37 having a thickness of, for example, approximately 10 μm to 50 μm, which is relatively large, at pitches of 40 μm to 50 μm and at a high density in comparison with a case where the wires are formed only on a surface. Accordingly, the electrical resistivity can be decreased by increasing the cross-sectional area of the second buried wire 37. In addition, since the cross-sectional area of the second buried wire 37 can be increased, it is possible to suppress a significant increase in electrical resistivity even when the width of the second buried wire 37 in the second direction Y is made small. Accordingly, it is possible to arrange the second buried wires 37 at a high density and to achieve a decrease in size of the wiring board 30 and the flow path forming board 10. In addition, in the present embodiment, one second bias wire 342 includes the plurality of (specifically, six) second buried wires 37. Therefore, the electrical resistivity from a one end portion of the second bias wire 342 in the first direction X, to which a bias voltage (VBS) from the external wire 130 is supplied, to the other end portion of the second bias wire 342 can be effectively decreased by means of the plurality of second buried wires 37.

In addition, in the present embodiment, the number of the second buried wires 37 of the second bias wire 342 is six, the number of the first buried wires 35 of the first drive signal wire 321 is two, and the number of first buried wires 35 of the second drive signal wire 322 is one. That is, the number of the second buried wires 37 of the bias wire 34 is larger than the number of first buried wires 35 of the first drive signal wire 321 and the number of the first buried wires 35 of the second drive signal wire 322. As described above, the number of the second buried wires 37 of the bias wire 34 is preferably equal to or larger than any one of the number of the first buried wires 35 of the first drive signal wire 321 and the number of the first buried wires 35 of the second drive signal wire 322, more preferably equal to or larger than both of the number of the first buried wires 35 of the first drive signal wire 321 and the number of the first buried wires 35 of the second drive signal wire 322, and further preferably equal to or larger than the sum of the number of the first buried wires 35 of the first drive signal wire 321 and the number of the first buried wires 35 of the second drive signal wire 322. This is because, in a case where the piezoelectric layer 70 in which a relationship between voltage and electric-field-induced strain (displacement) is represented by a butterfly curve is used as the piezoelectric actuator 150, the relationship between voltage and electric-field-induced strain indicates that a variation in displacement characteristics with respect to a variation in voltage becomes greater at a portion close to the ground. Therefore, since suppressing a variation in voltage at a portion close to the ground results in suppression of a variation in displacement characteristics, it is preferable that the electrical resistivity of the bias wire 34 close to the ground be decreased. That is, when the electrical resistivity of the bias wire 34 close to the ground is high and the voltage fluctuation attributable to the load fluctuation is large, a variation in displacement characteristics of the piezoelectric layer 70 becomes large. On the other hand, at a high-voltage portion in the butterfly curve, a variation in displacement characteristics with respect to a variation in voltage is small in comparison with the vicinity of the ground. Therefore, when the number of the second buried wires 37 of the bias wire 34 is preferably equal to or larger than any one of the number of the first buried wires 35 of the first drive signal wire 321 and the number of the first buried wires 35 of the second drive signal wire 322, more preferably equal to or larger than both of the number of first buried wires 35 of the first drive signal wire 321 and the number of the first buried wires 35 of the second drive signal wire 322, and further preferably equal to or larger than the sum of the number of the first buried wires 35 of the first drive signal wire 321 and the number of the first buried wires 35 of the second drive signal wire 322, the electrical resistivity of the bias wire 34 is reliably decreased, a voltage drop of the bias wire 34 is suppressed, and thus a variation in displacement characteristics of the piezoelectric actuator 150 can be further suppressed.

As described above, in the present embodiment, the activated portions of the piezoelectric actuators 150, which are the drive elements that cause a change in pressure of ink in the pressure generation chambers 12 as flow paths communicating with the nozzle openings 21 from which ink is ejected, the drive circuit 120 that outputs the discharge signal, which is a signal for driving the activated portions of the piezoelectric actuators 150, and the wiring board 30, of which the first surface 301 is on a side opposite to a side on which the activated portions of the piezoelectric actuators 150 are disposed and is close to the drive circuit 120 and of which the second surface 302 is close to the activated portions of the piezoelectric actuators 150, are provided. The wiring board 30 is provided with the power supply wires 33 that supply power to the drive circuit 120, the first drive signal wires 321 that supply the first drive signal COM1 to the drive circuit 120, and the second drive signal wires 322 that supply the second drive signal COM2 to the drive circuit 120 and that are not electrically connected to the power supply wires 33 and the first drive signal wires 321. Each of the first drive signal wires 321 and the second drive signal wires 322 is provided with the first buried wire 35, which is a buried wire buried in the first groove 304 provided on the wiring board 30, and the first drive signal wires 321 and the second drive signal wires 322 are different from each other in number of the first buried wires 35.

In the present embodiment, the number of the first buried wires 35 of the first drive signal wire 321 is larger than the number of the first buried wires 35 of the second drive signal wire 322. Since the number of the first buried wires 35 of the first drive signal wire 321 is larger than the number of the first buried wires 35 of the second drive signal wire 322 as described above, the electrical resistivity of the first drive signal wire 321 can be decreased in comparison with the second drive signal wire 322. Therefore, a voltage drop of the first drive signal COM1, which is supplied to the drive circuit 120 by the first drive signal wire 321, can be suppressed. Particularly, a variation in voltage fluctuation of the first drive signal COM1 attributable to the load fluctuation is suppressed such that the activated portions of the piezoelectric actuator 150 can be stably driven and a variation in ink droplet discharging characteristics is suppressed such that an improvement in printing quality can be achieved.

In addition, in the present embodiment, the number of the first buried wires 35 of the second drive signal wire 322 is smaller than the number of the first buried wires 35 of the first drive signal wire 321. Therefore, it is possible to suppress a meaningless increase in number of the first buried wires 35 of the second drive signal wire 322 and to achieve a decrease in size of the wiring board 30.

In addition, each of the first drive signal wires 321 and the second drive signal wires 322 is provided with the first buried wire 35 that is buried in the first groove 304 provided on the wiring board 30. Therefore, the first drive signal wires 321 and the second drive signal wires 322 having a large cross-sectional area and a large electrical resistivity can be provided on a relatively narrow space on the wiring board 30. In addition, the first drive signal wires 321 and the second drive signal wires 322 can be disposed at a high density and the size of the wiring board 30 can be decreased in an in-plane direction of the first surface 301.

In addition, in the present embodiment, the plurality of activated portions of the piezoelectric actuators 150, which are drive elements, the second electrode 80, which is a common electrode that is common to the plurality of activated portions, are preferably provided. The wiring board 30 is preferably provided with the bias wires 34 that are connected to the second electrode 80 and that supply a bias voltage, which is a reference potential, to the second electrode 80, each of the bias wires 34 is preferably provided with the second buried wires 37 as buried wires buried in the second groove 306 provided on the wiring board 30, and the number of the second buried wires 37 of the bias wire 34 is preferably equal to or larger than any one of the number of the first buried wires 35 of the first drive signal wire 321 and the number of the first buried wires 35 of the second drive signal wire 322.

When the number of the second buried wires 37 of the bias wire 34 is equal to or larger than any one of the number of the first buried wires 35 of the first drive signal wire 321 and the number of the second buried wires 37 of the second drive signal wire 322, the electrical resistivity of the bias wire 34 can be decreased. Therefore, in a case where a piezoelectric layer having a characteristic in which a relationship between voltage and electric-field-induced strain (displacement) is represented by a butterfly curve is used as the piezoelectric layer 70 of the piezoelectric actuator 150, the electrical resistivity of the bias wire 34 on the ground side in which a variation in displacement characteristic with respect to a variation in voltage is large is reliably suppressed, a voltage drop of the bias wire 34 is suppressed, and a variation in displacement characteristics of the piezoelectric actuator 150 can be further suppressed.

In addition, any one of the first drive signal wire 321 and the second drive signal wire 322 is preferably disposed close to the outer periphery side of the wiring board 30, and the number of the first buried wires 35, which are buried wires, of the one of the first drive signal wire 321 and the second drive signal wire 322, which is disposed close to the outer periphery side of the wiring board 30, is preferably larger than the number of the first buried wires 35, which are buried wires, of the other one of the first drive signal wire 321 and the second drive signal wire 322. In the present embodiment, the number of the first buried wires 35 of the first drive signal wire 321 is larger than the number of the first buried wires 35 of the second drive signal wire 322. Therefore, the first drive signal wire 321 is disposed close to the outer periphery side of the wiring board 30 in the second direction Y and the second drive signal wire 322 is disposed close to the center of the wiring board 30 in the second direction Y, the second direction Y being a direction in which the first drive signal wire 321 and the second drive signal wire 322 are arranged in parallel. Since the first drive signal wire 321 provided with a larger number of first buried wires 35 is disposed close to the outer periphery side of the wiring board 30 and the second drive signal wire 322 provided with a smaller number of first buried wires 35 is disposed close to the center of the wiring board 30 as described above, the number of the first buried wires 35 close to the outer periphery side of the wiring board 30, on which a relatively large available space is provided, can be increased without an increase in size of the wiring board 30 and it is easy to perform electrical connection between the first buried wires 35 or wiring.

In addition, in the present embodiment, the number of the first buried wires 35 which are buried wires provided on the first surface 301 of the wiring board 30 and the number of the second buried wires 37 which are buried wires provided on the second surface 302 is preferably different from each other. In this case, the number of the first buried wires 35 on the first surface 301 or the number of the second buried wires 37 on the second surface 302 is decreased and it is possible to achieve a decrease in size of the wiring board 30.

In addition, in the present embodiment, the recording head 1 and the drive signal generation unit 216, which is a drive signal generation circuit that generates the first drive signal COM1 and the second drive signal COM2, is preferably provided, and the number of the first buried wires 35, which are buried wires, of the first drive signal wire 321 is preferably larger than the number of first buried wires 35, which are buried wires, of the second drive signal wire 322 in a case where the value of an electric current, which flows through the first drive signal wire 321 for one discharge cycle via the first drive signal COM1 and the second drive signal COM2 generated by the drive signal generation unit 216, is larger than the value of an electric current, which flows through the second drive signal wire 322 for one discharge cycle via the first drive signal COM1 and the second drive signal COM2 generated by drive signal generation unit 216. That is, it is sufficient that the number of the first buried wires 35 of the first drive signal wire 321 in which a large amount of electric current flows be larger than the number of the first buried wires 35 of the second drive signal wire 322 in which a smaller amount of electric current flows than that in the first drive signal wire 321. In this case, a voltage drop of the first drive signal COM1, which is supplied to the drive circuit 120 via the first drive signal wire 321 in which a large amount of electric current flows, is suppressed and a variation in displacement characteristics of the activated portion of the piezoelectric actuator 150, which is the drive element, can be suppressed.

As illustrated in FIGS. 8 to 11, a case member 40, in which the manifolds 100 communicating with the plurality of pressure generation chambers 12 are formed, is fixed to a bonded body obtained by bonding the flow path forming board 10, the wiring board 30, the communication plate 15, and the nozzle plate 20 to each other. The case member 40 has approximately the same shape of the communication plate 15 described above as seen in a plan view and the case member 40 is bonded to the wiring board 30 and is also bonded to the communication plate 15 described above. Specifically, the case member 40 is provided with a recess 41 having a depth such that the flow path forming board 10 and the wiring board 30 can be accommodated therein, the recess 41 being on the wiring board 30 side. The recess 41 has an opening area wider than a surface of the wiring board 30 that is bonded to the flow path forming board 10. In addition, in a state where the flow path forming board 10 or the like is accommodated in the recess 41, an opening surface of the recess 41 that is on the nozzle plate 20 side is sealed by the communication plate 15. In addition, in the case member 40, third manifold portions 42 having a recess-like shape are formed on both sides of the recess 41 in the second direction Y. The third manifold portions 42 and the first manifold portions 17 and the second manifold portions 18 which are provided in the communication plate 15 constitute the manifolds 100 according to the present embodiment.

As the material of the case member 40, for example, resin, metal, or the like can be used. Incidentally, when resin material is molded as the case member 40, mass production at low cost can be realized.

A surface of the communication plate 15 that is on the nozzle plate 20 side is provided with the compliance board 45. The compliance board 45 seals openings of the first manifold portions 17 and the second manifold portions 18 that are on the nozzle plate 20 side. In the present embodiment, the compliance board 45 as described above is provided with a sealing film 46 and a fixation board 47. The sealing film 46 is a flexible thin film (for example, thin film that is formed of polyphenylene sulfide (PPS) or stainless steel (SUS) and of which thickness is equal to or smaller than 20 μm) and the fixation board 47 is formed of rigid material such as metal, for example, stainless steel (SUS). Since a region of the fixation board 47 that faces the manifold 100 is an opening portion 48 that is obtained by complete removal in the thickness direction, one surface of the manifold 100 is a compliance portion 49, which is a flexible portion at which the manifold 100 is sealed by only the sealing film 46.

The case member 40 is provided with inlet paths 44 that communicate with the manifolds 100 and through which ink is supplied to each manifold 100. In addition, the case member 40 is provided with a connection port 43 through which the wiring board 30 is exposed and into which the external wire is inserted and the external wire 130 inserted into the connection port 43 is connected to each wire of the wiring board 30, that is, the first drive signal wires 321, the power supply wires 33, and the first bias wires 341.

In the recording head 1 configured as described above, when ink is ejected, ink is taken in from a liquid storage unit, in which ink is stored, via the inlet paths 44 and the flow path is filled with ink over an area from the manifold 100 to the nozzle opening 21. Thereafter, according to a signal from the drive circuit 120, voltage is applied to each piezoelectric actuator 150 corresponding to the pressure generation chamber 12 and the piezoelectric actuator 150 and the vibration plate 50 are warped. Accordingly, the pressure in the pressure generation chamber 12 is increased and an ink droplet is ejected from a predetermined nozzle opening 21.

Embodiment 2

Figure 17:
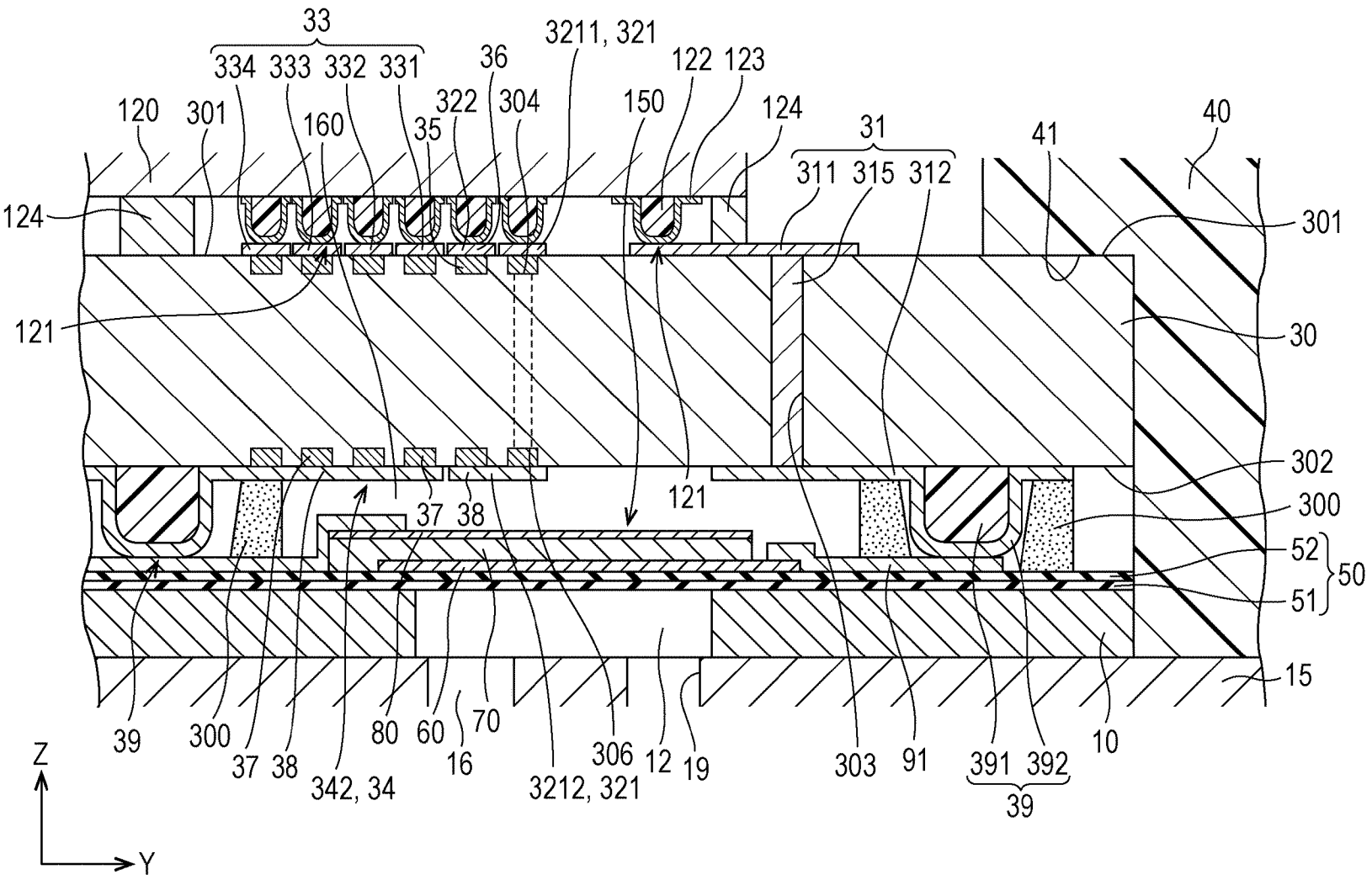
FIG. 17 is a sectional view illustrating a main portion of a wiring board according to Embodiment 2.
Figure 18:
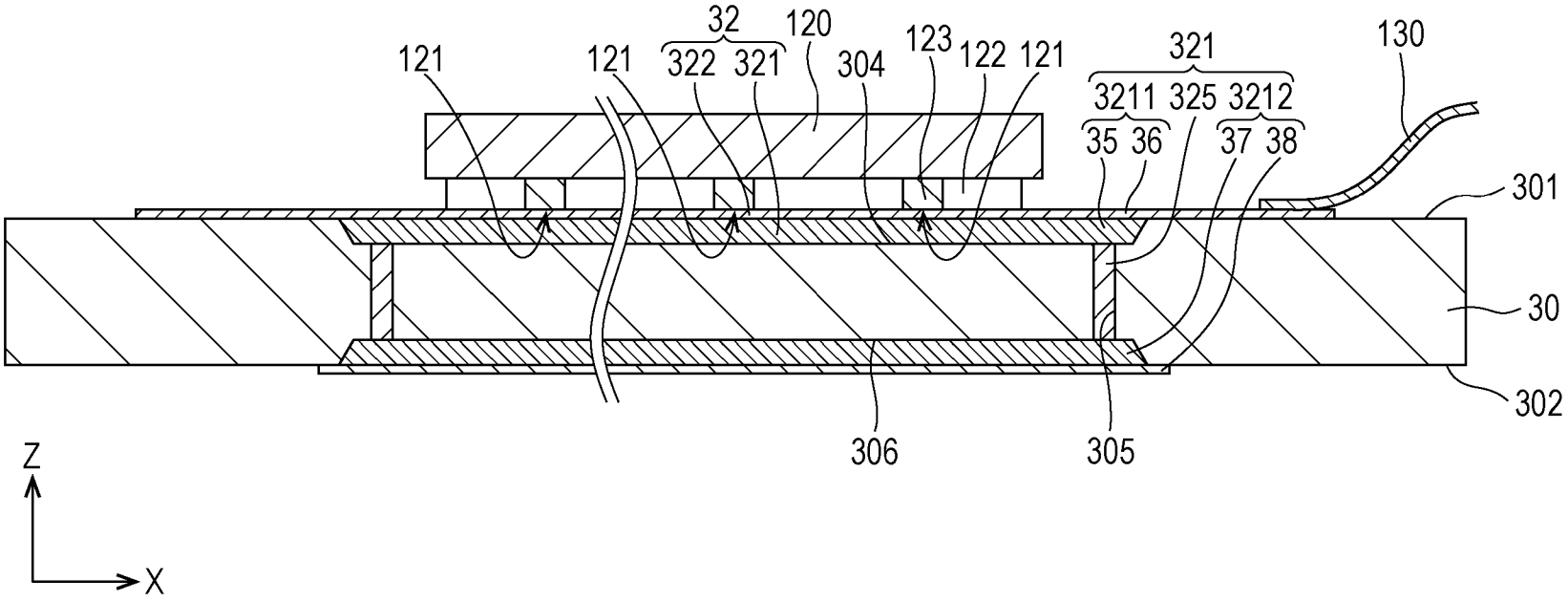
FIG. 18 is a sectional view of the wiring board according to Embodiment 2, which is taken along a line equivalent to line XVIII-XVIII in FIG. 12.

FIG. 17 is a sectional view illustrating a main portion of a drive circuit board according to Embodiment 2 of the invention and FIG. 18 is a sectional view of a wiring board, which is taken along a line equivalent to line XVIII-XVIII in FIG. 12. Note that, the same members as in the above-described embodiment will be given the same reference numerals and repetitive description thereof will be omitted.

As illustrated in FIGS. 17 and 18, the first drive signal wire 321 in the present embodiment is provided with a for-first-surface first drive signal wire 3211 provided on the first surface 301 and a for-second-surface first drive signal wire 3212 provided on the second surface 302.

The for-first-surface first drive signal wire 3211 is provided with one first buried wire 35 and the first connection wire 36 that covers the first buried wire 35, for each of the rows of the activated portions of the piezoelectric actuator 150.

The for-second-surface first drive signal wire 3212 is provided with the second buried wires 37 that are buried in the second grooves 306 provided on the second surface 302 of the wiring board 30 and the second connection wire 38 that covers the second buried wires 37. In the present embodiment, the for-second-surface first drive signal wire 3212 is provided with two second buried wires 37 and the second connection wire 38 that continuously covers the two second buried wires 37, for each of the rows of the activated portions of the piezoelectric actuator 150.

In addition, the for-first-surface first drive signal wire 3211 and the for-second-surface first drive signal wire 3212 are connected to each other via the drive signal through-wires 325, which are relay wires provided to penetrate the first surface 301 and the second surface 302 of the wiring board 30. The drive signal through-wire 325 is formed in a second through-hole 305 that is provided to be open in the bottom surface of the first groove 304 in which the for-first-surface first drive signal wire 3211 is formed and to be open in the bottom surface of the second groove 306 in which the for-second-surface first drive signal wire 3212 is formed. Accordingly, the drive signal through-wires 325, the for-first-surface first drive signal wire 3211, and the for-second-surface first drive signal wire 3212 are electrically connected to each other. Note that, as with the individual through-wire 315 in Embodiment 1 described above, the drive signal through-wire 325 can formed of metal such as copper (Cu) and can be formed via electroplating, electroless plating, or the like. In addition, when the first buried wire 35 and the drive signal through-wire 325 are formed at the same time, the first buried wire 35 and the drive signal through-wire 325 can be integrally formed with each other. As illustrated in FIG. 18, the drive signal through-wire 325 is provided for each of the opposite end portion sides of the wiring board 30 in the first direction X. Specifically, in the present embodiment, at least one drive signal through-wire 325 is provided at each of opposite positions outward of the rows of the activated portions of the piezoelectric actuator 150 in the first direction X, that is, at least two drive signal through-wires 325 are provided in total. Incidentally, although not illustrated in FIG. 18, the rows of the activated portions of the piezoelectric actuator 150 are disposed in an area that overlaps with the drive circuit 120 in the first direction X, as seen in a plan view from the third direction Z. Therefore, since the drive signal through-wires 325 are provided on the opposite positions outward of the drive circuit 120 in the first direction X, that is, since the drive signal through-wires 325 are provided at positions that do not overlap with the drive circuit 120 as seen in the plan view from the third direction Z, the drive signal through-wires 325 are provided outward of the activated portions. Accordingly, the for-first-surface first drive signal wire 3211 and the for-second-surface first drive signal wire 3212 can be electrically connected to each other at opposite end portions of the wiring board 30 in the first direction X.

In addition, in the present embodiment, the external wire 130 is connected to the for-first-surface first drive signal wire 3211 at a position close to an end portion which is outward of the drive signal through-wire 325 in the first direction X. That is, the external wire 130 is connected to one end portion of the for-first-surface first drive signal wire 3211 in the first direction X and the drive signal through-wire 325, which is the relay wire, is provided between the rows of the activated portions of the piezoelectric actuator 150 and a portion to which the external wire 130 is connected. Accordingly, it is possible to branch before the drive signal is supplied to the drive circuit 120 from the external wire 130.

It is a matter of course that the number and positions of the drive signal through-wires 325, which are the relay wires, are not limited to those described above. For example, the drive signal through-wires 325 may be disposed to overlap with the rows of the activated portions of the piezoelectric actuator 150 in the first direction X as seen in the plan view from the third direction Z and three or more drive signal through-wires 325 may be provided.

In addition, in the present embodiment, the first buried wire 35 and the second buried wire 37 of the first drive signal wire 321 are disposed to at least partially overlap with each other as seen in the plan view from the third direction Z, which is a normal direction of the first surface 301. Since the first buried wire 35 and the second buried wire 37 of the first drive signal wire 321 are disposed to at least partially overlap with each other as seen in the plan view from the third direction Z as described above, the for-first-surface first drive signal wire 3211 and the for-second-surface first drive signal wire 3212 can be easily connected to each other via the drive signal through-wires 325 that are the relay wires. That is, it is possible to form the drive signal through-wires 325 and the second through-holes 305, in which the drive signal through-wires 325 are provided, in a linear direction along the third direction Z with ease and at a high density. In addition, it is possible to decrease the electrical resistivity of the drive signal through-wire 325 by shortening the drive signal through-wire 325 in the third direction Z as much as possible.

As described above, the first drive signal wire 321 in the present embodiment is provided with the for-first-surface first drive signal wire 3211 provided on the first surface 301 and the for-second-surface first drive signal wire 3212 provided on the second surface 302. Therefore, it is possible to decrease the size of the wiring board 30 in an in-plane direction of the first surface 301 with the size of a space for forming the first drive signal wire 321 on the first surface 301 being decreased in comparison with a case where the first drive signal wire 321 is provided only on the first surface 301 and thus it is possible to achieve a decrease in size of the recording head 1.

In addition, the first surface 301 of the wiring board 30 is provided with the second drive signal wires 322 that supply the second drive signal COM2 to the drive circuit 120 from the external wire 130. As with Embodiment 1 described above, the second drive signal wire 322 is provided with one first buried wire 35 and the first connection wire 36 that covers the first buried wire 35, for each of the rows of the activated portions of the piezoelectric actuator 150.

Therefore, in the wiring board 30, for each of the rows of the activated portions of the piezoelectric actuator 150, the first drive signal wire 321 is provided with three buried wires, which are the first buried wire 35 and the second buried wires 37, in total and the second drive signal wire 322 is provided with one buried wire, which is the first buried wire 35, in total.

That is, in the present embodiment, the first drive signal wire 321 and the second drive signal wire 322 are different from each other in number of the buried wires. In the present embodiment, the total number of the first buried wires 35 and the second buried wires 37 of the first drive signal wire 321 is larger than the number of the first buried wires 35 of the second drive signal wire 322. Since the number of the first buried wires 35 and the second buried wires 37 of the first drive signal wire 321 is larger than the number of the first buried wires 35 of the second drive signal wire 322 as described above, the electrical resistivity of the first drive signal wire 321 can be decreased. Therefore, a voltage drop of the first drive signal COM1, which is supplied to the drive circuit 120 by the first drive signal wire 321, can be suppressed. Particularly, a variation in voltage fluctuation of the first drive signal COM1 attributable to the load fluctuation is suppressed such that the activated portions of the piezoelectric actuator 150 can be stably driven and a variation in ink droplet discharging characteristics is suppressed such that an improvement in printing quality can be achieved.

In addition, the number of the first buried wires 35 of the second drive signal wire 322 is smaller than the number of the first buried wires 35 and the second buried wires 37 of the first drive signal wire 321. Therefore, it is possible to achieve a decrease in size of the wiring board 30 without meaninglessly increasing the number of the first buried wires 35 of the second drive signal wire 322.

Note that, in the present embodiment, the number of the first buried wires 35 and the second buried wires 37 of the first drive signal wire 321 and the number of the first buried wires 35 of the second drive signal wire 322 are compared with each other. However, as with Embodiment 1 described above, the above-described comparison is substantially comparison between the first buried wire 35 and the second buried wires 37 of the first drive signal wire 321 and the first buried wire 35 of the second drive signal wire 322 in electrical resistivity. Therefore, it is sufficient that the comparison between the number of the first buried wires 35 and the second buried wires 37 of the first drive signal wire 321 and the number of the first buried wires 35 of the second drive signal wire 322 be performed in a case where the first buried wire 35 and the second buried wires 37 of the first drive signal wire 321 and the first buried wire 35 of the second drive signal wire 322 are approximately equal to each other in cross-sectional area. However, since there may be a case where the first buried wire 35 and the second buried wires 37 of the first drive signal wire 321 and the first buried wire 35 of the second drive signal wire 322 are different from each other in length or sectional area due to a difference in routing method, it is sufficient that the electrical resistivity of the first buried wire 35 and the second buried wires 37 of the first drive signal wire 321 and the electrical resistivity of the first buried wire 35 of the second drive signal wire 322 be compared with each other. That is, it is sufficient that the total electrical resistivity of the first buried wire 35 and the second buried wires 37 of the first drive signal wire 321 be higher than the total electrical resistivity of the first buried wire of the second drive signal wire 322 as a result of comparison between the total electrical resistivity of the first buried wire 35 and the second buried wires 37 of the first drive signal wire 321 and the total electrical resistivity of the first buried wire 35 of the second drive signal wire 322. Therefore, even when the first buried wire 35 and the second buried wires 37 of the first drive signal wire 321 and the first buried wire 35 of the second drive signal wire 322 are different from each other in cross sectional area or length, when the electrical resistivities thereof satisfy the above-described relationship, a displacement variation of the piezoelectric actuator 150 attributable to a variation in voltage fluctuation can be suppressed with a voltage drop in the first drive signal wire 321 being suppressed. However, the cross-sectional areas of the plurality of first buried wires 35 are preferably approximately equal to each other. That is, the plurality of first grooves 304 in which the first buried wires 35 are formed are preferably formed to have the same sectional area. Such a configuration is adopted in order to suppress the shape of a mask pattern at the time of etching for forming the first groove 304 or the second groove 306 being complicated and to improve the etching accuracy or the stability in coverage of the first buried wire 35 or the second buried wire 37. In addition, the first buried wire 35 and the second buried wire 37, which are respectively provided on different surfaces of the wiring board 30, are preferably formed to have the approximately same cross-sectional area. In this case, warping of the wiring board 30, which occurs due to a difference between the first surface 301 and the second surface 302 in area ratio of buried material when material having a linear expansion coefficient and an in-plane stress different from those of the wiring board 30 is buried in the first groove 304 and the second groove 306, can be suppressed.

In addition, the first drive signal wires 321 and the second drive signal wires 322 are provided with the first connection wires 36 and the second connection wires 38 in addition to the first buried wires 35 and the second buried wires 37. Therefore, it is sufficient that the first drive signal wire 321 and the second drive signal wire 322 be compared with each other in electrical resistivity from a portion to which the external wire 130 is connected to a portion connected to each terminal of the drive circuit 120. That is, it is sufficient that the electrical resistivity from a portion of the first drive signal wire 321 connected to the external wire 130 to a portion of the first drive signal wire 321 connected to a terminal of the drive circuit 120 (in the present embodiment, bump electrode 121 connected to terminal) be larger than the electrical resistivity from a portion of the second drive signal wire 322 connected to the external wire 130 to a portion of the second drive signal wire 322 connected to a terminal of the drive circuit 120 (in the present embodiment, bump electrode 121 connected to terminal). Incidentally, although the first drive signal wire 321 and the second drive signal wire 322 are connected to the drive circuit 120 via a plurality of terminals, it is sufficient that the above-described comparison be performed with respect to a portion with the highest electrical resistivity.

In addition, the second surface 302 of the wiring board 30 is provided with second bias wires 342. The second bias wire 342 is provided with four second buried wires 37 for each of the rows of the activated portions of the piezoelectric actuator 150 and the second connection wire 38 that continuously covers the four second buried wires 37.

That is, in the present embodiment, the first surface 301 of the wiring board 30 is provided with six first buried wires 35 for each of the rows of the activated portions of the piezoelectric actuator 150 and the second surface 302 is provided with six second buried wires 37 for each of the rows of the activated portions of the piezoelectric actuator 150.

That is, in the present embodiment, the number of the first buried wires 35 which are buried wires provided on the first surface 301 of the wiring board 30 and the number of the second buried wires 37 which are buried wires provided on the second surface 302 are the same as each other. Since the first surface 301 and the second surface 302 are provided with the same number of buried wires as described above, warping of the wiring board 30, which occurs due to a difference between the first surface 301 and the second surface 302 in area ratio of buried material when material having a linear expansion coefficient and an in-plane stress different from those of the wiring board 30 is buried in the first groove 304 and the second groove 306 of the wiring board 30, can be suppressed. Therefore, a damage such as a crack attributable to the warping of the wiring board 30, the wiring board 30 and the flow path forming board 10 being separated from each other, wire disconnection, or the like can be suppressed. Note that, in the present embodiment, the number of the first grooves 304 that are provided on the first surface 301 for each of the rows of the activated portions of the piezoelectric actuator 150 is larger than the number of the second grooves 306 by four because of four first grooves 304 for the first bias wire 341. However, the four first grooves 304 for the first bias wire 341 are short in the first direction X, and thus the influence on the warping of the wiring board 30 is small. That is, when the number of the first buried wires 35 and the number of the second buried wires 37 are the same, the warping of the wiring board 30 can be suppressed, each of the first buried wires 35 and the second buried wires 37 being provided to be approximately parallel to the first direction X.

That is, in the present embodiment, the number of the second buried wires 37 of the bias wire 34 is equal to or larger than any one of the sum of the number of the first buried wires 35 of the first drive signal wire 321 and the number of the second buried wires 37 of the first drive signal wire 321 and the number of the first buried wires 35 of the second drive signal wire 322. Accordingly, the electrical resistivity of the bias wire 34 can be decreased. Therefore, in a case where a piezoelectric layer having a characteristic in which a relationship between voltage and electric-field-induced strain (displacement) is represented by a butterfly curve is used as the piezoelectric layer 70 of the piezoelectric actuator 150, the electrical resistivity of the bias wire 34 on the ground side in which a variation in displacement characteristic with respect to a variation in voltage is large is reliably decreased, a voltage drop of the bias wire 34 is suppressed, and a variation in displacement characteristics of the piezoelectric actuator 150 can be further suppressed.

Embodiment 3

Figure 19:
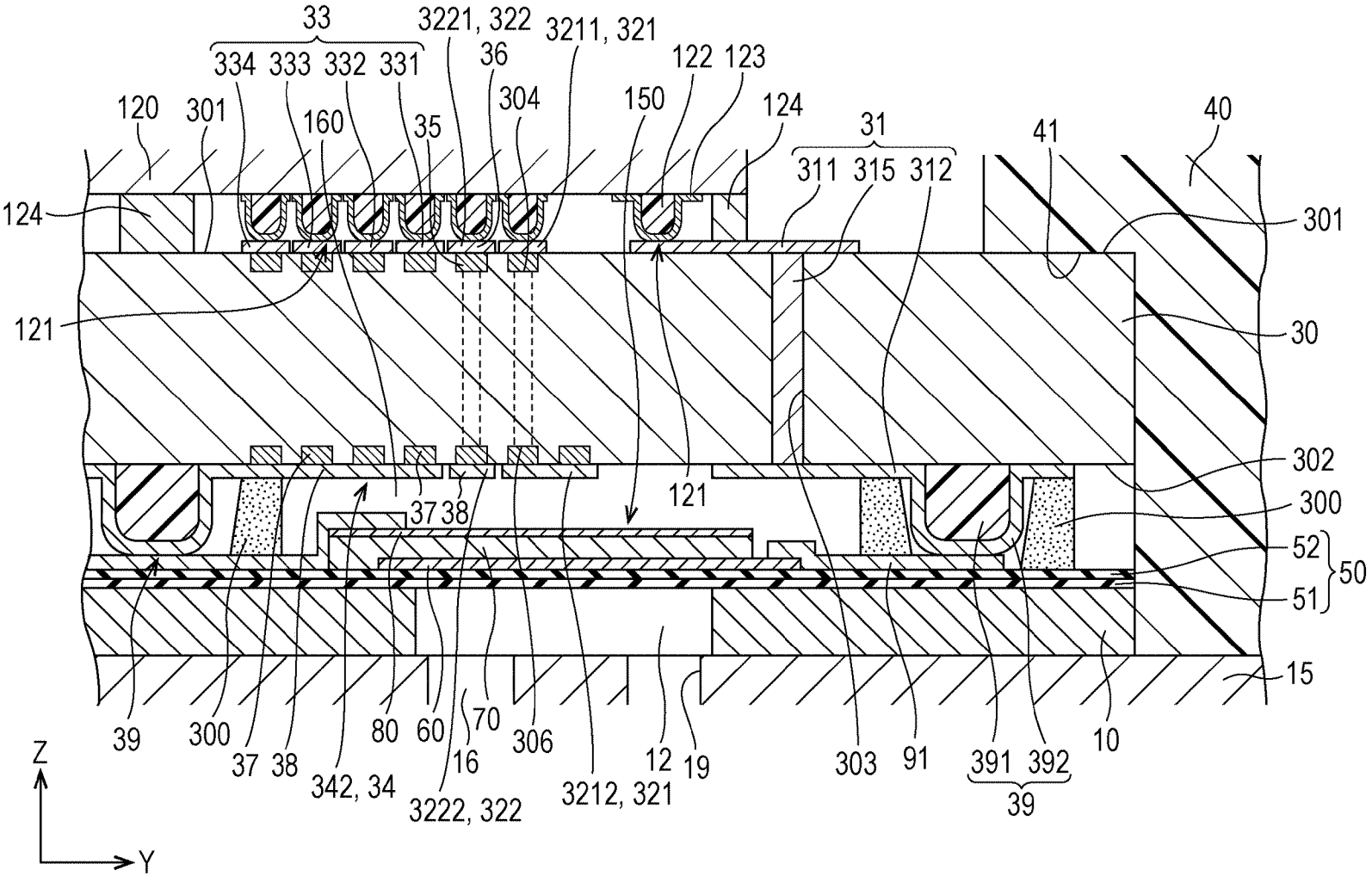
FIG. 19 is a sectional view illustrating a main portion of a wiring board according to Embodiment 3.

FIG. 19 is a sectional view illustrating a main portion of a wiring board according to Embodiment 3 of the invention. Note that, the same members as in the above-described embodiments will be given the same reference numerals and repetitive description thereof will be omitted.

As illustrated in FIG. 19, the first drive signal wire 321 in the present embodiment is provided with the for-first-surface first drive signal wire 3211 provided on the first surface 301 and the for-second-surface first drive signal wire 3212 provided on the second surface 302.

The for-first-surface first drive signal wire 3211 is provided with one first buried wire 35 and the first connection wire 36 that covers the first buried wire 35, for each of the rows of the activated portions of the piezoelectric actuator 150.

The for-second-surface first drive signal wire 3212 is provided with the second buried wires 37 that are buried in the second grooves 306 provided on the second surface 302 of the wiring board 30 and the second connection wire 38 that covers the second buried wires 37. In the present embodiment, the for-second-surface first drive signal wire 3212 is provided with two second buried wires 37 and the second connection wire 38 that continuously covers the two second buried wires 37, for each of the rows of the activated portions of the piezoelectric actuator 150.

In addition, as with Embodiment 2, the for-first-surface first drive signal wire 3211 and the for-second-surface first drive signal wire 3212 are connected to each other via the drive signal through-wires 325, which are the relay wires provided to penetrate the first surface 301 and the second surface 302 of the wiring board 30.

As described above, the first drive signal wire 321 in the present embodiment is provided with the for-first-surface first drive signal wire 3211 provided on the first surface 301 and the for-second-surface first drive signal wire 3212 provided on the second surface 302. Therefore, it is possible to decrease the size of the wiring board 30 in an in-plane direction of the first surface 301 with the size of a space for forming the first drive signal wire 321 on the first surface 301 being decreased in comparison with a case where the first drive signal wire 321 is provided only on the first surface 301 and thus it is possible to achieve a decrease in size of the recording head 1.

In addition, the second drive signal wire 322 in the present embodiment is provided with a for-first-surface second drive signal wire 3221 provided on the first surface 301 and a for-second-surface second drive signal wire 3222 provided on the second surface 302.

The for-first-surface second drive signal wire 3221 is provided with one first buried wire 35 and the first connection wire 36 that covers the first buried wire 35 on the first surface 301 of the wiring board 30, for each of the rows of the activated portions of the piezoelectric actuator 150.

The for-second-surface second drive signal wire 3222 is provided with one second buried wire 37 and the second connection wire 38 that covers the second buried wire 37 on the second surface 302 of the wiring board 30, for each of the rows of the activated portions of the piezoelectric actuator 150.

In addition, as with the first drive signal wire 321, the for-first-surface second drive signal wire 3221 and the for-second-surface second drive signal wire 3222 are connected to each other via the drive signal through-wires 325, which are the relay wires provided to penetrate the first surface 301 and the second surface 302 of the wiring board 30. Note that, since the number and positions of the drive signal through-wires 325 of the second drive signal wire 322 are the same as those of the drive signal through-wires 325 of the first drive signal wire 321 described above, repetitive description will be omitted. It is a matter of course that the number and positions of the drive signal through-wires 325 of the second drive signal wire 322 may be different from those of the drive signal through-wires 325 of the first drive signal wire 321.

As described above, the second drive signal wire 322 in the present embodiment is provided with the for-first-surface second drive signal wire 3221 provided on the first surface 301 and the for-second-surface second drive signal wire 3222 provided on the second surface 302. Therefore, it is possible to decrease the size of the wiring board 30 in an in-plane direction of the first surface 301 with the size of a space for forming the second drive signal wire 322 on the first surface 301 being decreased in comparison with a case where the second drive signal wire 322 is provided only on the first surface 301 and thus it is possible to achieve a decrease in size of the recording head 1.

As described above, in the wiring board 30, for each of the rows of the activated portions of the piezoelectric actuator 150, the first drive signal wire 321 is provided with three buried wires, which are the first buried wire 35 and the second buried wires 37, in total and the second drive signal wire 322 is provided with two buried wires, which are the first buried wire 35 and the second buried wire 37, in total.

That is, in the present embodiment, the first drive signal wire 321 and the second drive signal wire 322 are different from each other in number of the buried wires. In the present embodiment, the total number of the first buried wires 35 and the second buried wires 37 of the first drive signal wire 321 is larger than the total number of the first buried wires 35 and the second buried wires 37 of the second drive signal wire 322. Since the number of the first buried wires 35 and the second buried wires 37 of the first drive signal wire 321 is larger than the number of the first buried wires 35 and the second buried wires 37 of the second drive signal wire 322 as described above, the electrical resistivity of the first drive signal wire 321 can be decreased. Therefore, a voltage drop of the first drive signal COM1, which is supplied to the drive circuit 120 by the first drive signal wire 321, can be suppressed. Particularly, a variation in voltage fluctuation of the first drive signal COM1 attributable to the load fluctuation is suppressed such that the activated portions of the piezoelectric actuator 150 can be stably driven and a variation in ink droplet discharging characteristics is suppressed such that an improvement in printing quality can be achieved.

In addition, in the present embodiment, for each of the rows of the activated portions of the piezoelectric actuator 150, the first drive signal wire 321 is provided with three buried wires, which are the first buried wire 35 and the second buried wires 37, in total and the number of the buried wires is larger than that in Embodiments 1 and 2. Therefore, according to the first drive signal wire 321 in the present embodiment, the electrical resistivity is decreased in comparison with the first drive signal wire 321 in Embodiments 1 and 2 and thus a voltage drop can be further suppressed.

In addition, in the present embodiment, for each of the rows of the activated portions of the piezoelectric actuator 150, the second drive signal wire 322 is provided with two buried wires, which are the first buried wire 35 and the second buried wire 37. Therefore, the electrical resistivity of the second drive signal COM2, which is supplied to the drive circuit 120 via the second drive signal wire 322, is decreased in comparison with Embodiments 1 and 2 and thus a voltage drop can be suppressed.

Note that, in the present embodiment, the number of the first buried wires 35 and the second buried wires 37 of the first drive signal wire 321 and the number of the first buried wires 35 and the second buried wires 37 of the second drive signal wire 322 are compared with each other. However, as with Embodiment 1 described above, the above-described comparison is substantially comparison between the first buried wires 35 and the second buried wire 37 of the first drive signal wire 321 and the first buried wire 35 and the second buried wire 37 of the second drive signal wire 322 in electrical resistivity. Therefore, it is sufficient that the electrical resistivity of the first buried wire 35 and the second buried wires 37 of the first drive signal wire 321 and the electrical resistivity of the first buried wire 35 and the second buried wire 37 of the second drive signal wire 322 be compared with each other. In addition, the first drive signal wires 321 and the second drive signal wires 322 are provided with the first connection wires 36 and the second connection wires 38 in addition to the first buried wires 35 and the second buried wires 37. Therefore, to be precise, it is sufficient that the first drive signal wire 321 and the second drive signal wire 322 be compared with each other in electrical resistivity from a portion to which the external wire 130 is connected to a portion connected to each terminal of the drive circuit 120.

Note that, in the present embodiment, on the second surface 302, the for-second-surface first drive signal wire 3212 is disposed close to the outer periphery side of the wiring board 30 in the second direction Y and the for-second-surface second drive signal wire 3222 is disposed close to the center of the wiring board 30. That is, on the second surface 302, the for-second-surface first drive signal wire 3212 which is provided with a larger number of second buried wires 37 is disposed close to the outer periphery side of the wiring board 30 in the second direction Y, which is a direction in which the second buried wires 37 are arranged in parallel, and the for-second-surface second drive signal wire 3222 which is provided with a smaller number of second buried wires 37 is disposed close to the center of the wiring board 30 in the second direction Y. In this case, since the number of the second buried wires 37 close to the outer periphery side of the second surface 302, on which a relatively large available space is provided, can be increased, it is possible to achieve a decrease in size of the wiring board 30 and it is easy to perform electrical connection between the plurality of second buried wires 37 or wiring.

In addition, with respect to a position which overlaps with the power supply wires 33 as seen in the plan view from the third direction Z, which is the normal direction of the first surface 301, the for-second-surface first drive signal wire 3212 and the for-second-surface second drive signal wire 3222 on the second surface 302 are disposed on the same one side as the positions of the for-first-surface first drive signal wire 3211 and the for-first-surface second drive signal wire 3221 with respect to the power supply wires 33 in the second direction Y. Therefore, the for-first-surface first drive signal wire 3211 and the for-second-surface first drive signal wire 3212 can be easily connected to each other and the for-first-surface second drive signal wire 3221 and the for-second-surface second drive signal wire 3222 can be easily connected to each other. Incidentally, when the positions of the first drive signal wire 321 and the second drive signal wire 322 with respect to the power supply wires 33 are disposed in different directions from each other on the first surface 301 and the second surface 302, the first drive signal wire 321 and the second drive signal wire 322 need to be routed over the power supply wires 33, a space for routing the first drive signal wire 321 and the second drive signal wire 322 becomes necessary, and thus the size of the wiring board 30 is increased. In the present embodiment, since the first drive signal wire 321 and the second drive signal wire 322 are disposed on the same one side of the wiring board 30 with respect to the power supply wires 33, the size of a space for routing the first drive signal wire 321 and the second drive signal wire 322 can be decreased and the size of the wiring board 30 can be decreased in an in-plane direction of the first surface 301.

In addition, in the present embodiment, the first buried wire 35 and the second buried wire 37 of the first drive signal wire 321 are disposed to at least partially overlap with each other as seen in the plan view from the third direction Z, which is the normal direction of the first surface 301. Since the first buried wire 35 and the second buried wire 37 of the first drive signal wire 321 are disposed to at least partially overlap with each other as seen in the plan view from the third direction Z as described above, the for-first-surface first drive signal wire 3211 and the for-second-surface first drive signal wire 3212 can be easily connected to each other via the drive signal through-wires 325 that are the relay wires. That is, it is possible to form the drive signal through-wires 325 and the second through-holes 305, in which the drive signal through-wires 325 are provided, in a linear direction along the third direction Z with ease and at a high density. In addition, it is possible to decrease the electrical resistivity of the drive signal through-wire 325 by shortening the drive signal through-wire 325 in the third direction Z as much as possible. Note that, the same applies to the first buried wire 35 and the second buried wire 37 of the second drive signal wire 322.

In addition, the second surface 302 of the wiring board 30 is provided with second bias wires 342. The second bias wire 342 is provided with four second buried wires 37 for each of the rows of the activated portions of the piezoelectric actuator 150 and the second connection wire 38 that continuously covers the four second buried wires 37.

That is, in the present embodiment, the first surface 301 of the wiring board 30 is provided with six first buried wires 35 for each of the rows of the activated portions of the piezoelectric actuator 150 and the second surface 302 is provided with seven second buried wires 37 for each of the rows of the activated portions of the piezoelectric actuator 150.

Since the number of the second buried wires 37 provided on the second surface 302 is larger than the number of the first buried wires 35 provided on the first surface 301, an increase in size of the wiring board 30 can be suppressed. That is, regarding the wiring board 30, since the power supply wires 33 and the like are formed on the first surface 301, the second surface 302 has a larger available space than the first surface 301. Therefore, it is possible to suppress an increase in size of the wiring board 30 and to achieve a decrease in size of the wiring board 30 by increasing the number of the second buried wires 37 on the second surface 302 on which a relatively large available space is provided.

In addition, in the present embodiment, the number of the second buried wires 37 of the bias wire 34 is equal to or larger than any one of the sum of the number of the first buried wires 35 of the first drive signal wire 321 and the number of the second buried wires 37 of the first drive signal wire 321 and the sum of the number of first buried wires 35 of the second drive signal wire 322 and the number of the second buried wires 37 of the second drive signal wire 322. Accordingly, the electrical resistivity of the bias wire 34 can be decreased. Therefore, in a case where a piezoelectric layer having a characteristic in which a relationship between voltage and electric-field-induced strain (displacement) is represented by a butterfly curve is used as the piezoelectric layer 70 of the piezoelectric actuator 150, the electrical resistivity of the bias wire 34 on the ground side in which a variation in displacement characteristic with respect to a variation in voltage is large is reliably decreased, a voltage drop of the bias wire 34 is suppressed, and a variation in displacement characteristics of the piezoelectric actuator 150 can be further suppressed.

Note that, in the present embodiment, on the second surface 302 of the wiring board 30, the second bias wire 342, the for-second-surface second drive signal wire 3222, and the for-second-surface first drive signal wire 3212 are arranged in this order in the second direction Y. However, the invention is not limited to this. Here, a modification example of the wires in the present embodiment is illustrated in FIG. 20.

Figure 20:
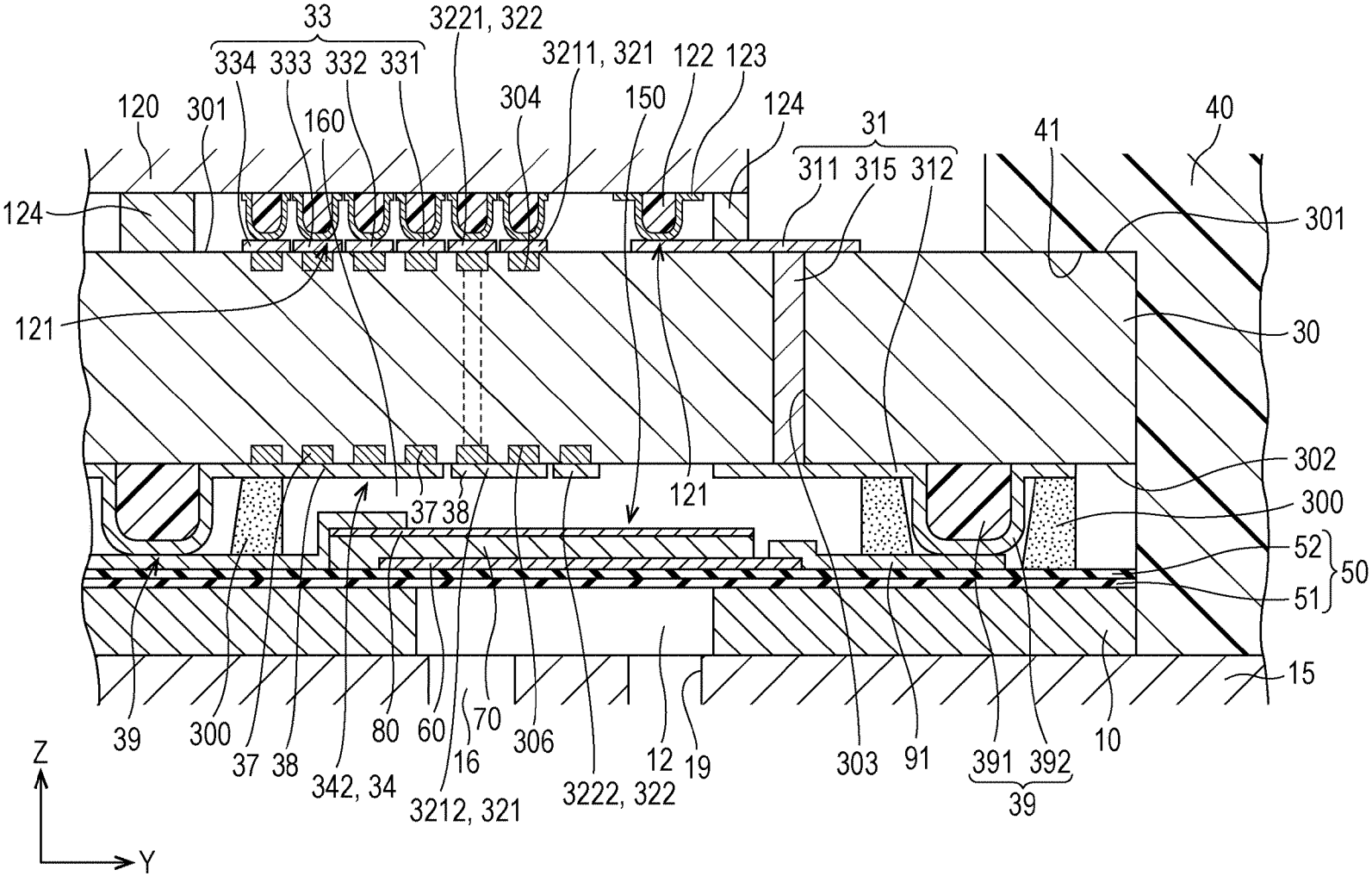
FIG. 20 is a sectional view illustrating a modification example of the wiring board according to Embodiment 3.

As illustrated in FIG. 20, on the second surface 302 of the wiring board 30, the second bias wire 342, the for-second-surface first drive signal wire 3212, and the for-second-surface second drive signal wire 3222 are arranged in this order in the second direction Y. That is, on the second surface 302, the for-second-surface first drive signal wire 3212 having a large number of second buried wires 37 and the second bias wire 342 are disposed to face each other. An induced electromotive current can be reduced with the second bias wire 342, in which a relatively large electric current flows, and the for-second-surface first drive signal wire 3212 being disposed to face each other. Therefore, distortion of a voltage waveform flowing through the first drive signal wire 321, so-called overshoot or undershoot can be suppressed.

Embodiment 4

Figure 21:
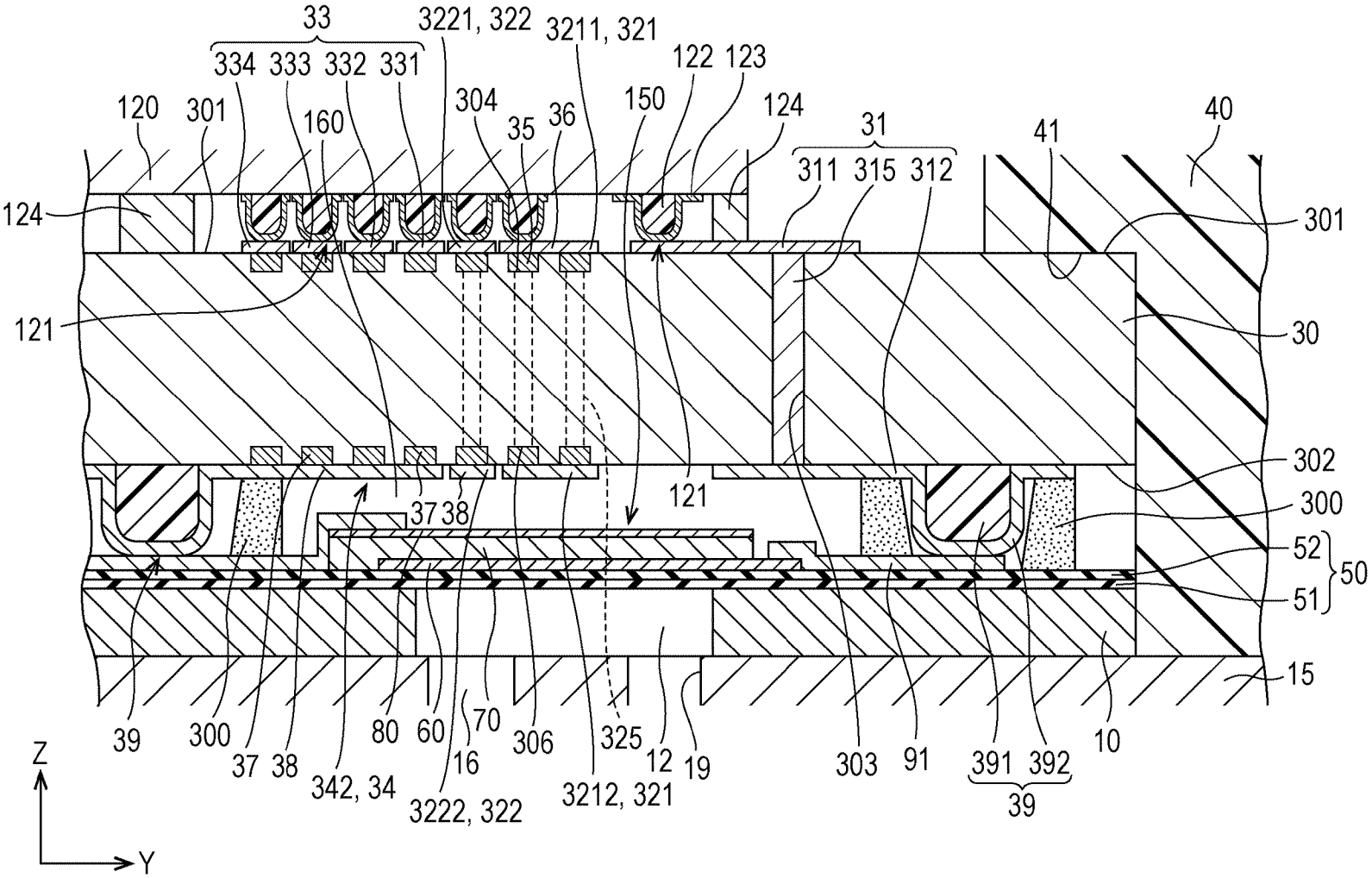
FIG. 21 is a sectional view illustrating a main portion of a wiring board according to Embodiment 4.

FIG. 21 is a sectional view illustrating a main portion of a wiring board according to Embodiment 4 of the invention. Note that, the same members as in the above-described embodiments will be given the same reference numerals and repetitive description thereof will be omitted.

As illustrated in FIG. 21, the first drive signal wire 321 in Embodiment 4 is provided with the for-first-surface first drive signal wire 3211 provided on the first surface 301 and the for-second-surface first drive signal wire 3212 provided on the second surface 302.

The for-first-surface first drive signal wire 3211 is provided with the first buried wires 35 that are buried in the first grooves 304 provided on the first surface 301 of the wiring board 30 and the first connection wire 36 that covers the first buried wires 35. In the present embodiment, the for-first-surface first drive signal wire 3211 is provided with two first buried wires 35 and the first connection wire 36 that continuously covers the two first buried wires 35, for each of the rows of the activated portions of the piezoelectric actuator 150.

The for-second-surface first drive signal wire 3212 is provided with the second buried wires 37 that are buried in the second grooves 306 provided on the second surface 302 of the wiring board 30 and the second connection wire 38 that covers the second buried wires 37. In the present embodiment, the for-second-surface first drive signal wire 3212 is provided with two second buried wires 37 and the second connection wire 38 that continuously covers the two second buried wires 37, for each of the rows of the activated portions of the piezoelectric actuator 150.

In addition, as with Embodiments 2 and 3, the for-first-surface first drive signal wire 3211 and the for-second-surface first drive signal wire 3212 are connected to each other via the drive signal through-wires 325, which are the relay wires provided to penetrate the first surface 301 and the second surface 302 of the wiring board 30.

As described above, the first drive signal wire 321 in the present embodiment is provided with the for-first-surface first drive signal wire 3211 provided on the first surface 301 and the for-second-surface first drive signal wire 3212 provided on the second surface 302. Therefore, it is possible to decrease the size of the wiring board 30 in an in-plane direction of the first surface 301 with the size of a space for forming the first drive signal wire 321 on the first surface 301 being decreased in comparison with a case where the first drive signal wire 321 is provided only on the first surface 301 and thus it is possible to achieve a decrease in size of the recording head 1.

In addition, the second drive signal wire 322 in the present embodiment is provided with the for-first-surface second drive signal wire 3221 provided on the first surface 301 and the for-second-surface second drive signal wire 3222 provided on the second surface 302.

The for-first-surface second drive signal wire 3221 is provided with one first buried wire 35 and the first connection wire 36 that covers the first buried wire 35 on the first surface 301 of the wiring board 30, for each of the rows of the activated portions of the piezoelectric actuator 150.

The for-second-surface second drive signal wire 3222 is provided with one second buried wire 37 and the second connection wire 38 that covers the second buried wire 37 on the second surface 302 of the wiring board 30, for each of the rows of the activated portions of the piezoelectric actuator 150.

In addition, as with the first drive signal wire 321, the for-first-surface second drive signal wire 3221 and the for-second-surface second drive signal wire 3222 are connected to each other via the drive signal through-wires 325, which are the relay wires provided to penetrate the first surface 301 and the second surface 302 of the wiring board 30. Note that, since the number and positions of the drive signal through-wires 325 of the second drive signal wire 322 are the same as those of the drive signal through-wires 325 of the first drive signal wire 321 described above, repetitive description will be omitted. It is a matter of course that the number and positions of the drive signal through-wires 325 of the second drive signal wire 322 may be different from those of the drive signal through-wires 325 of the first drive signal wire 321.

As described above, the second drive signal wire 322 in the present embodiment is provided with the for-first-surface second drive signal wire 3221 provided on the first surface 301 and the for-second-surface second drive signal wire 3222 provided on the second surface 302. Therefore, it is possible to decrease the size of the wiring board 30 in an in-plane direction of the first surface 301 with the size of a space for forming the second drive signal wire 322 on the first surface 301 being decreased in comparison with a case where the second drive signal wire 322 is provided only on the first surface 301 and thus it is possible to achieve a decrease in size of the recording head 1.

As described above, in the wiring board 30, for each of the rows of the activated portions of the piezoelectric actuator 150, the first drive signal wire 321 is provided with four buried wires, which are the first buried wires 35 and the second buried wires 37, in total and the second drive signal wire 322 is provided with two buried wires, which are the first buried wire 35 and the second buried wire 37, in total.

That is, in the present embodiment, the first drive signal wire 321 and the second drive signal wire 322 are different from each other in the number of the buried wires. In the present embodiment, the total number of the first buried wires 35 and the second buried wires 37 of the first drive signal wire 321 is larger than the total number of the first buried wires 35 and the second buried wires 37 of the second drive signal wire 322. Since the number of the first buried wires 35 and the second buried wires 37 of the first drive signal wire 321 is larger than the number of the first buried wires 35 and the second buried wires 37 of the second drive signal wire 322 as described above, the electrical resistivity of the first drive signal wire 321 can be decreased. Therefore, a voltage drop of the first drive signal COM1, which is supplied to the drive circuit 120 by the first drive signal wire 321, can be suppressed. Particularly, a variation in voltage fluctuation of the first drive signal COM1 attributable to the load fluctuation is suppressed such that the activated portions of the piezoelectric actuator 150 can be stably driven and a variation in ink droplet discharging characteristics is suppressed such that an improvement in printing quality can be achieved.

In addition, in the present embodiment, for each of the rows of the activated portions of the piezoelectric actuator 150, the first drive signal wire 321 is provided with four buried wires, which are the first buried wires 35 and the second buried wires 37, in total and the number of the buried wires is larger than that in Embodiments 1 to 3. Therefore, according to the first drive signal wire 321 in the present embodiment, the electrical resistivity is decreased in comparison with the first drive signal wire 321 in Embodiments 1 to 3 and thus a voltage drop can be further suppressed.

In addition, in the present embodiment, for each of the rows of the activated portions of the piezoelectric actuator 150, the second drive signal wire 322 is provided with two buried wires, which are the first buried wire 35 and the second buried wire 37. Therefore, the electrical resistivity of the second drive signal COM2, which is supplied to the drive circuit 120 via the second drive signal wire 322, is decreased in comparison with Embodiments 1 and 2 and thus a voltage drop can be suppressed.

Note that, in the present embodiment, the number of the first buried wires 35 and the second buried wires 37 of the first drive signal wire 321 and the number of the first buried wires 35 and the second buried wires 37 of the second drive signal wire 322 are compared with each other. However, as with Embodiment 1 described above, the above-described comparison is substantially comparison between the first buried wires 35 and the second buried wires 37 of the first drive signal wire 321 and the first buried wire 35 and the second buried wire 37 of the second drive signal wire 322 in electrical resistivity. Therefore, it is sufficient that the electrical resistivity of the first buried wires 35 and the second buried wires 37 of the first drive signal wire 321 and the electrical resistivity of the first buried wire 35 and the second buried wire 37 of the second drive signal wire 322 be compared with each other. In addition, the first drive signal wires 321 and the second drive signal wires 322 are provided with the first connection wires 36 and the second connection wires 38 in addition to the first buried wires 35 and the second buried wires 37. Therefore, to be precise, it is sufficient that the first drive signal wire 321 and the second drive signal wire 322 be compared with each other in electrical resistivity from a portion to which the external wire 130 is connected to a portion connected to each terminal of the drive circuit 120.

In addition, the second surface 302 of the wiring board 30 is provided with second bias wires 342. The second bias wire 342 is provided with four second buried wires 37 for each of the rows of the activated portions of the piezoelectric actuator 150 and the second connection wire 38 that continuously covers the four second buried wires 37.

That is, in the present embodiment, the first surface 301 of the wiring board 30 is provided with eight first buried wires 35 for each of the rows of the activated portions of the piezoelectric actuator 150 and the second surface 302 is provided with eight second buried wires 37 for each of the rows of the activated portions of the piezoelectric actuator 150.

That is, in the present embodiment, the number of the first buried wires 35 which are buried wires provided on the first surface 301 of the wiring board 30 and the number of the second buried wires 37 which are buried wires provided on the second surface 302 are the same as each other. Since the first surface 301 and the second surface 302 are provided with the same number of buried wires as described above, warping of the wiring board 30, which occurs due to a difference between the first surface 301 and the second surface 302 in area ratio of buried material when material having a linear expansion coefficient and an in-plane stress different from those of the wiring board 30 is buried in the first groove 304 and the second groove 306 of the wiring board 30, can be suppressed. Therefore, a damage such as a crack attributable to the warping of the wiring board 30, the wiring board 30 and the flow path forming board 10 being separated from each other, wire disconnection, or the like can be suppressed. Note that, in the present embodiment, the number of the first grooves 304 that are provided on the first surface 301 for each of the rows of the activated portions of the piezoelectric actuator 150 is larger than the number of the second grooves 306 by four because of four first grooves 304 for the first bias wire 341. However, the four first grooves 304 for the first bias wire 341 are short in the first direction X, and thus the influence on the warping of the wiring board 30 is small. That is, when the number of the first buried wires 35 and the number of the second buried wires 37 are the same, the warping of the wiring board 30 can be suppressed, each of the first buried wires 35 and the second buried wires 37 being provided to be approximately parallel to the first direction X.

In addition, in the present embodiment, the number of the second buried wires 37 of the bias wire 34 is equal to or larger than any one of the sum of the number of the first buried wires 35 of the first drive signal wire 321 and the number of the second buried wires 37 of the first drive signal wire 321 and the number of first buried wires 35 of the second drive signal wire 322. Accordingly, the electrical resistivity of the bias wire 34 can be decreased. Therefore, in a case where a piezoelectric layer having a characteristic in which a relationship between voltage and electric-field-induced strain (displacement) is represented by a butterfly curve is used as the piezoelectric layer 70 of the piezoelectric actuator 150, the electrical resistivity of the bias wire 34 on the ground side in which a variation in displacement characteristic with respect to a variation in voltage is large is reliably suppressed, a voltage drop of the bias wire 34 is suppressed, and a variation in displacement characteristics of the piezoelectric actuator 150 can be further suppressed.

Here, FIG. 22 shows a relationship between the buried wires of each wire in Embodiments 1 to 4 described above. Note that, FIG. 22 is a table showing a relationship between the buried wires in Embodiments 1 to 4. Note that, the buried wires in the table in FIG. 22 collectively refer to the first buried wires 35 provided on the first surface 301 and the second buried wires 37 provided on the second surface 302. In addition, in the table in FIG. 22, the number of the buried wires for each of the rows of the activated portions of the piezoelectric actuator 150 is shown. Furthermore, in FIG. 22, a configuration, in which one first buried wire 35 of the first drive signal wire 321 is provided on the first surface 301 of the wiring board 30, one first buried wire 35 of the second drive signal wire 322 is provided on the first surface 301, and six second buried wires 37 of the bias wire 34 are provided on the second surface 302, is given as a comparative example.

In Embodiment 1, the number of the buried wires on the first surface 301 is seven and the number of the buried wires on the second surface 302 is six. In addition, the number of the buried wires of the first drive signal wire 321 on the first surface 301 is two and the number of the buried wires of the first drive signal wire 321 on the second surface 302 is zero. In addition, the number of the buried wires of the second drive signal wire 322 on the first surface 301 is one and the number of the buried wires of the second drive signal wire 322 on the second surface 302 is zero. In addition, the number of the buried wires of the bias wire 34 on the second surface 302 is six. That is, the number of the buried wires of the first drive signal wire 321 is larger than the number of the buried wires of the second drive signal wire 322 by one. Therefore, even when an electric current that flows through the first drive signal wire 321 within one recording cycle T is large, a voltage drop of the first drive signal COM1, which is supplied via the first drive signal wire 321, can be suppressed. However, in Embodiment 1, the number of the buried wires provided on the first surface 301 and the number of the buried wires provided on the second surface 302 are different from each other and the number of the buried wires on the first surface 301 is larger than the number of the buried wires on the second surface 302. Therefore, there is a high risk of crack due to warping since the first surface 301 and the second surface 302 are different from each other in area ratio. That is, warping of the wiring board 30 occurs due to a difference between the first surface 301 and the second surface 302 in area ratio of buried material when material having a linear expansion coefficient and an in-plane stress different from those of the wiring board 30 is buried in the first groove 304 and the second groove 306 of the wiring board 30. In addition, when the wiring board 30 is warped, there is a possibility of a damage such as a crack of the wiring board 30, the wiring board 30 and the flow path forming board 10 being separated from each other, wire disconnection, or the like. In addition, in Embodiment 1, the number of the buried wires on the first surface 301 is large in comparison with the comparative example and thus an additional space is needed in comparison with Comparative Example 1.

Note that, in Embodiment 1, a magnitude relationship between the numbers of the buried wires is (buried wires of bias wire 34)>(buried wires of first drive signal wire 321)>(buried wires of second drive signal wire 322).

In Embodiment 2, the number of the buried wires on the first surface 301 is six and the number of the buried wires on the second surface 302 is six. In addition, the number of the buried wires of the first drive signal wire 321 on the first surface 301 is one and the number of the buried wires of the first drive signal wire 321 on the second surface 302 is two. In addition, the number of the buried wires of the second drive signal wire 322 on the first surface 301 is one and the number of the buried wires of the second drive signal wire 322 on the second surface 302 is zero. In addition, the number of the buried wires of the bias wire 34 on the second surface 302 is four. That is, the number of the buried wires of the first drive signal wire 321 is larger than the number of the buried wires of the second drive signal wire 322 by two. Therefore, even when an electric current that flows through the first drive signal wire 321 within one recording cycle T is large, a voltage drop of the first drive signal COM1, which is supplied via the first drive signal wire 321, can be suppressed.

In addition, since the number of the buried wires provided on the first surface 301 and the number of the buried wires provided on the second surface 302 are the same as each other, the warping can be suppressed with the first surface 301 and the second surface 302 being approximately the same as each other in area ratio of the buried wires and a risk of crack can be lowered. In addition, in Embodiment 2, the number of buried wires on the first surface 301 is smaller than that in Embodiment 1 and the number of buried wires on the first surface 301 is the same as that of the comparative example. Therefore, an additional space is not needed in comparison with the comparison example and thus a decrease in size can be achieved.

Note that, in Embodiment 2, a magnitude relationship between the numbers of the buried wires is (buried wires of bias wire 34)>(buried wires of first drive signal wire 321)>(buried wires of second drive signal wire 322).

In Embodiment 3, the number of the buried wires on the first surface 301 is six and the number of the buried wires on the second surface 302 is six. In addition, the number of the buried wires of the first drive signal wire 321 on the first surface 301 is one and the number of the buried wires of the first drive signal wire 321 on the second surface 302 is two. In addition, the number of the buried wires of the second drive signal wire 322 on the first surface 301 is one and the number of the buried wires of the second drive signal wire 322 on the second surface 302 is one. In addition, the number of the buried wires of the bias wire 34 on the second surface 302 is four. That is, the number of the buried wires of the first drive signal wire 321 is larger than the number of the buried wires of the second drive signal wire 322 by one. Therefore, even when an electric current that flows through the first drive signal wire 321 within one recording cycle T is large, a voltage drop of the first drive signal COM1, which is supplied via the first drive signal wire 321, can be suppressed. However, the number of the buried wires provided on the first surface 301 and the number of the buried wires provided on the second surface 302 are different from each other and the number of the buried wires on the second surface 302 is larger than the number of the buried wires on the first surface 301. Therefore, there is a high risk of crack due to warping since the first surface 301 and the second surface 302 are different from each other in area ratio. In addition, the number of the buried wires on the second surface 302 is large in comparison with the comparative example and thus an additional space is needed in comparison with the comparative example. However, since the number of the buried wires on the second surface 302, on which a relatively large available space is provided, is larger than the number of the buried wires on the first surface 301, a decrease in size can be achieved in comparison with Embodiment 1.

Note that, in Embodiment 3, a magnitude relationship between the numbers of the buried wires is (buried wires of bias wire 34)>(buried wires of first drive signal wire 321)>(buried wires of second drive signal wire 322).

In Embodiment 4, the number of the buried wires on the first surface 301 is seven and the number of the buried wires on the second surface 302 is seven. In addition, the number of the buried wires of the first drive signal wire 321 on the first surface 301 is two and the number of the buried wires of the first drive signal wire 321 on the second surface 302 is two. In addition, the number of the buried wires of the second drive signal wire 322 on the first surface is one and the number of the buried wires of the second drive signal wire 322 on the second surface 302 is one. In addition, the number of the buried wires of the bias wire 34 on the second surface 302 is four. That is, the number of the buried wires of the first drive signal wire 321 is larger than the number of the buried wires of the second drive signal wire 322 by two. Therefore, even when an electric current that flows through the first drive signal wire 321 within one recording cycle T is large, a voltage drop of the first drive signal COM1, which is supplied via the first drive signal wire 321, can be suppressed. In addition, since the number of the buried wires provided on the first surface 301 and the number of the buried wires provided on the second surface 302 are the same as each other, the warping can be suppressed with the first surface 301 and the second surface 302 being approximately the same as each other in area ratio of the buried wires and a risk of crack can be lowered. In addition, the number of the buried wires on the first surface 301 and the second surface 302 is large in comparison with the comparative example and thus an additional space is needed in comparison with Comparative Example 1.

Note that, in Embodiment 4, a magnitude relationship between the numbers of the buried wires is (buried wires of bias wire 34)=(buried wires of first drive signal wire 321)>(buried wires of second drive signal wire 322).

In addition, as described above, Embodiments 1 and 4 are largest in number of the buried wires on the first surface 301 and Embodiments 2 and 3 are smallest in number of the buried wires on the first surface 301. In addition, Embodiments 2 and 3 are largest in number of the buried wires on the second surface 302 and Embodiments 1 and 4 are smallest in number of the buried wires on the second surface 302.

Accordingly, Embodiment 2 is most effective in decreasing the size of the wiring board 30. In addition, since the second surface 302 has a large available space in comparison with the first surface 301, Embodiment 3 is second most effective in decreasing the size and Embodiments 1 and 4 are most ineffective in decreasing the size.

In addition, Embodiments 1 and 4 are largest in number of the buried wires of the first drive signal wire 321 on the first surface 301 and Embodiments 2 and 3 are smallest in number of the buried wires of the first drive signal wire 321 on the first surface 301. In addition, Embodiments 2, 3 and 4 are largest in number of the buried wires of the first drive signal wire 321 on the second surface and Embodiment 1 is smallest in number of the buried wires of the first drive signal wire 321 on the second surface. Furthermore, Embodiment 4 is largest in total number of the buried wires of the first drive signal wire 321 and Embodiment 1 is smallest in total number of the buried wires of the first drive signal wire 321.

Accordingly, in Embodiments 1 to 4, Embodiment 4 is most effective in suppressing a voltage drop of the first drive signal COM1, which is supplied via the first drive signal wire 321, Embodiments 2 and 3 are second most effective in suppressing the voltage drop, and Embodiment 1 is most ineffective suppressing the voltage drop. It is a matter of course that even Embodiment 1 is effective in suppressing the voltage drop of the first drive signal wire 321 in comparison with the comparative example.

In addition, Embodiments 1 to 4 are the same as each other in number of the buried wires of the second drive signal wire 322 on the second surface 302, Embodiments 3 and 4 are largest in number of buried wires of the second drive signal wire 322 on the second surface 302, and Embodiments 1 and 2 are smallest in number of buried wires of the second drive signal wire 322 on the second surface 302. In addition, Embodiments 3 and 4 are largest in total number of the buried wires of the second drive signal wire 322 and Embodiments 1 and 2 are smallest in total number of the buried wires of the second drive signal wire 322.

Therefore, in Embodiment 1 to 4, Embodiments 3 and 4 are most effective in suppressing a voltage drop of the second drive signal COM2, which is supplied via the second drive signal wire 322, and Embodiments 1 and 2 are ineffective suppressing the voltage drop.

In addition, Embodiment 1 is largest in number of the buried wires of the bias wire 34 and Embodiments 2 and 4 are smallest in number of the buried wires of the bias wire 34.

Therefore, in Embodiment 1 to 4, Embodiment 1 is most effective in suppressing a voltage drop of the bias wire 34 and Embodiments 2 to 4 are ineffective suppressing the voltage drop.

Furthermore, Embodiments 2 and 4 are largest in difference between the number of the buried wires of the first drive signal wire 321 and the number of the buried wires of the second drive signal wire 322 and Embodiment 1 and 3 are smallest in difference between the number of the buried wires of the first drive signal wire 321 and the number of the buried wires of the second drive signal wire 322.

In addition, Embodiments 2 and 4 have the lowest risk of crack attributable to warping of the wiring board 30 and Embodiments 1 and 3 have the highest risk of crack attributable to warping of the wiring board 30.

Furthermore, in Embodiment 2, an additional space on the wiring board 30 is not needed in comparison with the comparative example and Embodiments 1, 3, and 4, an additional space is needed.

Other Embodiments

Hereinabove, the embodiments of the invention have been described. However, the basic configuration of the invention is not limited to those described above.

For example, in the embodiments described above, the second bias wire 342 constituting the bias wire 34 is provided on the second surface 302 of the wiring board 30. However, the invention is not particularly limited to this and the second bias wire 342 may be provided only on the first surface 301.

In addition, in the embodiments described above, the power supply wire 33 or the bias wire 34 is provided with the first buried wire 35 and the second buried wire 37. However, the invention is not particularly limited to this and the power supply wire 33 or the bias wire 34 may be configured not to be provided with the buried wires on any one or both of the first surface 301 and the second surface 302.

Furthermore, in the embodiments described above, two drive signal through-wires 325 that relay the first drive signal wire 321 or the second drive signal wire 322 on the first surface 301 and the second surface 302 are provided on both sides of the wiring board 30 in the first direction X. However, the number and positions of the drive signal through-wires 325 are not particularly limited to this. For example, three or more drive signal through-wires 325 may be provided. In addition, the position of the drive signal through-wire 325 is not particularly limited and the drive signal through-wire 325 may be disposed at a position that overlaps with the drive circuit 120 in a plan view as seen from the third direction Z.

In addition, in the embodiments described above, the drive circuit 120 is provided with the bump electrodes 121. However, the invention is not particularly limited to this. For example, the bump electrodes may be provided on the first surface 301 of the wiring board 30. Similarly, the second surface 302 of the wiring board 30 is provided with the bump electrodes 39. However, the invention is not particularly limited to this and the bump electrodes may be provided on the flow path forming board 10 side. In addition, the positions of the bump electrodes 121 and the bump electrodes 39 are not also limited to those in the embodiments described above.

Furthermore, in the embodiments described above, one drive circuit 120 is provided for the two rows of the piezoelectric actuators 150. However, the invention is not particularly limited to this. For example, the drive circuit 120 may be provided for each of the rows of the piezoelectric actuators 150 and a plurality of drive circuits 120 divided into two or more parts in the first direction X may be provided for each of the rows of the piezoelectric actuators 150.

Furthermore, in the embodiments described above, regarding the bump electrode 39 of which the bump wires 392 are connected to the common lead electrode 92, the second connection wires 38 led out from two bump wires 392 are provided such that a portion of a surface of one core portion 391 is covered. However, the invention is not particularly limited to this and for example, the core portion 391 may be provided for each bump wire 392. In addition, the core portion 391 of the bump electrode 39 for the bump wire 392 and the core portion 391 of the bump electrode 39 for the second individual wire 312 may be the same one.

Furthermore, in the embodiments described above, the thin piezoelectric actuator 150 is used as the drive element that causes a change in pressure in the pressure generation chamber 12. However, the invention is not particularly limited to this and for example, a thick piezoelectric actuator that is formed through a method of pasting a green sheet or the like, a longitudinal vibration piezoelectric actuator that is obtained by alternately stacking piezoelectric material and electrode forming material and that expands and contracts in an axial direction, or the like can be used. In addition, as the drive element, a drive element, in which a heat generating element is disposed in the pressure generation chamber such that a liquid droplet is discharged from a nozzle opening by means of bubbles generated due to heat generated by the heat generating element, or a so-called electrostatic actuator, which generates static electricity between a vibration plate and an electrode such that a liquid droplet is discharged from a nozzle opening with the vibration plate being deformed due to an electrostatic force, can be used.

Note that, in the ink jet recording apparatus I described above, the recording head 1 is installed in the carriage 3 and moves in a main scanning direction. However, the invention is not particularly limited to this and for example, the invention can also be applied to a so-called line type recording apparatus, in which the recording head 1 is fixed and printing is performed while only the recording sheet S such as a paper sheet moves in a sub scanning direction.

In addition, in the examples described above, the ink jet recording apparatus I is configured such that the cartridge 2, which is a liquid storage unit, is installed in the carriage 3. However, the invention is not limited to this and for example, the liquid storage unit may be fixed to the apparatus main body 4 and the storage unit and the recording head 1 may be connected to each other via a supply pipe such as a tube. In addition, the liquid storage unit may not be installed in the ink jet recording apparatus.

Furthermore, the invention widely aims at heads and for example, the invention can be applied to a recording head such as various ink jet recording heads that are used for an image recording apparatus such as a printer, a coloring material ejecting head that is used for manufacturing a color filter of a liquid display or the like, an organic EL display, an electrode material ejecting head that is used for forming an electrode of a field emission display (FED), a bioorganic material ejecting head that is used for manufacturing a bio chip, or the like.

What is claimed is:

1. A liquid ejecting head comprising:

a drive element that causes a change in pressure of liquid in a flow path communicating with a nozzle from which the liquid is ejected;

a drive circuit that outputs a signal for driving the drive element; and a wiring board of which a first surface is on the drive circuit side and a second surface is on the drive element side, the first surface being on a side opposite to the drive element, wherein the wiring board is provided with a power supply wire through which power is supplied to the drive circuit, a first drive signal wire through which a first drive signal is supplied to the drive circuit, and a second drive signal wire through which a second drive signal is supplied to the drive circuit and that is not electrically connected to the power supply wire and the first drive signal wire on the wiring board, wherein each of the first drive signal wire and the second drive signal wire is provided with a buried wire that is buried in a groove provided on the wiring board, and wherein the first drive signal wire and the second drive signal wire are different from each other in number of the buried wires.

2. The liquid ejecting head according to claim 1, wherein a plurality of the drive elements are provided, wherein a common electrode that is common to the plurality of drive elements is provided, wherein the wiring board is provided with a bias wire that is connected to the common electrode and through which a bias voltage, which is a reference potential, is supplied to the common electrode, wherein the bias wire is provided with a buried wire that is buried in a groove provided on the wiring board, and wherein the number of the buried wires of the bias wire is equal to or larger than any one of the number of the buried wires of the first drive signal wire and the number of the buried wires of the second drive signal wire.

3. The liquid ejecting head according to claim 1, wherein any one of the first drive signal wire and the second drive signal wire is disposed close to an outer periphery side of the wiring board and the number of the buried wires of the one of the first drive signal wire and the second drive signal wire, which is disposed close to the outer periphery side of the wiring board, is larger than the number of the buried wires of the other one of the first drive signal wire and the second drive signal wire.

4. The liquid ejecting head according to claim 1, wherein the number of the buried wires provided on the first surface and the number of the buried wires provided on the second surface are different from each other.

5. The liquid ejecting head according to claim 4, wherein the number of the buried wires provided on the second surface is larger than the number of the buried wires provided on the first surface.

6. The liquid ejecting head according to claim 1, wherein the number of the buried wires provided on the first surface and the number of the buried wires provided on the second surface are the same as each other.

7. The liquid ejecting head according to claim 1, wherein a plurality of the drive elements are provided, wherein a common electrode that is common to the plurality of drive elements is provided, wherein the wiring board is provided with a bias wire that is connected to the common electrode and through which a bias voltage, which is a reference potential, is supplied to the common electrode, wherein the bias wire is provided with a buried wire that is buried in a groove provided on the wiring board, and wherein one of the first drive signal wire and the second drive signal wire, which is provided with a larger number of buried wires, the bias wire, and the other one of the first drive signal wire and the second drive signal wire, which is provided with a smaller number of buried wires, are arranged in this order.

8. A liquid ejecting apparatus comprising:

the liquid ejecting head according to claim 1; and a drive signal generation circuit that generates the first drive signal and the second drive signal, wherein, the number of the buried wires of the first drive signal wire is larger than the number of buried wires of the second drive signal wire in a case where a value of an electric current, which flows through the first drive signal wire for one discharge cycle via the first drive signal and the second drive signal generated by the drive signal generation circuit, is larger than a value of an electric current, which flows through the second drive signal wire for one discharge cycle via the first drive signal and the second drive signal generated by the drive signal generation circuit.

9. A liquid ejecting apparatus comprising:

the liquid ejecting head according to claim 2; and a drive signal generation circuit that generates the first drive signal and the second drive signal, wherein, the number of the buried wires of the first drive signal wire is larger than the number of buried wires of the second drive signal wire in a case where a value of an electric current, which flows through the first drive signal wire for one discharge cycle via the first drive signal and the second drive signal generated by the drive signal generation circuit, is larger than a value of an electric current, which flows through the second drive signal wire for one discharge cycle via the first drive signal and the second drive signal generated by the drive signal generation circuit.

10. A liquid ejecting apparatus comprising:

the liquid ejecting head according to claim 3; and a drive signal generation circuit that generates the first drive signal and the second drive signal, wherein, the number of the buried wires of the first drive signal wire is larger than the number of buried wires of the second drive signal wire in a case where a value of an electric current, which flows through the first drive signal wire for one discharge cycle via the first drive signal and the second drive signal generated by the drive signal generation circuit, is larger than a value of an electric current, which flows through the second drive signal wire for one discharge cycle via the first drive signal and the second drive signal generated by the drive signal generation circuit.

11. A liquid ejecting apparatus comprising:

the liquid ejecting head according to claim 4; and a drive signal generation circuit that generates the first drive signal and the second drive signal, wherein, the number of the buried wires of the first drive signal wire is larger than the number of buried wires of the second drive signal wire in a case where a value of an electric current, which flows through the first drive signal wire for one discharge cycle via the first drive signal and the second drive signal generated by the drive signal generation circuit, is larger than a value of an electric current, which flows through the second drive signal wire for one discharge cycle via the first drive signal and the second drive signal generated by the drive signal generation circuit.

12. A liquid ejecting apparatus comprising:

the liquid ejecting head according to claim 5; and a drive signal generation circuit that generates the first drive signal and the second drive signal, wherein, the number of the buried wires of the first drive signal wire is larger than the number of buried wires of the second drive signal wire in a case where a value of an electric current, which flows through the first drive signal wire for one discharge cycle via the first drive signal and the second drive signal generated by the drive signal generation circuit, is larger than a value of an electric current, which flows through the second drive signal wire for one discharge cycle via the first drive signal and the second drive signal generated by the drive signal generation circuit.

13. A liquid ejecting apparatus comprising:

the liquid ejecting head according to claim 6; and a drive signal generation circuit that generates the first drive signal and the second drive signal, wherein, the number of the buried wires of the first drive signal wire is larger than the number of buried wires of the second drive signal wire in a case where a value of an electric current, which flows through the first drive signal wire for one discharge cycle via the first drive signal and the second drive signal generated by the drive signal generation circuit, is larger than a value of an electric current, which flows through the second drive signal wire for one discharge cycle via the first drive signal and the second drive signal generated by the drive signal generation circuit.

14. A liquid ejecting apparatus comprising:

the liquid ejecting head according to claim 7; and a drive signal generation circuit that generates the first drive signal and the second drive signal, wherein, the number of the buried wires of the first drive signal wire is larger than the number of buried wires of the second drive signal wire in a case where a value of an electric current, which flows through the first drive signal wire for one discharge cycle via the first drive signal and the second drive signal generated by the drive signal generation circuit, is larger than a value of an electric current, which flows through the second drive signal wire for one discharge cycle via the first drive signal and the second drive signal generated by the drive signal generation circuit.

15. A liquid ejecting head comprising:

a drive element that causes a change in pressure of liquid in a flow path communicating with a nozzle from which the liquid is ejected;

a drive circuit that outputs a signal for driving the drive element; and a wiring board of which a first surface is on the drive circuit side and a second surface is on the drive element side, the first surface being on a side opposite to the drive element, wherein the wiring board is provided with a power supply wire through which power is supplied to the drive circuit, a first drive signal wire through which a first drive signal is supplied to the drive circuit, and a second drive signal wire through which a second drive signal is supplied to the drive circuit and that is not electrically connected to the power supply wire and the first drive signal wire on the wiring board, wherein each of the first drive signal wire and the second drive signal wire is provided with a buried wire that is buried in a groove provided on the wiring board, and wherein a total electrical resistivity of the buried wires of the first drive signal wire and a total electrical resistivity of the buried wires of the second drive signal wire are different from each other.

16. A liquid ejecting apparatus comprising:

the liquid ejecting head according to claim 15.

* * * * *